US012245731B2

(12) United States Patent
Resch et al.

(10) Patent No.: US 12,245,731 B2
(45) **Date of Patent: *Mar. 11, 2025**

(54) SURFACE CLEANING APPARATUS WITH STEAM

(71) Applicant: BISSELL Inc., Grand Rapids, MI (US)

(72) Inventors: Jacob Resch, Rockford, MI (US); Andrew Woodcox, Holland, MI (US); Jeremy W. Hoffmann, Comstock Park, MI (US)

(73) Assignee: BISSELL Inc., Grand Rapids, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/215,878

(22) Filed: Jun. 29, 2023

(65) Prior Publication Data

US 2023/0337888 A1 Oct. 26, 2023

Related U.S. Application Data

(63) Continuation of application No. 17/704,626, filed on Mar. 25, 2022, now Pat. No. 11,730,335.

(51) Int. Cl.
*A47L 11/40* (2006.01)
*A47L 11/34* (2006.01)

(52) U.S. Cl.
CPC ..... *A47L 11/4086* (2013.01); *A47L 11/4016* (2013.01); *A47L 11/4041* (2013.01); *A47L 11/4083* (2013.01); *A47L 11/4088* (2013.01); *A47L 11/34* (2013.01)

(58) Field of Classification Search
CPC ..... A47L 11/4086; A47L 11/4016; A47L 11/4041; A47L 11/4083; A47L 11/4088; A47L 11/34; A47L 11/185; A47L 11/201; A47L 11/202; A47L 11/4044
See application file for complete search history.

(56) References Cited

U.S. PATENT DOCUMENTS

| | | | |
|---|---|---|---|
| 6,571,421 | B1 | 6/2003 | Sham et al. |
| 6,898,820 | B2 | 5/2005 | Kasper et al. |
| 6,934,995 | B2 | 8/2005 | Wheeler et al. |
| 7,048,804 | B2 | 5/2006 | Kisela et al. |
| 7,617,563 | B2 | 11/2009 | Hertrick et al. |
| 7,640,626 | B2 | 1/2010 | Oh |
| 7,752,705 | B2 | 7/2010 | McDowell et al. |

(Continued)

FOREIGN PATENT DOCUMENTS

| | | | |
|---|---|---|---|
| CN | 110338719 | A | 10/2019 |
| CN | 110353560 | A | 10/2019 |

(Continued)

*Primary Examiner* — David Redding
(74) *Attorney, Agent, or Firm* — Warner Norcross + Judd LLP

(57) ABSTRACT

A surface cleaning apparatus includes a steam delivery system, a liquid delivery system, and a recovery system. The steam delivery system may include a steam dispenser having one outlet to dispense steam toward the surface to be cleaned and another outlet to dispense steam away from the surface to be cleaned as visible steam vapor. The apparatus may have multiple cleaning modes, including a mode where liquid is dispensed and a mode where liquid and steam are dispensed. Methods for operating a surface cleaning apparatus and for self-cleaning a surface cleaning apparatus are also provided.

20 Claims, 31 Drawing Sheets

(56) References Cited

U.S. PATENT DOCUMENTS

| | | | | |
|---|---|---|---|---|
| 8,056,181 | B2 | 11/2011 | Kim et al. | |
| 8,627,543 | B2 | 1/2014 | Vrdoljak et al. | |
| 8,752,236 | B2 | 6/2014 | Oh et al. | |
| 10,376,124 | B2 | 8/2019 | McDowell et al. | |
| 10,512,383 | B2 | 12/2019 | Luyckx et al. | |
| 10,820,769 | B2 | 11/2020 | Xia et al. | |
| 11,730,335 | B1 * | 8/2023 | Resch | A47L 11/201 15/320 |
| 2008/0301900 | A1 | 12/2008 | Choi et al. | |
| 2012/0284950 | A1 | 11/2012 | De Wit et al. | |
| 2014/0053363 | A1 | 2/2014 | Barlotti et al. | |
| 2014/0208536 | A1 | 7/2014 | Ni | |
| 2020/0022550 | A1 | 1/2020 | Amoretti | |
| 2020/0060502 | A1 * | 2/2020 | Davila | A47L 11/4041 |

FOREIGN PATENT DOCUMENTS

| | | | | |
|---|---|---|---|---|
| EP | 1603446 | B1 | 6/2010 | |
| EP | 3016565 | A1 | 7/2020 | |
| KR | 20210073460 | A * | 6/2021 | A47L 11/4091 |

* cited by examiner

SURFACE CLEANING APPARATUS WITH STEAM

CROSS-REFERENCE TO RELATED APPLICATION(S)

This application is a continuation of U.S. patent application Ser. No. 17/704,626, filed Mar. 25, 2022, now U.S. Pat. No. 11,730,335, issued Aug. 22, 2023, which is incorporated herein by reference in its entirety.

BACKGROUND

Multi-surface or wet/dry vacuum cleaners are adapted for cleaning hard floor surfaces such as tile and hardwood and soft floor surfaces such as carpet and upholstery. Some multi-surface vacuum cleaners comprise a fluid delivery system that delivers cleaning fluid to a surface to be cleaned and a fluid recovery system that extracts spent cleaning fluid and debris (which may include dirt, dust, stains, soil, hair, and other debris) from the surface. The fluid delivery system typically includes one or more fluid supply tanks for storing a supply of cleaning fluid, a fluid distributor for applying the cleaning fluid to the surface to be cleaned, and a fluid supply conduit for delivering the cleaning fluid from the fluid supply tank to the fluid distributor. An agitator can be provided for agitating the cleaning fluid on the surface. The fluid recovery system typically includes a recovery tank, a nozzle adjacent the surface to be cleaned and in fluid communication with the recovery tank through a working air conduit, and a source of suction in fluid communication with the working air conduit to draw the cleaning fluid from the surface to be cleaned and through the nozzle and the working air conduit to the recovery tank.

Other cleaning apparatuses include steam cleaners that dispense steam, and spot cleaners that may dispense liquid and scrub the surface, but do not recover liquid.

BRIEF SUMMARY

A surface cleaning apparatus with steam delivery is provided herein. In certain embodiments, the surface cleaning apparatus is a wet/dry vacuum cleaner or wet/dry multi-surface cleaner that can be used to clean hard floor surfaces such as tile and hardwood and soft floor surfaces such as carpet.

According to one aspect of the disclosure, a surface cleaning apparatus includes an upright body, a base assembly coupled with the upright body, a recovery system, a liquid dispenser, a heater configured to heat cleaning fluid to generate steam, and a steam dispenser, wherein the steam dispenser includes a floor steam outlet to dispense steam toward the surface to be cleaned and a steam vapor outlet to dispense steam away from the surface to be cleaned as visible steam vapor.

In this and other aspects of the disclosure, the surface cleaning apparatus includes a plurality of modes of operation, including at least a first liquid cleaning mode in which liquid is dispensed from the liquid dispenser at a first flow rate, a second liquid cleaning mode in which liquid is dispensed from the liquid dispenser at a second flow rate that is greater than the first flow rate, and a steam mode in which steam is dispensed from the steam dispenser, wherein the steam mode is executable in conjunction with the first liquid cleaning mode or the second liquid cleaning mode.

In this and other aspects of the disclosure, the liquid delivery system comprises a first pump disposed in a liquid supply path between the supply tank and the liquid dispenser, the steam delivery system comprises a second pump disposed in a steam supply path between the supply tank and the heater, the heater, the vacuum motor, and the steam pump are disposed within the upright body, at least one of the supply tank and the recovery tank is removably mounted to the upright body, and the liquid dispenser and the liquid pump are disposed on the base assembly.

According to another aspect of the disclosure, a surface cleaning apparatus includes an upright body, a base assembly coupled with the upright body, a recovery system, a liquid delivery system comprising a liquid dispenser, and a steam delivery system including a heater configured to heat cleaning fluid to generate steam, and a steam dispenser on the base assembly, wherein the heater is disposed in a heater cavity on the upright body, and has a heater inlet in fluid communication with a supply tank and a heater outlet in fluid communication with the steam dispenser, wherein the heater inlet and the heater outlet are disposed at a lower end of the heater.

According to yet another aspect of the disclosure, a surface cleaning apparatus includes an upright body, a base assembly coupled with the upright body, and a recovery system including a suction inlet port on the base assembly, a recovery tank, a vacuum motor, and a recovery path extending from the suction inlet port to an exhaust vent, wherein the exhaust vent is formed in the recovery tank.

According to still another aspect of the disclosure, a surface cleaning apparatus includes a base assembly adapted for movement across a surface to be cleaned, a plurality of modes of operation, and a status display on the base assembly, the status display including a plurality of illumination elements within the base assembly, a plurality of icons representative of the plurality of modes of operation, the plurality of icons viewable at an upper side of the base assembly, and a baffle assembly having a plurality of baffle sections, each baffle section having an input opening aligned with one of the plurality of illumination elements, an output opening lighted with one of the plurality of icon, and a reflector to reflect the light emitted by the one of the plurality of illumination elements toward the output opening.

According to a further aspect of the disclosure, a surface cleaning apparatus includes a recovery system, a liquid delivery system, a steam system, a controller to control the operation of the systems, a detection mechanism that detects docking of the base assembly on a tray, and a self-cleaning mode in which an unattended, automatic cleanout cycle is executed to clean at least a portion of the recovery system, wherein the controller is configured to enable the self-cleaning mode when the detection mechanism detects that the base assembly is on the tray and the controller is configured to disable the self-cleaning mode when the detection mechanism does not detect that the base assembly is on the tray.

These and other features and advantages of the present disclosure will become apparent from the following description of particular embodiments, when viewed in accordance with the accompanying drawings and appended claims.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. In addition, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components. Any reference to claim elements as "at least one of X, Y and Z" is meant to include any one of X, Y or Z individually, and any combination of X, Y and Z, for example, X, Y, Z; X, Y; X, Z; and Y, Z.

BRIEF DESCRIPTION

Figure 1:
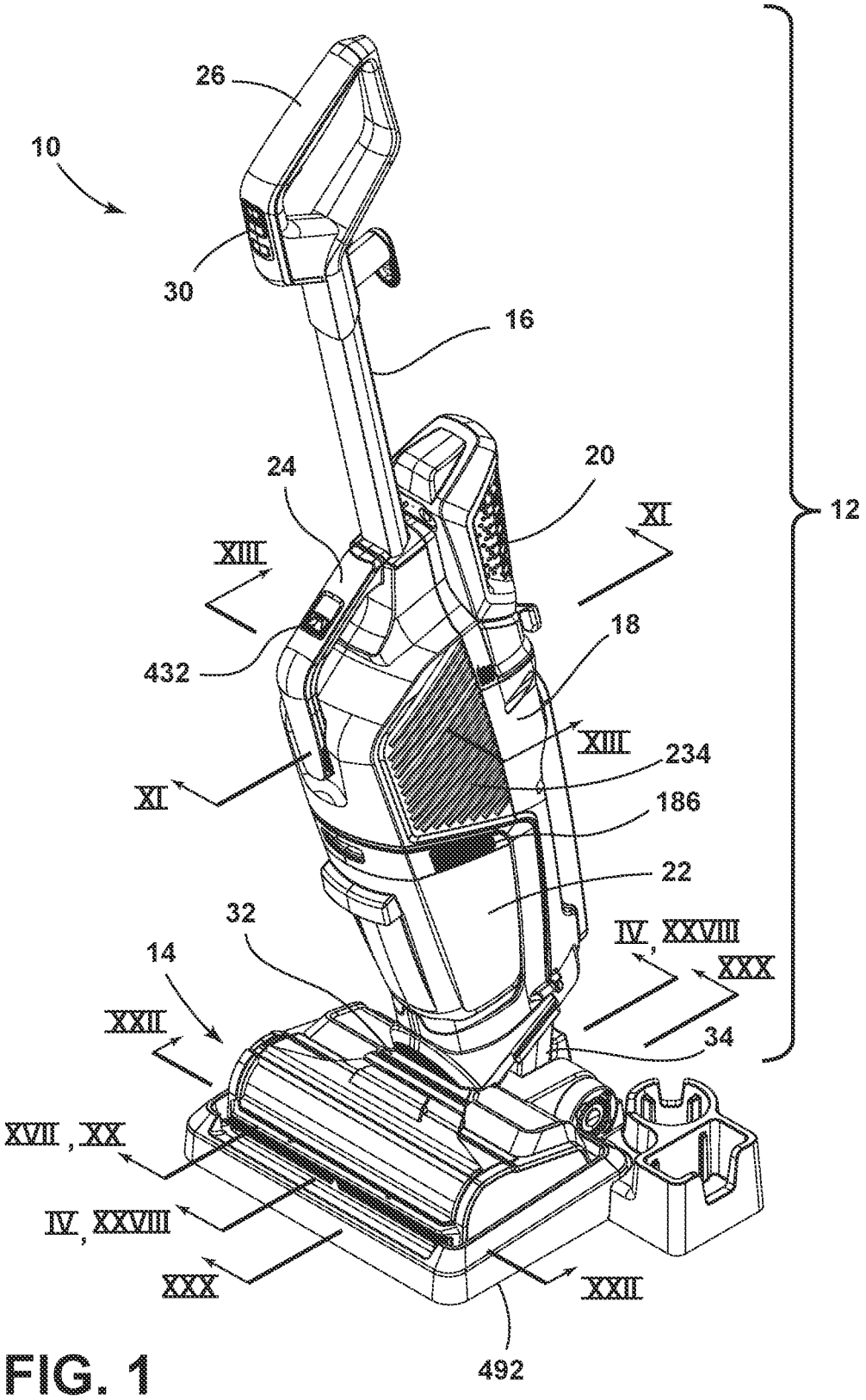
FIG. 1 is a perspective view of a floor cleaner according to one aspect of the disclosure, the floor cleaner docked on a tray in a upright storage position.

The invention generally relates to a surface cleaning apparatus with steam delivery. Aspects of the disclosure described herein are further related to an upright wet/dry vacuum cleaner or wet/dry multi-surface cleaner that can delivery liquid and/or steam to clean hard floor surfaces such as tile and hardwood and soft floor surfaces such as carpet.

As used herein, the term "dirt" includes dirt, soil, dust, hair, stains, and other debris, unless otherwise noted.

As used herein, the term "cleaning fluid" may encompass liquid, steam, or a mixture of both liquid and steam, and may include the presence of a surface cleaning and/or treatment agent. Examples of cleaning fluids are water or solutions containing water (like water mixed with a cleaning chemistry, fragrance, etc.), As used herein, the term "steam" includes a cleaning fluid at least partially converted to a gas or vapor phase. The cleaning fluid can be boiled or otherwise at least partially converted to the gas or vapor phase by heating a cleaning fluid with a heat source on board the floor cleaner. The cleaning fluid can be heated to around 100±10° C., alternately about 90 to 100° C., alternatively about 95 to 98° C. Alternatively, steam may be produced by a mechanical action like nebulizing. The steam can be invisible to the naked eye, in the form of a visible vapor that can be observed by the naked eye, or combinations thereof.

The steam can have a steam quality of 100% or less, alternatively about 50% or greater, alternatively about 60% or greater, alternatively about 70% or greater, alternatively about 80% or greater, alternatively about 90% or greater, alternatively about 90-100%. As used herein, "steam quality" is the proportion of saturated steam in a saturated condensate (liquid) and steam mixture. For example, saturated steam vapor has a steam quality of 100%, and saturated liquid has a steam quality of 0%.

As used herein, the terms "visible vapor," "visible steam," or "visible steam vapor" includes steam that can be observed by the naked eye and is therefore visible to a user of the floor cleaner.

As used herein, the term "liquid" includes a cleaning fluid having a temperature below the temperature of steam, including but not limited to 32 to 55° C. The liquid may or may not be heated by a heat source on board the surface cleaning apparatus. The liquid may have a steam quality of 0%.

The functional systems of the surface cleaning apparatus can be arranged into any desired configuration, such as an upright device having a base and an upright body for directing the base across the surface to be cleaned, a canister device having a cleaning implement connected to a wheeled base by a vacuum hose, a portable device adapted to be hand carried by a user for cleaning relatively small areas, or a commercial device. Any of the aforementioned cleaners can be adapted to include a flexible vacuum hose, which can form a portion of the working air conduit between a nozzle and the suction source. As used herein, the term "multi-surface" or "wet/dry" vacuum cleaner includes a vacuum cleaner that can be used to clean hard floor surfaces such as tile and hardwood and soft floor surfaces such as carpet.

FIG. 1 is a perspective view of a surface cleaning apparatus or floor cleaner 10 according to one aspect of the present disclosure. As discussed in further detail below, the floor cleaner 10 is provided with various features and improvements, which are described in further detail below. The floor cleaner 10 can include multiple cleaning systems, including a liquid delivery system, a steam delivery system, and a recovery system. With both steam and liquid delivery systems, the floor cleaner 10 can selectively deliver liquid and/or steam to the surface to be cleaned.

As illustrated herein, the floor cleaner 10 can be an upright floor cleaner having a housing that includes a cleaning head in the form of a base 14 adapted to move over a surface to be cleaned and an upper housing in the form of an upright body 12 coupled with the base 14 to direct the base 14 over the surface to be cleaned. The various cleaning systems and components thereof can be supported by either or both the base 14 and the upright body 12. For purposes of description related to the figures, the terms "upper," "lower," "right," "left," "rear," "front," "vertical," "horizontal," "inner," "outer," and derivatives thereof shall relate to the disclosure as oriented in FIG. 1 from the perspective of a user behind the floor cleaner 10, which defines the rear of the floor cleaner 10. However, it is to be understood that the disclosure may assume various alternative orientations, except where expressly specified to the contrary.

As used herein, the term upright floor cleaner is intended to refer to various types of floor cleaners including, but not limited to, upright floor cleaners, stick floor cleaners, convertible floor cleaners (e.g., a floor cleaner capable of being used as an upright- or stick-type cleaner as well as a handheld cleaner), lift-off floor cleaners (e.g., a floor cleaner capable of being used as an upright-type cleaner as well as a canister type cleaner), and the like, or combinations thereof. In one embodiment, the upright floor cleaner is an upright multi-surface wet vacuum cleaner.

The base 14 can comprise any type of base, foot, or other cleaning head suitable for the purposes described herein, including being moved over a floor surface to be cleaned. The base 14 may include any of a suction nozzle, an agitator (e.g. a brushroll, a pad, etc.), a squeegee, a wheel, a pump, a heater, a motor, a tank, a filter, a dispenser, a battery, a wireless communication module, a hose, and the like, or any combination thereof.

The upright body 12 can comprise any type of elongated handle, wand, body, or combination thereof suitable for the purposes described herein, including for a user to maneuver the floor cleaner 10 over a floor surface to be cleaned. The upright body 12 can include a handle 16 and a frame 18. The frame 18 can comprise a main support section supporting at least a supply tank 20 and a recovery tank 22, and may further support additional components of the body 12. The floor cleaner 10 can include a fluid delivery or supply pathway, including and at least partially defined by the supply tank 20, for storing cleaning fluid and delivering the cleaning fluid to the surface to be cleaned and a recovery pathway, including and at least partially defined by the recovery tank 22, for removing the spent cleaning fluid and debris from the surface to be cleaned and storing the spent cleaning fluid and debris until emptied by the user.

Optionally, the body 12 can have a carry handle 24 to facilitate lifting and carrying the entire floor cleaner 10. The carry handle 24 can be disposed on a top and/or upper side of the frame 18, generally lower than the handle 16, although the carry handle 24 may, in some embodiments, partially overlap the handle 16.

The handle 16 can include a hand grip 26 and a trigger 28 mounted to the hand grip 26, which controls fluid delivery from the supply tank 20 via an electronic or mechanical coupling with the tank 20. The trigger 28 can project at least partially exteriorly of the hand grip 26 for user access. Other actuators, such as a thumb switch, can be provided to control fluid delivery instead of the trigger 28. In yet other embodiments, separate actuators for liquid and steam delivery can be provided.

Other components of the body 12 may include any of a pump, a motor, a filter, a dispenser, a battery, a wireless communication module, a wand, a hose, and the like, or any combination thereof.

The floor cleaner 10 may include at least one user interface ("UI") through which a user can interact with the floor cleaner 10 to accomplish one or more functions. In some embodiments, the floor cleaner 10 may include a first UI 30 and a second UI 32. One UI 30 can be provided on the body 12 and the other UI 32 can be provided on the base 14. The UIs 30, 32 can, among other abilities, accept user inputs for controlling the cleaning system and/or function as a communication output device for the cleaning system.

To accept user inputs, the UIs 30, 32 can have at least one user input control operably connected to one or more components or systems of the floor cleaner 10 to affect and control its operation. Non-limiting examples of input controls include buttons, triggers, toggles, keys, switches, or the like, or any combination thereof.

To communicate output to the user, the UIs 30, 32 can have at least one status indicator, or a status display including a plurality of status indicators, that communicates a condition or status of the floor cleaner 10, including systems and components thereof, to the user. Non-limiting examples of status indicators include visual indicators such as lights (e.g., LEDs), icon displays, textual displays, graphical displays, or the like, or any combination thereof. The UIs 30, 32 can also include an auditory output component, such as a speaker.

In one embodiment, the first UI 30 is an input UI configured to accept user inputs to control the floor cleaner 10, including systems or components thereof and the second UI 32 is an output UI configured to indicate status information relating to the floor cleaner 10, including systems or components thereof. For example, the first UI 30 can include multiple input controls to affect and control the operation of the liquid delivery system, the steam delivery system, the recovery system, or any combination thereof. As yet another example, the input controls may affect and control the operation of a motor, a brushroll, a liquid dispenser, a steam dispenser, a pump, a filter, a supply tank, a recovery tank, a battery, a wireless communication module, and the like, or any combination thereof. The second UI 32 can include a display may indicate a cleaning mode of the floor cleaner 10, a Wi-Fi connection status of the floor cleaner, and the like, or any combination thereof. As another example, the display may indicate that status of the liquid delivery system, the steam delivery system, the recovery system, or any combination thereof. As yet another example, the display may indicate that status of a motor, a brushroll, a liquid dispenser, a steam dispenser, a pump, a filter, a supply tank, a recovery tank, a battery, a wireless communication module, and the like, or any combination thereof.

While the first UI 30 is referred to herein as an input UI, in some embodiments the first UI 30 may have an output functionality as well. For example, the first UI 30 may, in some embodiments, include at least one status indicator that communicates a condition or status of the floor cleaner, including systems and components thereof, to the user. In other embodiments, the first UI 30 solely accepts input, and does not provide outputs to the user.

Likewise, while the second UI 32 is referred to herein as an output UI, in some embodiments the second UI 32 may have an input functionality as well. For example, the second UI 32 may, in some embodiments, include at least one user input control operably connected to one or more components or systems of the floor cleaner 10 to affect and control its operation. In other embodiments, the second UI 32 solely provides output, and does not accept inputs from the user.

The first and second UIs 30, 32 are separate from each other, and are located on different areas of the floor cleaner 10. The upright body 12, or more particularly the handle 16, or more particularly the hand grip 26, can include the first UI 30. The first UI 30 can conveniently be located adjacent to the grip 26, so that a user may hold the grip 26 in one hand and operate the first UI 30 with the same hand. For example, a user may wrap their palm and fingers around the grip 26, and operate the first UI 30 using the thumb of the same hand. Similarly, the trigger 28 can conveniently be located adjacent to the grip 26 and first UI 30. For example, the user may operate the trigger 28 using the forefinger of the same hand holding the grip 26. Conveniently, in one arrangement, the UI 30 is disposed on a front side of the grip 26 and the trigger 28 is disposed on a rear side of the grip 26.

Other locations for the first UI 30 are possible, including locations where the user must hold the grip 26 in one hand and operate the first UI 30 with their other hand. It may be preferred that the first UI 30 is in a location that the user holding the grip 26 may operate the first UI 30 without having to bend down or take their hand off the grip 26. Such locations include, but are not limited to, on a portion of the handle 16 other than the grip 26, on the carry handle 24, or on an upper portion of the frame 18. In other embodiments, the first UI 30 may be distributed across multiple portions of the floor cleaner 10, such as including a first portion on the grip 26 and another portion on the handle 16, carry handle 25, or frame 18, for example.

The base 14 can include the second UI 32. The second UI 32 can conveniently be located in a field of view of the user operating the floor cleaner, e.g. in an observable area a person can see through their eyes. When operating the floor cleaner 10, the user commonly looks down the apparatus toward a surface being cleaned and/or toward the base 14 moving over the surface. For example, to operate the floor cleaner 10, the user may stand generally behind the floor cleaner 10 and hold the grip 26 in one hand. During operation, the user commonly looks down the floor cleaner 10 toward a floor surface being cleaned. As such, their field of view includes the base 14 of the floor cleaner 10. Locating the second UI 32 on the base 14 positions the second UI in the user's field of view. During operation of the floor cleaner 10, the user can quickly glance back and forth between the floor surface being cleaned and the second UI 32. Even when the user's attention is focused on the floor surface, changes displayed on the second UI 32 are within the user's field of view, and so may readily draw the user's attention to the information conveyed by second UI 32.

Although shown on the base 14, and particularly on a top side of the base 14, other locations for the second UI 32 are possible. It may be preferred that the second UI 32 is in a location that the user holding the grip 26 may view the second UI 32 without having to bend down or take their hand off the grip 26. Such locations include, but are not limited to, a lower front portion of the frame 18.

Figure 2:
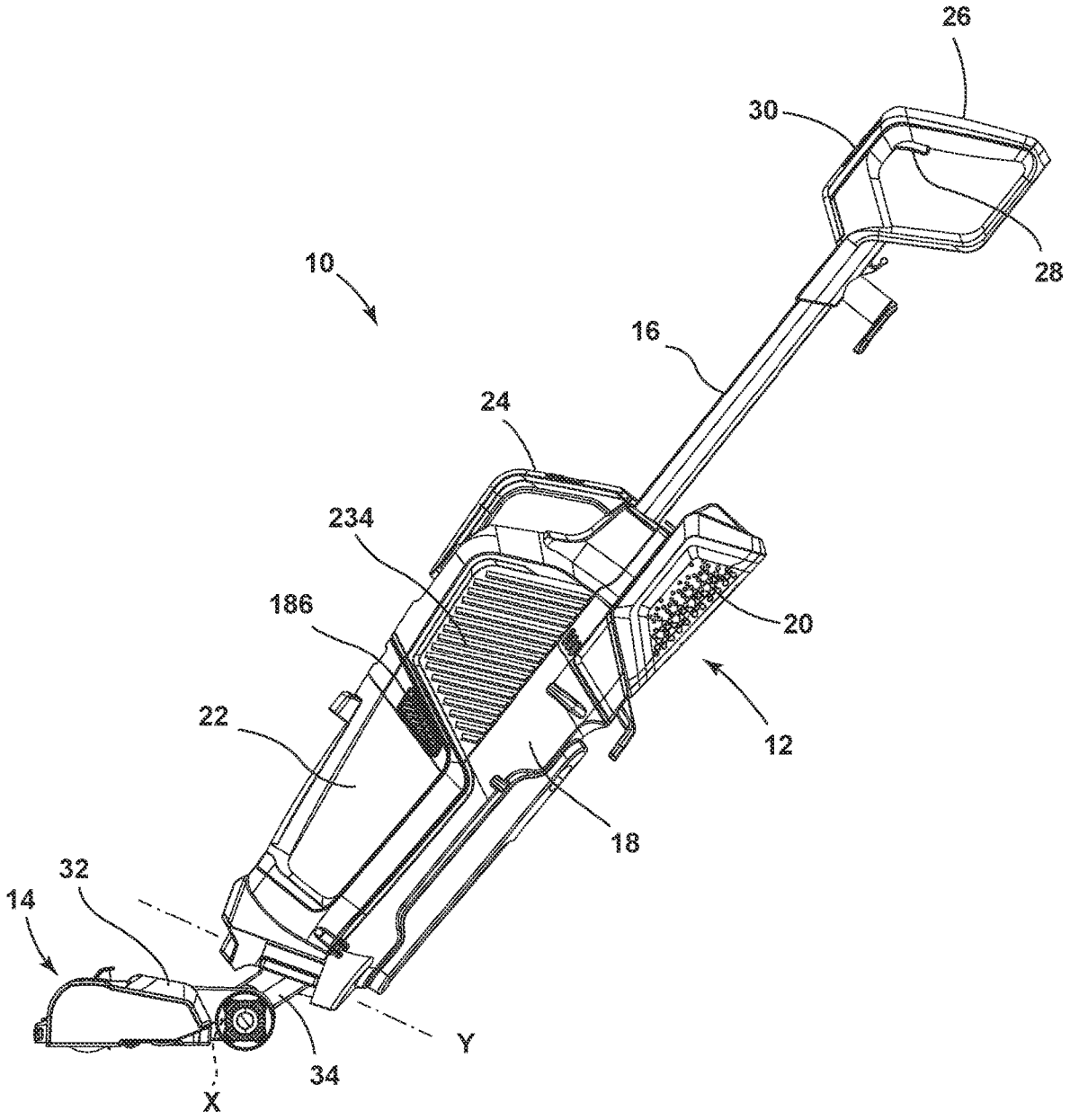
FIG. 2 is a side view of the floor cleaner in a reclined use position on a surface to be cleaned.

A moveable joint assembly 34 can connect the base 14 to the upright body 12 for movement of the upright body 12 about at least one axis. In the embodiment shown herein, the upright body 12 can pivot up and down about a first axis X relative to the base 14. Optionally, the joint assembly 34 can be configured such that the upright body 12 can swivel about a second axis Y in addition to pivoting about the first axis X. The upright body 12 can pivot, via the joint assembly 34, between the upright or storage position, an example of which is shown in FIG. 1, and a reclined or use position, an example of which is shown in FIG. 2, in which the upright body 12 is pivoted rearwardly to form an acute angle with the surface to be cleaned. Wiring and/or conduits can optionally supply electricity, air, liquid and/or steam between the upright body 12 and the base 14, or vice versa, and can extend though the joint assembly 34. As such, in some embodiments, a portion of the cleaning systems can extend through the joint assembly 34.

A joint lock 36 (FIG. 5) can selectively engage and lock the upright body 12 in the upright or storage position. When locked in the upright/storage position, the joint assembly 34 is locked-out and the upright body 12 is not moveable about the at least one axis. When reclined, the joint assembly 34 is released and the upright body 12 can move relative to the base 14 about the at least one axis. Aside from this function, the joint lock 36 is not particularly limited, and may comprise any components and/or configurations suitable for use in/as a joint lock. In one embodiment, the joint lock 36 is a detent mechanism. By way of non-limiting example, the detent mechanism can include a spring-biased detent on the base 14 that engages a portion of the upright body 12 automatically by the action of raising the upright body 12 to the upright storage position. A user can disengage the detent mechanism to recline the upright body 12, for example, by pressing down on the base 14 while pulling the upright body 12 rearwardly. In another example, the base 14 can include an actuator, such as a pedal, button, or lever that a user may press to disengage the detent mechanism.

Figure 3A:
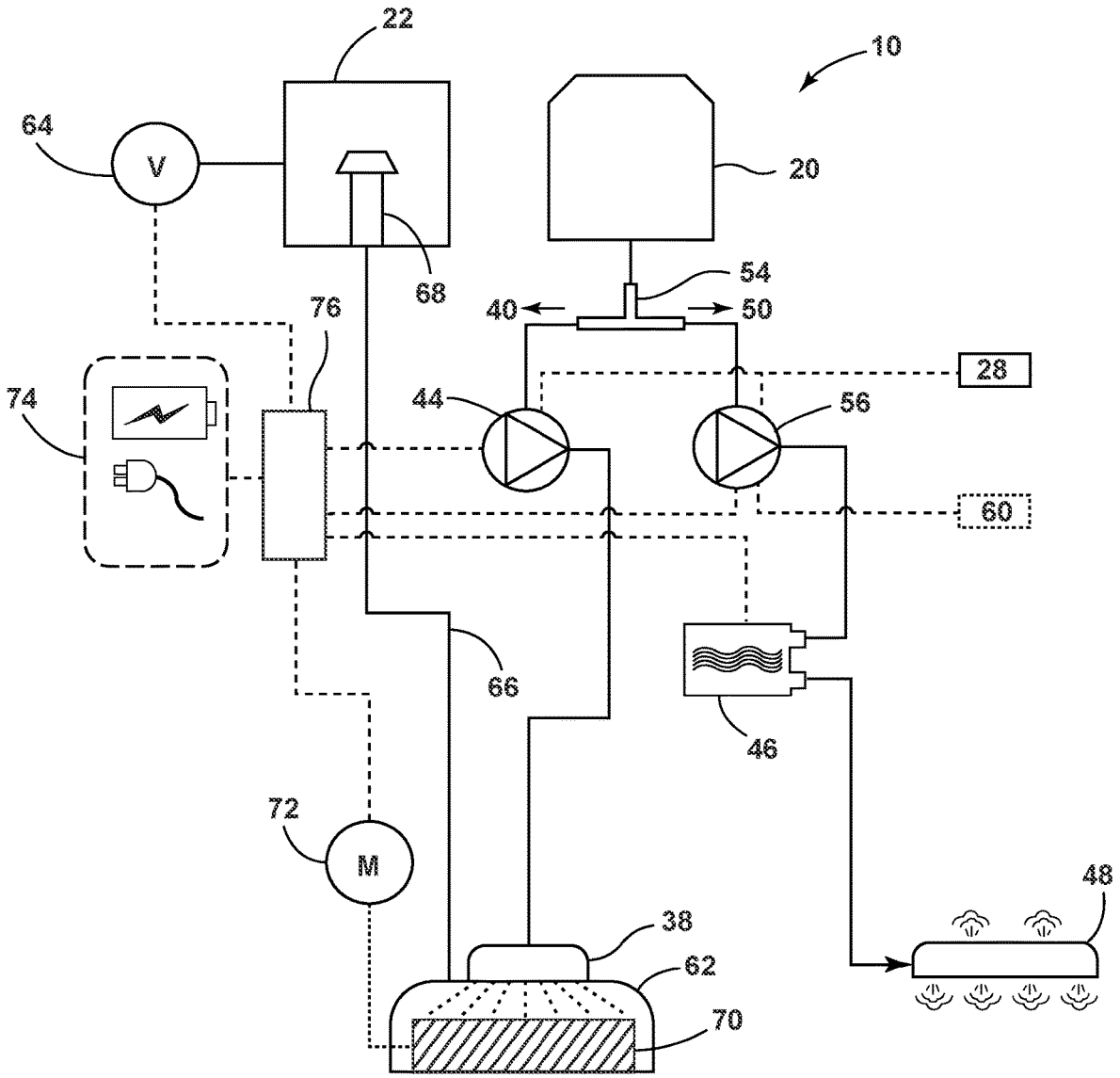
FIG. 3A is a schematic view of various functional systems of the floor cleaner from FIG. 1.

FIG. 3A is a schematic view of various functional systems of the floor cleaner 10. The liquid delivery system includes the supply tank 20 configured to hold a source of cleaning fluid, at least one liquid dispenser 38 supplied with liquid cleaning fluid from the supply tank 20, and a liquid supply path 40 from the supply tank 20 to the liquid dispenser 38.

The supply tank 20 can store cleaning fluid in liquid form. The cleaning fluid can comprise one or more of any suitable cleaning fluids, including, but not limited to, water, compositions, concentrated detergent, diluted detergent, etc., and mixtures thereof. For example, the cleaning fluid can comprise water. In another example, the cleaning fluid can comprise a mixture of water and concentrated detergent.

The liquid delivery system can include a flow controller for controlling the flow of fluid from the supply tank 20 to the liquid dispenser 38. In one configuration, the flow controller can comprise a pump 44, which pressurizes the supply path 40 and controls the delivery of liquid cleaning fluid to the liquid dispenser 38. In one example, the pump 44 can be a centrifugal pump. In another example, the pump 44 can be a solenoid pump.

The release of cleaning liquid from the liquid dispenser 38 can be controlled by the trigger 28. The trigger 28 can operate the liquid pump 44 in the path 40, where depressing the trigger 28 turns the pump 44 on to pressurize the path 40, thereby providing cleaning liquid to the dispenser 38. Release of the trigger 28 de-activates the pump 44 and stops liquid dispensing. As described in further detail below, in some embodiments, operation of the pump 44 upon depression of the trigger 28 can be mode-dependent. In other words, depending on a selected cleaning mode of the floor cleaner 10, depression of the trigger 28 may or may not activate the pump 44.

The liquid dispenser 38 can comprise various structures, such as a nozzle, a spray tip, or a manifold, and can comprise at least one liquid outlet for dispensing liquid cleaning fluid to the surface to be cleaned. The dispenser 38 can be positioned to deliver liquid cleaning fluid directly to the surface to be cleaned, or indirectly by delivering liquid cleaning fluid onto an agitator (not shown). In one non-limiting example, the dispenser 38 delivers liquid cleaning fluid onto a brushroll. In another non-limiting example, the dispenser 38 delivers liquid cleaning fluid between two horizontally-rotating brushrolls.

The liquid delivery system can include other conduits, ducts, tubing, hoses, connectors, valves, etc. fluidly coupling the components of the liquid delivery system together and providing the liquid supply path 40.

In the embodiment shown in FIG. 3A, the liquid delivery system includes a single supply tank 20 for storing a supply of cleaning fluid. In another embodiment, the liquid delivery system can have an additional supply container (not shown) for storing another cleaning fluid. For example, the supply tank 20 can store water and the second supply container can store a cleaning agent such as detergent. In embodiments where multiple supply containers are provided, the floor cleaner 10 can have a mixing system for controlling the composition of the cleaning fluid that is delivered to the surface.

The steam delivery system includes a source of cleaning fluid, a heater 46 for heating the cleaning fluid, a steam dispenser 48 to dispense steam, and a steam supply path 50 from the source of cleaning fluid to the steam dispenser 48. The heater 46 preferably heats the cleaning fluid to around 100±10° C., alternately about 90 to 100° C., alternatively about 95 to 98° C. This temperature may be the temperature at an outlet of the heater 46. The heater 46 itself may operate at a higher temperature, such as around 130° C. Some heat loss between the heater 46 and the steam dispenser 48 is possible, particularly when the system and its components are heating up and pressurizing. Once a "steady state" is reached, the temperature of the steam may be about 90 to 100° C., alternatively about 95 to 98° C. Some non-limiting examples of a suitable heater 46 include, but are not limited to, a flash heater, a boiler, an immersion heater, and a flow-through steam generator.

The steam produced by the heater 46 may include a mixture of vapor phase and liquid phase. For example, the steam output by the heater 46 can have a steam quality of 50% or greater, alternatively about 60% or greater, alternatively about 70% or greater, alternatively about 80% or greater, alternatively about 90% or greater, alternatively about 90-100%. It is noted that the steam quality of the heated fluid that reaches the steam dispenser 48 may change over time, for example depending on how long the trigger 28 or other control actuator is depressed. When the trigger 28 is initially depressed, the steam quality may be higher and may decrease until a steady state is reached.

The steam delivery system can share the same fluid source, e.g. supply tank 20, as the liquid delivery system. In another embodiment, the floor cleaner 10 can include a separate supply container (not shown) for storing a cleaning fluid for the steam delivery system. In embodiments where the supply tank 20 is shared, a manifold splitter 54 splits liquid between the steam supply path 50 and the liquid supply path 40.

The steam delivery system can include a flow controller to control the flow of fluid from the supply tank 20 to the heater 46. In one configuration, the flow controller can comprise a pump 56 that pressurizes the path 50 and controls the delivery of heated fluid to the steam dispenser 48. In one example, the pump 56 can be a centrifugal pump. In another example, the pump 56 can be a solenoid pump.

The release of steam from the steam dispenser 48 can be controlled by the trigger 28. The trigger 28 can activate the steam pump 56 in the path 50, where depressing the trigger 28 turns the pump 56 on to pressurize the path 50, thereby providing liquid to the heater 46, which in turn generates steam, and providing the generated steam to the steam dispenser 48. Release of the trigger 28 de-activates the pump 56 and stops steam dispensing. As described in further detail below, in some embodiments, operation of the steam pump 56 upon depression of the trigger 28 can be mode-dependent. In other words, depending on a selected cleaning mode of the floor cleaner 10, depression of the trigger 28 may or may not activate the steam pump 56. For example, depending on the cleaning mode, operation of the trigger 28 may activate the liquid pump 44 only, the steam pump 56 only, or both pumps 44, 56.

In yet another embodiment, a separate steam input control 60 selectively operates the steam pump 56 to control steam dispensing, while the trigger 28 selectively operates the liquid pump 44 to control liquid dispensing. A user may operate both controls 28, 60 at the same time for simultaneous liquid and steam dispensing.

The steam dispenser 48 can comprise various structures, such as a nozzle or a manifold, and can comprise at least one steam outlet for dispensing steam toward the surface to be cleaned. The dispenser 48 can be positioned to deliver steam directly to the surface to be cleaned, or indirectly by delivering steam onto an agitator or cleaning pad. In one non-limiting example, the steam dispenser 48 delivers steam onto the surface to be cleaned in front of an agitator, such as a brushroll.

The steam delivery system can include other conduits, ducts, tubing, hoses, connectors, valves, etc. fluidly coupling the components of the system together and providing the supply path 50 from the supply tank 20 to the steam dispenser 48.

In certain embodiments, the liquid provided to the liquid dispenser 38 does not pass through the heater 46 and/or is otherwise unheated, and is at the same temperature as the fluid stored in the supply tank 20. In other embodiments, the liquid provided to the liquid dispenser 38 passes through a heater (not shown) or is otherwise heated to a temperature that is less than the temperature of the steam dispensed by the steam dispenser 48. Such a heater can be located downstream of the supply tank 20 and upstream of the pump 44. In yet another example, exhaust air from a motor-cooling pathway for a motor/fan assembly can be applied to the liquid supply path 40 to heat the liquid.

The recovery system can include a recovery path 66 through the cleaner 10 having a path inlet and a path outlet, a suction source including a vacuum motor 64 in fluid communication with the path inlet for generating a working air stream through a recovery path 66, and the recovery tank 22 for separating and collecting fluid and dirt from the working airstream for later disposal. A separator 68 can be formed in a portion of the recovery tank 22 for separating fluid and entrained dirt from the working airstream.

In one embodiment, the path inlet can include a suction inlet port 62 disposed on the cleaning head or base 14, and the path inlet can be defined by a suction nozzle, a brush chamber, and/or a brushroll cover, or any combination thereof, as described in more detail below.

The floor cleaner 10 can include at least one agitator to agitate the surface to be cleaned. In one embodiment, the agitator is a rotating brushroll 70. The liquid dispenser 38 delivers liquid cleaning fluid directly onto the brushroll 70. In one non-limiting example, the suction inlet port 62 is positioned in close proximity to the brushroll 70 to collect liquid and debris directly from the brushroll 70. Other examples of agitators include, but are not limited to, dual horizontally-rotating brushrolls, one or more vertically-rotating brushes, a stationary brush, or a cleaning pad.

A drive assembly including a brushroll motor 72 can drive the brushroll 70. A drive transmission (not shown) operably connects the motor 72 with the brushroll 70 for transmitting rotational motion of the motor 72 to the brushroll 70. In other embodiment, a drive transmission can operably connect the brushroll 70 with the vacuum motor 64 to transmit rotational motion of the motor 64 to the brushroll 70.

The floor cleaner 10 can be provided with above-the-floor cleaning features (not shown), including, but not limited to, an accessory hose and an above-the floor cleaning tool with its own suction inlet and/or fluid dispenser.

Electrical components of the floor cleaner 10, including the heater 46, pumps 44, 56, vacuum motor 64, brushroll motor 72, or any combination thereof, are electrically coupled to a power source 74, which can comprise a power cord plugged into a household electrical outlet or a battery for cordless operation. In one embodiment, the power source 74 comprises a power cord. At least one of the UIs 30, 32 (FIG. 1) can have appropriate input controls for user control of one or more of the heater 46, pumps 44, 56, vacuum motor 64, and brushroll motor 72, thereby controlling the cleaning systems of the floor cleaner 10. For example, cleaning modes can have associated operating parameters for the heater 46, pumps 44, 56, vacuum motor 64, and/or brushroll motor 72, such that user selection of a cleaning mode will operate those components according to the associated operating parameters. At least one of the UIs 30, 32 (FIG. 1) can output status information regarding the selected cleaning modes to the user.

The floor cleaner 10 can include a main controller 76 operably coupled with the various function systems and components of the floor cleaner 10. In one embodiment the main controller 76 can comprise a printed circuit board ("PCB"). As used herein, unless otherwise noted, the term "PCB" includes a printed circuit board having a plurality of electrical and electronic components that provide operational control to the floor cleaner 10. The PCB includes, for example, a processing unit (e.g., a microprocessor, a microcontroller, or another suitable programmable device) and a memory (e.g., a read-only memory ("ROM"), a random access memory ("RAM"), an electrically erasable programmable read-only memory ("EEPROM"), a flash memory, or another suitable magnetic, optical, physical, or electronic memory device). The processing unit is connected to the memory and executes instructions (e.g., software) that is capable of being stored in the RAM (e.g., during execution), the ROM (e.g., on a generally permanent basis), or another non-transitory computer readable medium such as another memory or a disc. Additionally or alternatively, the memory is included in the processing unit (e.g., as part of a microcontroller). Software stored in memory includes, for example, firmware, program data, one or more program modules, and other executable instructions. The processing unit is configured to retrieve from memory and execute, among other things, instructions related to the control processes and methods described herein. The PCB can also include, among other things, a plurality of additional passive and active components such as resistors, capacitors, inductors, integrated circuits, and amplifiers. These components are arranged and connected to provide a plurality of electrical functions to the PCB including, among other things, signal conditioning or voltage regulation. For descriptive purposes, a PCB and the electrical components populated on the PCB are collectively referred to as a controller. Thus, the main PCB and the electrical components populated on the main PCB may be referred to as main controller 76.

Figure 3B:
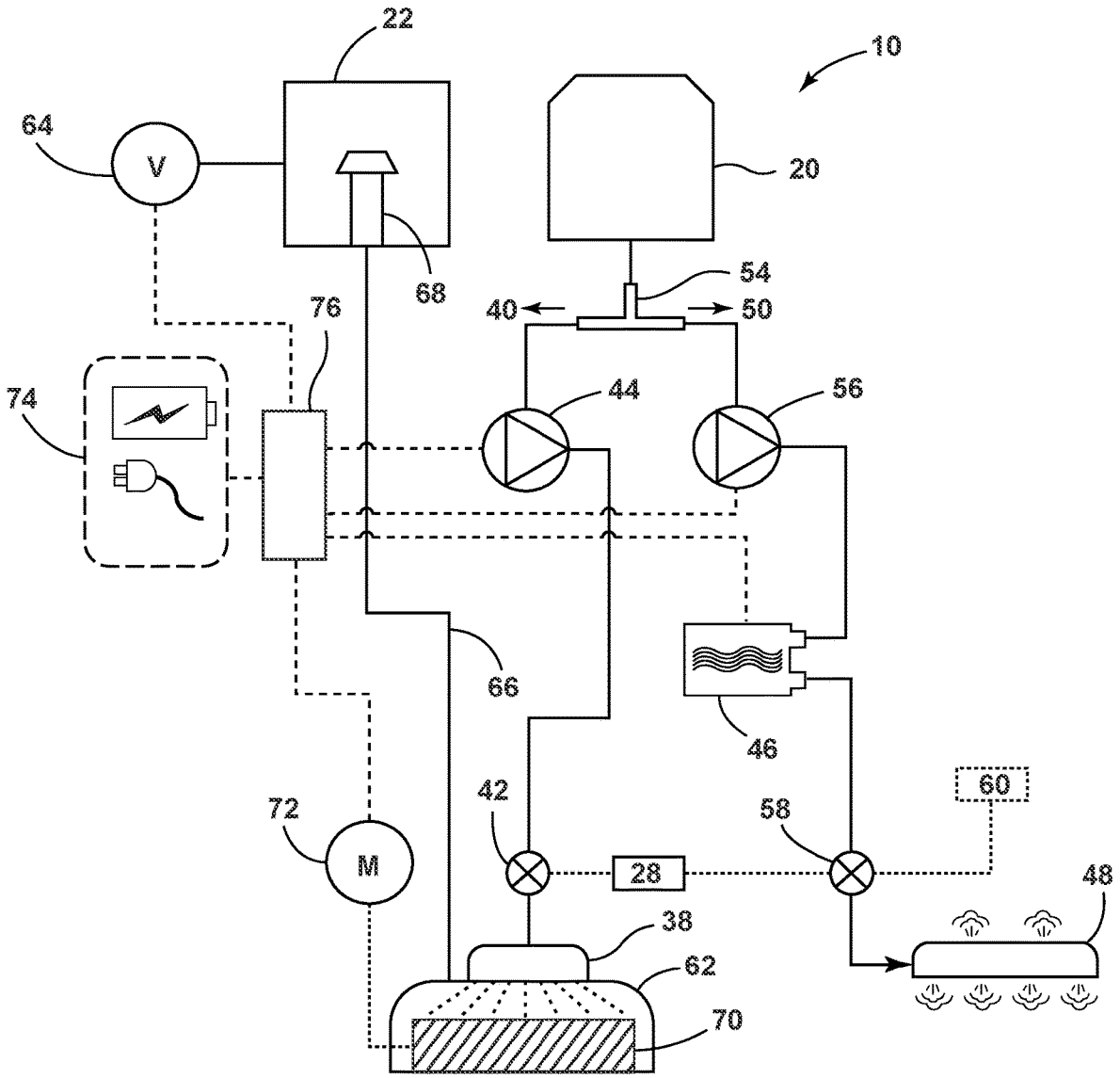
FIG. 3B is a schematic view of various functional systems of the floor cleaner from FIG. 1 having flow controllers according to another embodiment.

FIG. 3B shows another embodiment of the functional systems of the floor cleaner 10, where the liquid and steam delivery systems have flow controllers including valves 42, 58 in the supply paths 40, 50 respectively. The trigger 28 can selectively operate the valves 42, 58, where depressing the trigger 28 opens at least one of the valves 42, 58 to release liquid and/or steam to the associated dispenser 38, 48. Release of the trigger 28 closes the valve 42, 58 and stops dispensing. In some embodiments, operation of the valve 42 upon depression of the trigger 28 can be mode-dependent. In other words, depending on a selected cleaning mode of the floor cleaner 10, depression of the trigger 28 may or may not open one of the valves 42, 58. For example, depending on the cleaning mode, operation of the trigger 28 may open the liquid valve 42 only, the steam valve 58 only, or both the valves 42, 58.

Various locations and configurations for the valves 42, 58 are possible. In one embodiment, the liquid valve 42 is located in the supply path 40 between the liquid pump 44 and the liquid dispenser 38 and the steam valve 58 is located in the supply path 50 between the heater 46 and the steam dispenser 48. The valves 42, 58 may be, for example a solenoid valve or an, 50 other electronic valve. Aside from the function of controlling fluid flow through the paths 40, the valves 42, 58 are not particularly limited, and may comprise any component and/or configuration suitable for use in/as a fluid control valve.

In yet another configuration of the liquid delivery system, the pump 44 can be eliminated and the flow controller can comprise a gravity-feed system having the valve 42 fluidly coupled with an outlet of the supply tank 20, whereby when the valve 42 is open, fluid will flow under the force of gravity to the liquid dispenser 38.

Figure 4:
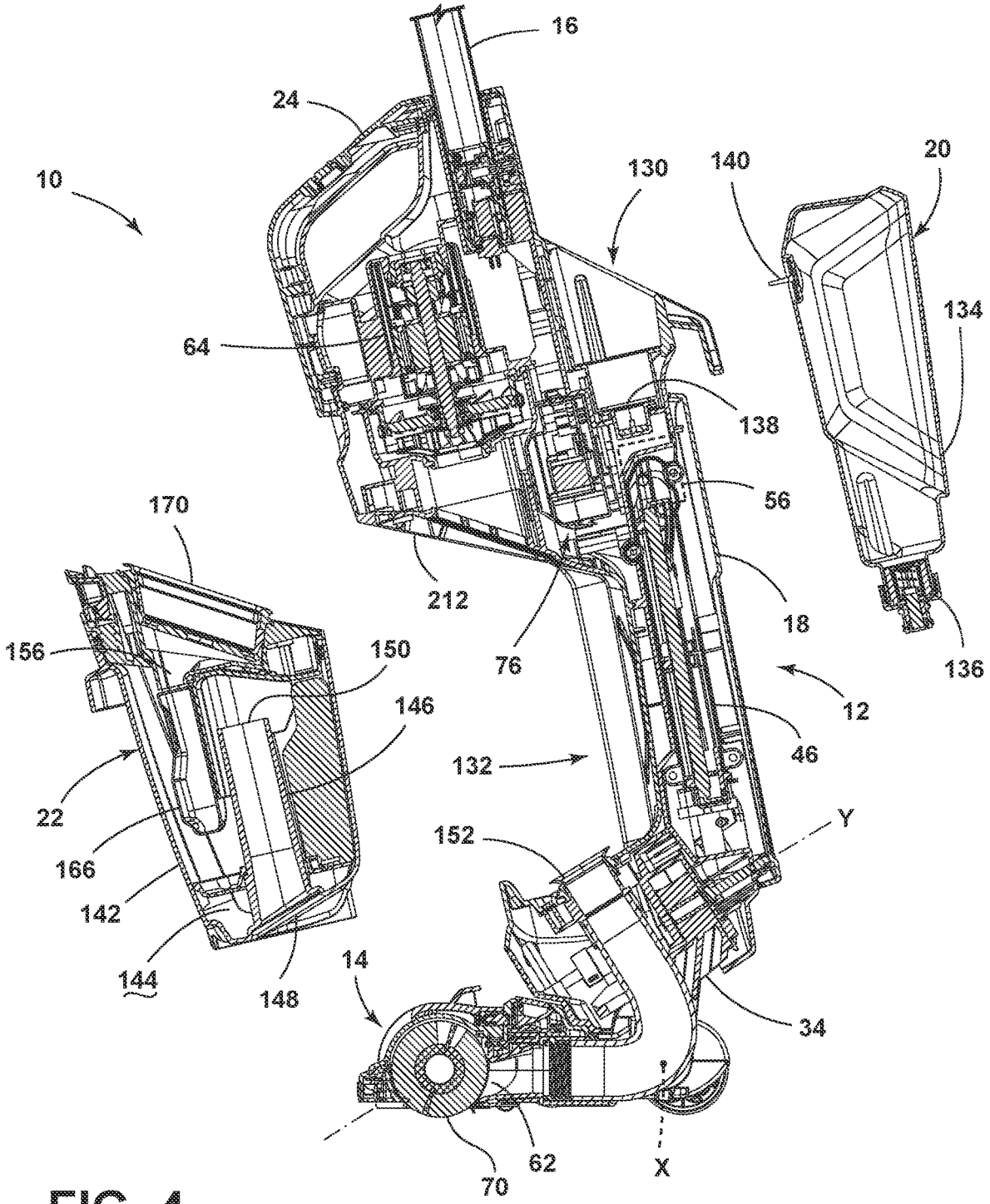
FIG. 4 is a cross-sectional view of the floor cleaner, with a supply tank and recovery tank exploded from the floor cleaner, taken through line IV-IV of FIG. 1.

FIG. 4 shows an architectural layout for the upright body 12 according to one aspect of the disclosure, including locations and relative positions for components of the liquid, steam, and recovery systems. Components including the supply tank 20, heater 46, steam pump 56, and vacuum motor 64 are included on the upright body 12. The components of the upright body 12 are arranged with relative positioning that provides an architecture that is well-balanced and comfortable for the user to operate as the floor cleaner 10 is moved along a surface to be cleaned. For example, the heater 46 is disposed in a lower end of the frame 18 and the vacuum motor 64 is disposed in an upper end of the frame 18 to arrange these heavier components in a generally linear, stacked orientation that can provide a slim upright body 12 that is well-balanced and comfortable to hold in a reclined use position. The recovery tank 22 is disposed on a lower front side of the frame 18, forwardly of the heater 46, with the supply tank 20 disposed on a rear side of the frame 18 above the heater 46 to provide a compact spatial arrangement for the upright body 12. Smaller components such as the steam pump 56 are disposed in the available space between the vacuum motor 64 and the heater 46. Other architectural layouts for the components of the upright body 12 are possible while providing a well-balanced and comfortably operable floor cleaner 10.

Figure 5:
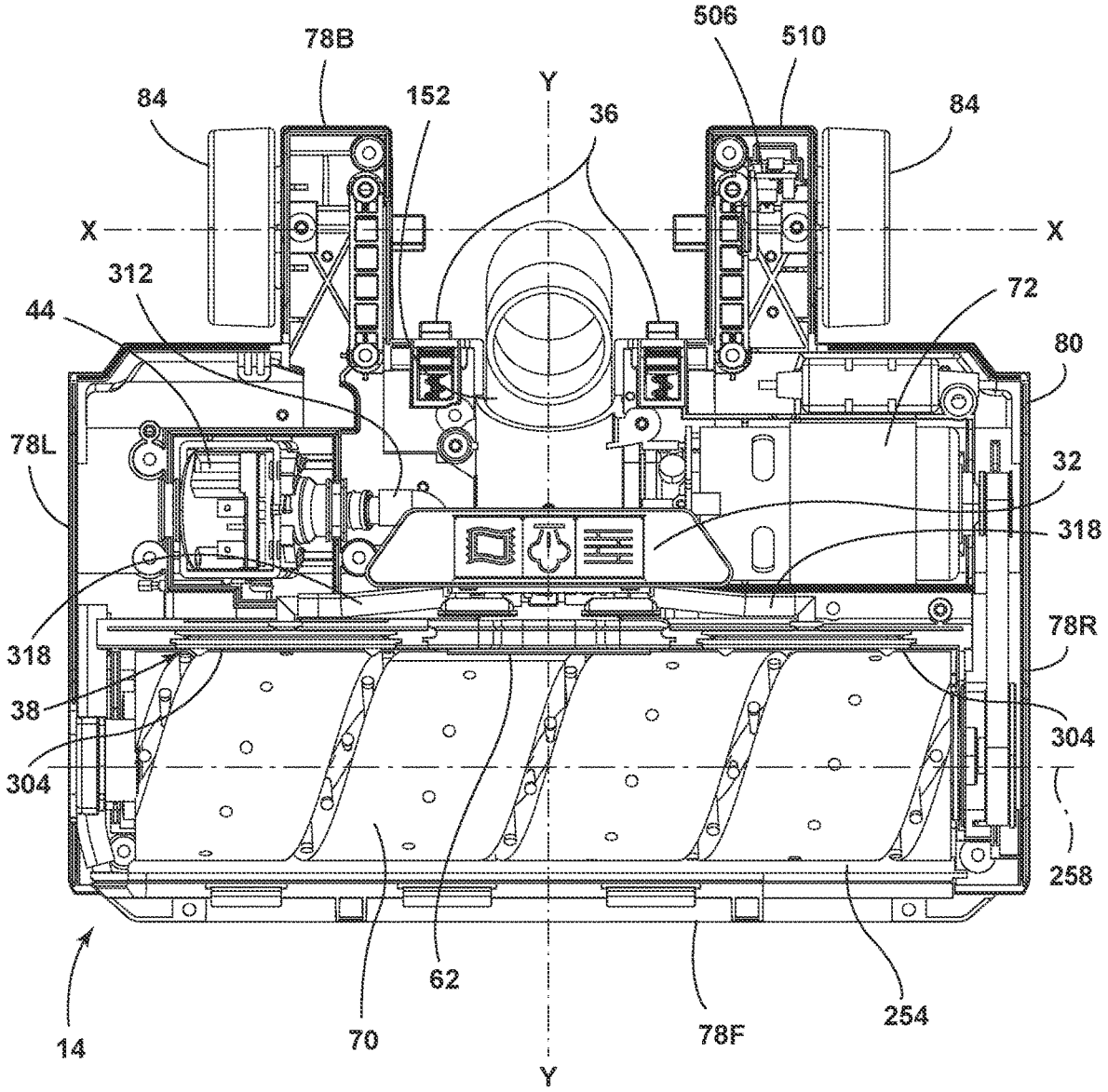
FIG. 5 is a top view of a base of the floor cleaner, with one or more housing pieces and component covers not shown for clarity.

FIG. 5 show an architectural layout for the base 14 according to one aspect of the disclosure, including locations and relative positions for components of the liquid, steam, and recovery systems. Components including the liquid pump 44, brushroll 70, and brushroll motor 72 are included on the base 14. For clarity of the architectural layout, one or more housing pieces and component covers of the base 14 are not shown in FIG. 5.

In one embodiment, the base 14 includes a plurality of sides, including, for example, a front side 78F, a first lateral or right side 78R, a second lateral or left side 78L, and a rear side 78B. The base 14 can include a base housing 80 supporting the components of the base 14, the base housing 80 including one or more housing pieces and/or covers assembled together, and, in some embodiments, defining one or more of the sides of the base 14. Wheels 84 can at least partially support the base housing 80 for movement over the surface to be cleaned.

The components of the base 14 are arranged with relative positioning that provides an architecture that is low-profile and easily maneuvered along a surface to be cleaned. For example, the liquid pump 44 and brushroll motor 72 are disposed rearwardly of the brushroll 70. As another example, the liquid pump 44 and brushroll motor 72 are located on opposing sides of the swivel axis Y, and forwardly of the pivot axis X. A conduit 152 can pass between the pump 44 and the brush motor 72, and can generally bisect a rear portion of the base 14 into a pump cavity in which the pump 44 is located and a brush motor cavity in which the brush motor 72 is located.

Other architectural layouts for the components of the base 14 are possible while providing an easily maneuverable floor cleaner 10.

Figure 6:
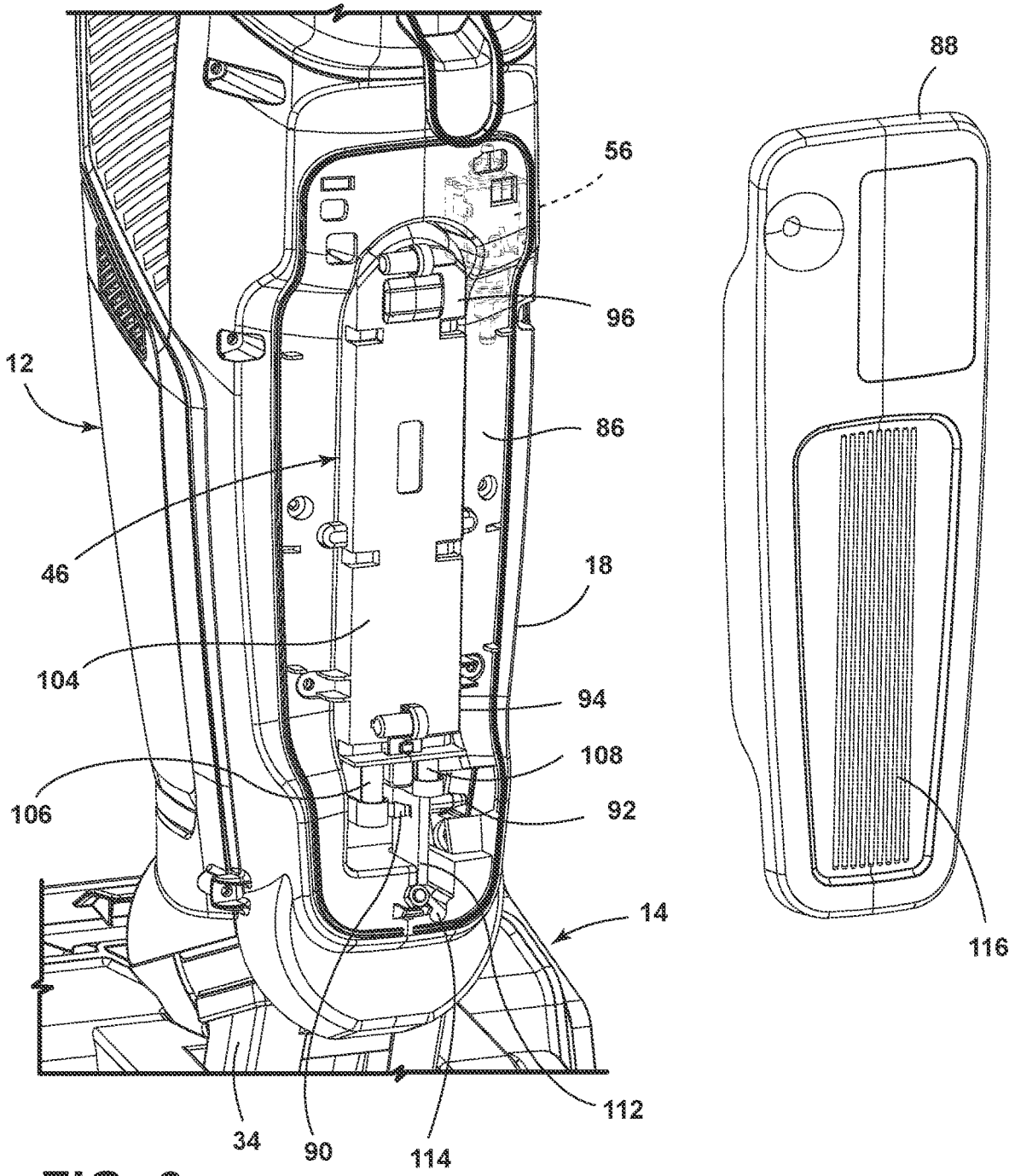
FIG. 6 is a rear perspective view of the floor cleaner, with a heater cover exploded to show a heater and a pressure relief device.
Figure 7:
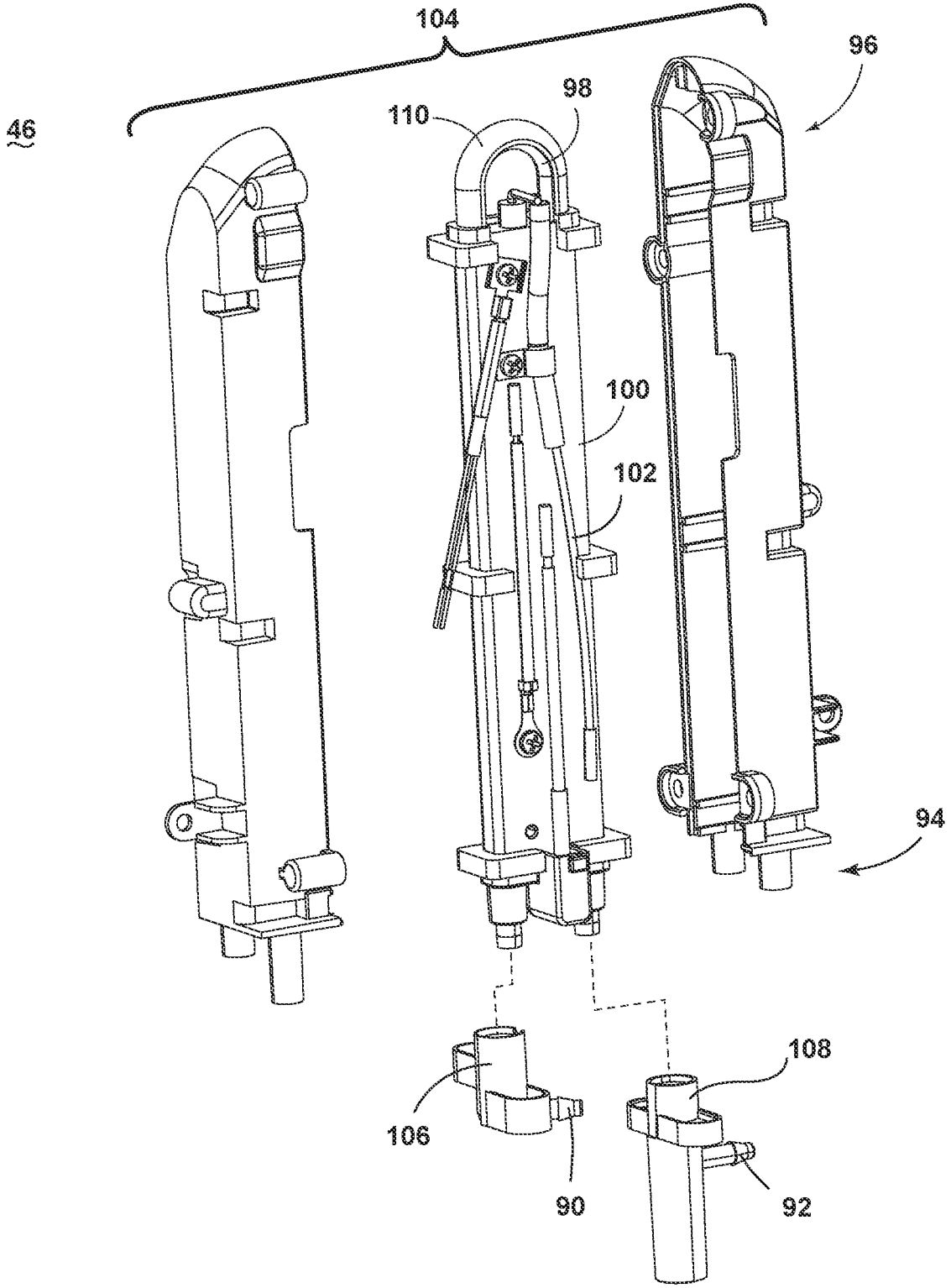
FIG. 7 is an exploded view of the heater and pressure relief device.

FIGS. 6-7 show details related to the heater 46, according to one aspect of the disclosure. The heater 46 can be disposed in a heater cavity 86 on a lower end of the frame 18, the heater cavity 86 closeable by a heater cover 88. The heater cover 88 can define a rear side of the upright body 12. The heater 46 includes a heater inlet 90 fluidly connected to the supply tank 20 (FIG. 3A), for example via the steam pump 56 (shown in phantom line), and a heater outlet 92 fluidly connected to the steam dispenser 48 (FIG. 3A).

The heater 46 can be oriented with the inlet 90 and outlet 92 at a lower end 94 of the heater 46, which can maximize liquid dwell time within the heater 46. For example, by pumping liquid through the heater 46 initially in an upward direction, e.g., against gravity, dwell time increases. The heater inlet and outlet 90, 92 can accordingly be disposed at a lower end of the heater cavity 86. The steam pump 56 can be disposed at an upper end 96 of or above the heater 46, and may accordingly be disposed at an upper end of or above the heater cavity 86.

Referring to FIG. 7, the heater 46 includes a fluid-conducting tube 98 encased in a body 100 with an electric heating element 102. The tube 98 can be constructed of stainless steel or other suitable corrosion-resistant and/or oxidation-resistant material and the body 100 can be constructed of aluminum or other suitable thermally conductive material. The tube 98, body 100, and heating element 102 can be enclosed within a heater box 104. The heater box 104 is shown herein as including two halves; other configurations for the heater box 104 are possible.

The heating element 102 uniformly heats the cleaning fluid as it passes through the tube 98. The heating element 102 may, for example, be selected to effectively deliver approximately 800 watts of power to heat the cleaning fluid in the tube 98 to a temperature of around 100±10° C., alternately about 90 to 100° C., alternatively about 95 to 98° C.

The tube 98 can have a single 180 degree bend 110 between the inlet 90 and the outlet 92. In other embodiments, the tube 98 has more than one bend, and may comprise a serpentine channel with multiple bends. With the heater inlet and outlet 90, 92 at the lower end 94 of the heater 46, the bend 110 in the tube 98 can accordingly be disposed at the upper end 96 of the heater 46.

In one embodiment, the heater inlet 90 can comprise an inlet fitting 106 fluidly connected to an inlet end of the tube 98 and the heater outlet 92 can comprise an outlet fitting 108 fluidly connected to an outlet end of the tube 98. The inlet fitting 106 can be fluidly connected to an inlet conduit (not shown) to conduct pressurized cleaning fluid from the steam pump 56 to the tube 98. The outlet fitting 108 can be fluidly connected to a steam conduit 344 (FIG. 21) to conduct cleaning fluid from the tube 98 to the steam dispenser 48 (FIG. 3A). The steam conduit 344 may pass from the upright body 12 to the base 14, for example by passing through or around the joint assembly 34.

A pressure relief device 112 controls or limits the pressure in the steam delivery system. The pressure relief device 112 opens at a predetermined set pressure to protect the system from being subjected to high pressures that exceed their design criteria. When the set pressure is met or exceeded, the pressure relief device 112 opens and vents steam outside the floor cleaner 10. Aside from this function, the pressure relief device 112 is not particularly limited, and may comprise any components and/or configurations suitable for use in/as a pressure relief. In one embodiment, the pressure relief device 112 is a spring valve that opens at a predetermined set pressure.

In one embodiment, the pressure relief device 112 can be incorporated into the heater outlet 92, including, but limited to, being incorporated into the outlet fitting 108. In other embodiments, the pressure relief device 112 can be disposed elsewhere in the steam supply path 50, e.g. separate from the heater 46. In one non-limiting example, the pressure relief device 112 can vent steam to outside the floor cleaner 10 via a vent port 114 in the upright body 12. The vent port 114 can be oriented to direct vented steam generally rearwardly and downwardly, relative to the upright body 12. Optionally, the vent port 114 can be hidden by the heater cover 88, with the heater cover 88 including a vent 116 for venting excess heat from the heater cavity 86 and steam from the vent port 114

During steam generation, pressure will build in the steam system unless the pressure is released. Pressure is released, for example, when steam is dispensed from the steam dispenser 48. When the steam path 50 is blocked or steam is otherwise held within the steam path 50 for a period of time, pressure will build in the system as liquid is heated and steam is generated. When the pressure in the path 50 reaches the set pressure, the pressure relief device 112 opens. Once pressure in the path 50 drops below the set pressure, such as may occur if steam is released or if the floor cleaner 10 is powered off, the pressure relief device 112 closes. The set pressure may be, for example, about 6 PSI, alternately about 7 PSI, although it is understood that the set pressure may vary depending on the design limits of the floor cleaner 10.

Figure 8:
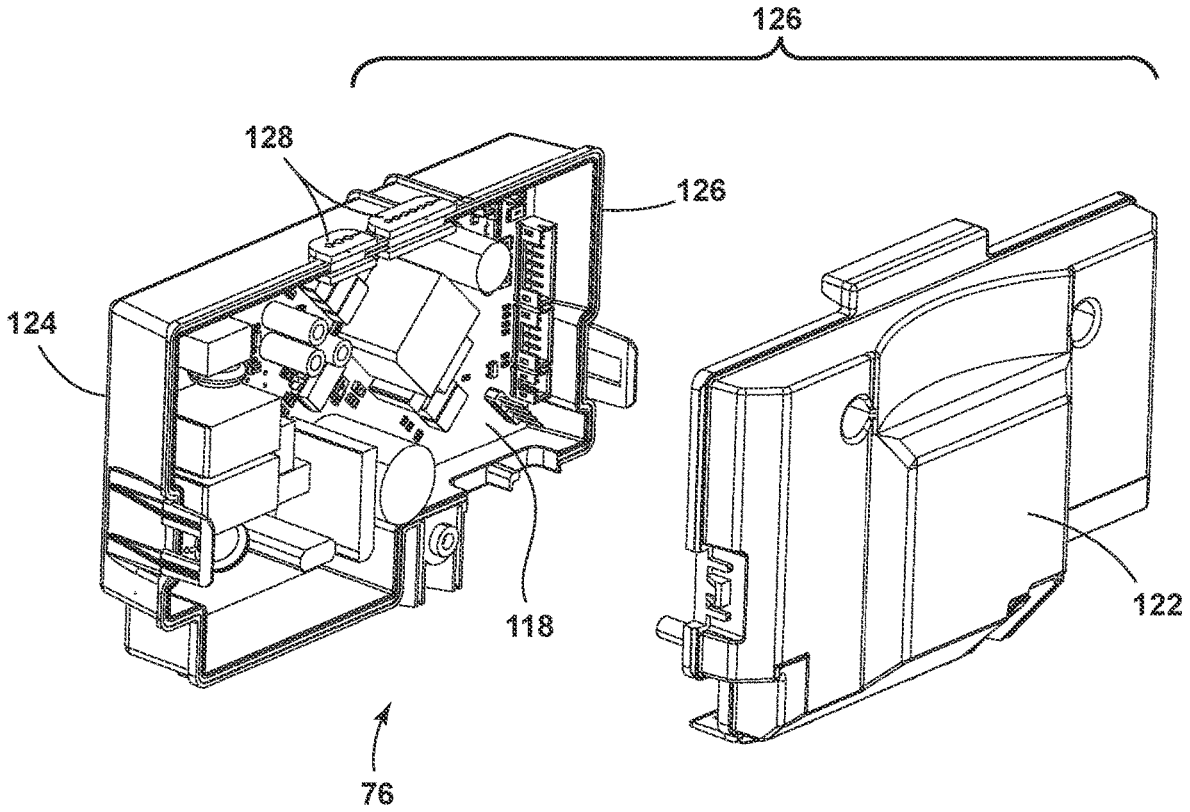
FIG. 8 is an exploded view of a main controller assembly for the floor cleaner.

FIGS. 4 and 8 show details related to the main controller 76, according to one aspect of the disclosure. Various locations for the main controller 76 are possible. In one embodiment, the controller 76 is located in the frame 18 of the upright body 12, below the supply tank 20. The main controller 76 can comprise a PCB 118 and can be enclosed within a controller housing 120. The controller housing 120 can be sealed to shield the controller 76 from moisture exposure. In particular, sealing the controller 76 within the controller housing 120 can prevent cleaning fluid, which may leak from the supply tank 20, from intrusion into the PCB 118. The controller 76 can further be below the vacuum motor 64 in order to reduce electromagnetic interference. Additional electromagnetic interference shielding can be provided by the controller housing 120.

Referring to FIG. 8, in one embodiment, the controller housing 120 can include two housing halves 122, 124 that are assembled around the PCB 118 and sealed with an overmolded seal 126. Wires (not shown) that connect to the PCB 118 can exit the controller housing 120 through grommets 128 to prevent liquid intrusion at the wire exit points.

Referring to FIG. 4, the supply and recovery tanks 20, 22 can be provided on the upright body 12, and can be mounted to the frame 18 in any configuration. In the present embodiment, the upright body 12 comprises tank sockets or receivers 130, 132 for respectively receiving the supply and recovery tanks 20, 22. As shown herein, in one embodiment the tank receivers 130, 132 can be defined by portions of the frame 18, and can be provided on opposing sides of the frame 18, and more particularly on rear and front sides of the frame 18, respectively. The frame 18 can include an upper rear receiver 130 for receiving the supply tank 20 therein and a lower front receiver 132 for receiving the recovery tank 22 therein. The recovery tank receiver 132 can be disposed generally below the supply tank receiver 130.

The supply tank 20 includes a tank body 134 having a plurality of walls and defining a supply chamber for storing a cleaning liquid. In one embodiment, the tank body 134 is blow-molded. The supply tank 20 includes an outlet valve 136 controlling fluid flow through an outlet of the tank body 134. The outlet valve 136 mates with a valve receiver 138 in the tank receiver 130 and can be configured to automatically open when seated and release cleaning fluid to the supply paths 40, 50. A check valve 140 can be mounted to the tank body 134 and is adapted to selectively vent excess gas within the supply tank 20. The supply tank 20 can also include a pressure relief valve (not shown) that is adapted to vent ambient atmospheric air into the chamber 126 as cleaning fluid therein is released through the outlet valve 136.

The recovery tank 22 can include a recovery tank body 142, which forms a collection chamber 144 for the recovery system, with a hollow standpipe 146 therein. The standpipe 146 forms a flow path between a tank inlet 148 formed at a lower end of the tank body 142 and a tank outlet 150 at the upper end of the standpipe 146 within the interior of the tank body 142. When the recovery tank 22 is mounted to the frame 18, the inlet 148 is aligned with the conduit 152, which forms a portion of the recovery path 66 (FIG. 3A), to establish fluid communication between the base 14 and the recovery tank 22. The standpipe 146 can be integrally formed with the tank body 142, or may be removeably connected thereto.

Figure 9:
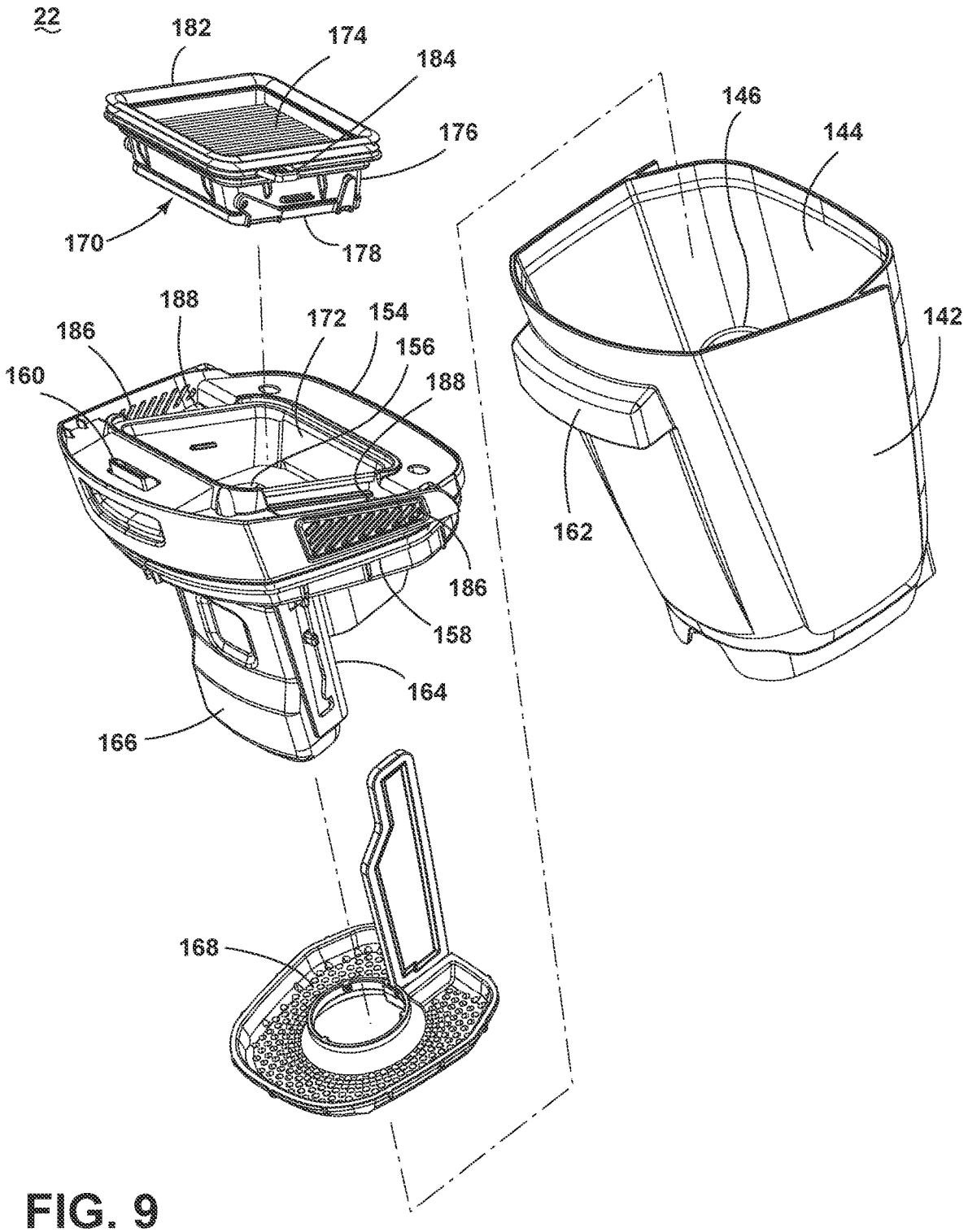
FIG. 9 is an exploded view of a recovery tank for the floor cleaner.
Figure 10:
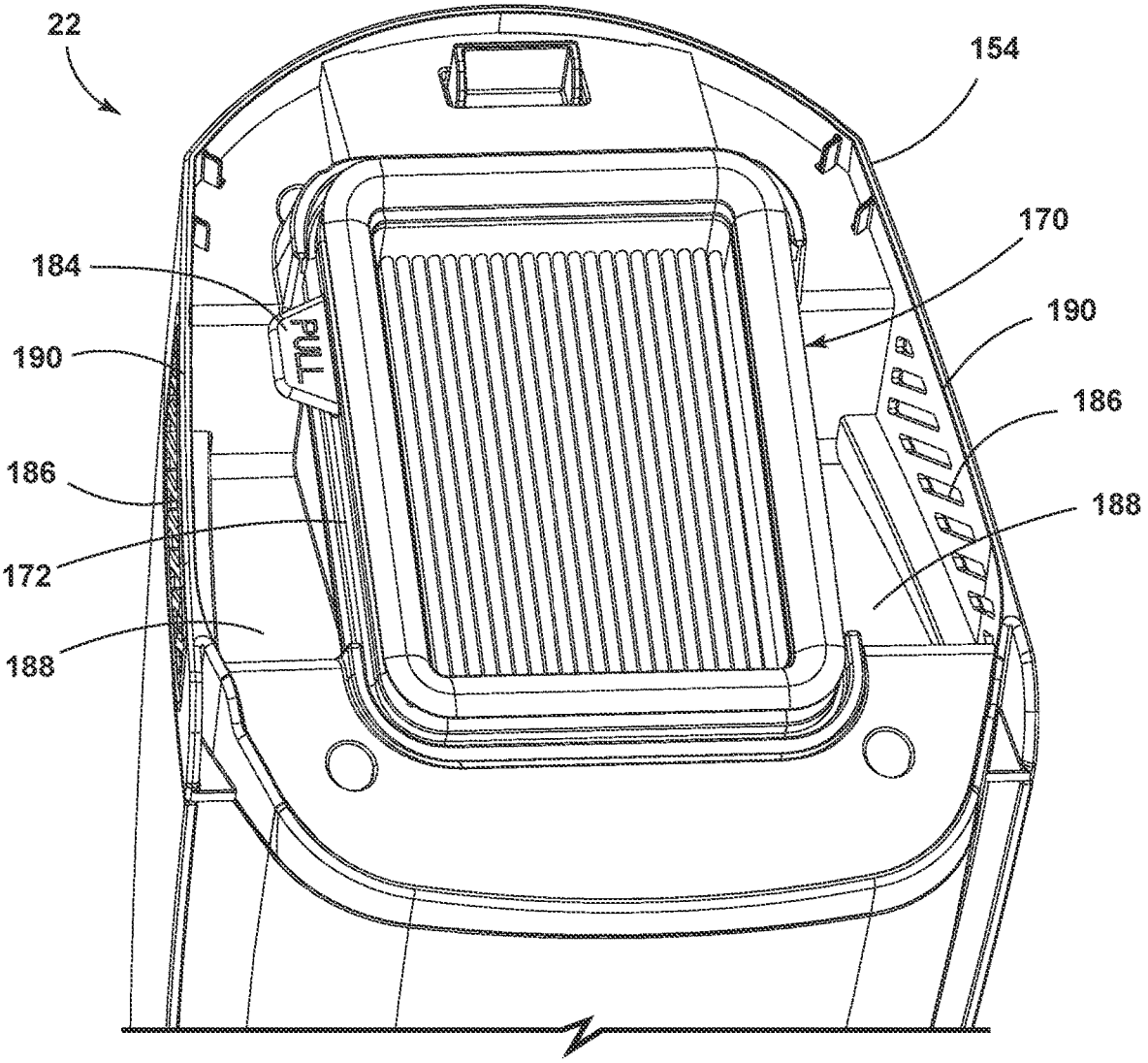
FIG. 10 is a top perspective view of the recovery tank.

FIG. 9 is an exploded view of the recovery tank 22. The recovery tank 22 includes a lid 154 configured to be seated on the top of the tank body 142. The lid 154 at least partially encloses an open top of the tank body 142, and can further define an air outlet 156 of the recovery tank 22. A gasket 158 is positioned between mating surfaces of the lid 154 and the tank body 142 and creates a seal therebetween for prevention of leaks.

A recovery tank latch 160 can optionally be supported by the lid 154 for securing the recovery tank 22 to the upright body 12 within the recovery tank receiver 132. The latch 160 is configured to releasably lock the recovery tank 22 to the upright body 12, such that a user must actuate the latch 160 before pulling the tank 22 off the frame 18. A hand grip 162 on the recovery tank 22 can be located below the latch 160 and can facilitate removal of the recovery tank 22 from the frame 18. In another embodiment, the latch 160 can releasably latch or retain, but not lock, the tank 22 on the frame 18, such that a user can conveniently apply sufficient force to the tank 22 itself to pull the tank 22 off the frame 18.

A float-style shut-off can be provided for interrupting suction when liquid in the recovery tank 22 reaches a predetermined level. The shut-off includes a float bracket 164 fixedly attached to an inner side of the lid 154 in a position offset from the standpipe 146 and a moveable float 166 carried by the float bracket 164. The float 166 is buoyant and oriented so that the top of the float 166 can selectively seal the air outlet 156 when the liquid in the recovery tank 22 reaches a predetermined level. In another embodiment, the recovery tank 22 can include an electronic sensing system configured to detect liquid at one or more levels within the recovery tank 22 and determine when to shut-off or otherwise interrupt the recovery system.

The recovery tank 22 can include a removable strainer 168 configured to strain large debris and hair out of the tank body 142 prior to emptying. The strainer 168 is configured to be manually lifted out of the tank body 142 and to collect the large debris and hair while draining liquid and smaller debris back into the tank body 142.

The recovery tank 22 can further include a filter assembly 170 provided at the air outlet 156. The filter assembly 170 can be supported by the lid 154 and the lid 154 can include a filter receiver 172 on an upwardly-facing side thereof that is sized to receive the filter assembly 170. The filter assembly 170 is removably mounted in the filter receiver 172.

In one embodiment, the filter assembly 170 can include a filter 174 and a filter frame 176 having an open area through which air may pass, with the filter 174 supported within the frame 176. The filter 174 can comprise any suitable type or combination of types of filter media suitable for filtering particles entrained within an airstream. Non-limiting examples of filter media include paper, cellulosic material, non-woven material, spunbond material, pleated filter media, open cell foam, polyester type matrix (e.g., polyethylene terephthalate), and combinations thereof. The filter media can also be a reusable or washable type of media such as a non-woven or foam type filter media, for example. It will be understood that the particle filtration size of the filter will vary depending on the floor cleaner 10 in which the filter assembly 170 is intended for use. For the embodiment of the multi-surface wet/dry floor cleaner 10 shown, the filter 174 is a pleated filter, and can be made of a material that remains porous when wet, e.g., air can still flow through the filter 174 when wet (unlike conventional paper filters).

In certain embodiments, the filter assembly 170 may comprise at least one additional filter media upstream of the filter 174. In the depicted embodiment, a mesh screen 178 is disposed on an upstream inlet side of the filter 174, and has a larger pore size than the filter 174. When referring to the filter 174 or mesh screen 178, the pore size is the size of the largest particles that can successfully pass through that element. The pore size may be an effective pore size or an average of pore sizes across the media. The mesh screen 178 can be pivotally coupled with the filter frame 176, and can swing open, e.g. away from the filter 174.

A seal 182 on the frame 176 blocks the escape of air from the recovery pathway 66. A ceiling of the tank receiver 132 (FIG. 4) can be configured to fit tightly against the seal 182, and optionally also with the lid 154, to provide a sealed pathway from the filter assembly 170 to the vacuum motor 64.

The filter assembly 170 can have a poka-yoke installation to prevent a user from inadvertent error in installing the filter assembly 170 in the filter receiver 172, such as a projecting feature on the filter assembly 170 and/or on the filter receiver 172 that prevents a user from installing the filter assembly 170 incorrectly by interfering with the insertion of the filter assembly 170 into the filter receiver 172.

The filter assembly 170 can have a gripping feature that is made to be grasped or held by the hand for easy removal of the filter assembly 170. The gripping feature can comprise a pull tab 184 that projects from one side of the filter assembly to assist the user in lifting the filter assembly 170 out of the filter receiver 172. The pull tab 184 can have a flat, low profile so that it is flush with or below an uppermost portion of the recovery tank 22 so that the pull tab 184 does not interfere with installation of recovery tank 22. In one embodiment, the pull tab 184 is integrally formed with the seal 182, for example by injection molding or other suitable forming method. In another embodiment, the pull tab 184 is formed on the frame 176. In yet other embodiments, the pull tab 184 may be eliminated, and the filter assembly 170 may be liftable out of the filter receiver 172 by gripping the frame 176 alone.

In one aspect of the disclosure, the recovery tank 22 defines a first upstream portion of the recovery path 66 (FIG. 3A) upstream of the vacuum motor 64 and defines a second portion of the recovery tank 20 downstream of the vacuum motor 64. For example a portion of the working air exhaust path downstream of the vacuum motor 64 extends through a portion of the recovery tank 20. In one embodiment, the recovery tank 22 can have at least one exhaust vent 186 defining the path outlet of the recovery path 66 e.g. a clean air outlet for the floor cleaner. In the illustrated embodiment, two exhaust vents 186 are provided on the opposing sides of the recovery tank 22, although other numbers and locations for the exhaust vents 186 are possible.

In one embodiment, the exhaust vents 186 are incorporated into the lid 154 of the recovery tank 22. The lid 154 can have an exhaust chamber 188 in fluid communication with each vent 186. The chambers 188 can be disposed on opposing sides of the filter receiver 172. The chambers 188 can extend between an outer side wall 190 of the lid 154 and the filter receiver 172, with exhaust vents 186 disposed in the outer side wall 190.

The exhaust chamber 188 on at least one side of the filter receiver 172 can be enlarged for easier grasping and removal of the filter assembly 170 from the filter receiver 172. For example, the chamber 188 provided on a side of the filter receiver 172 corresponding to the pull tab 184 can be sized for insertion of a user's finger for easy filter removal. In the embodiment shown, the pull tab 184 projects at least partially over the top of the chamber 188, and the chamber 188 is sufficiently large for a user to insert a finger into the chamber 188 and under the tab 184 to lift the filter assembly.

Figure 11:
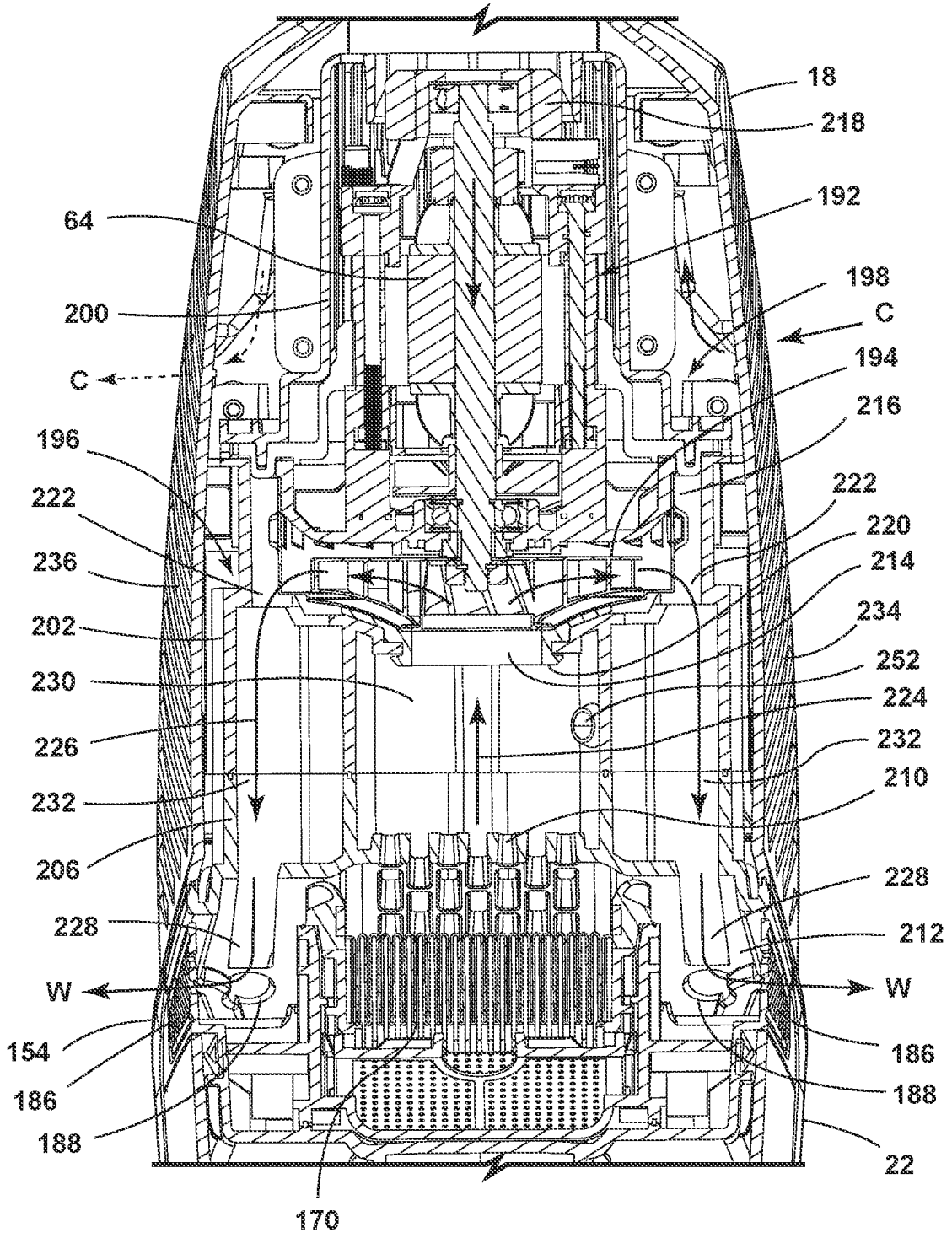
FIG. 11 is a cross-sectional view of the floor cleaner, taken through line XI-XI of FIG. 1 and showing a portion of a recovery path including a suction source.

FIG. 11 shows a portion of the recovery path downstream of the recovery tank 22 and the filter assembly 170, according to one aspect of the disclosure, where a working air flow path is generally indicated by arrows W. The recovery path can include a suction source 192, which can be a motor/fan assembly including the vacuum motor 64 and a fan 194. The suction source 192 can be positioned within a housing of the frame 18, such as above the recovery tank 22. In one embodiment, the suction source 192 is arranged within an enclosure 196, and the vacuum motor 64, fan 194, and enclosure 196, forms a self-contained module 198. The working air path W routes through and is enclosed by the module 198.

The enclosure 196 includes an upper motor housing 200 and a lower motor housing 202. A gasket 204 seals the interface between the housings 200, 202 to provide a fluid-tight joint therebetween. The vacuum motor 64 is enclosed within the housings 200, 202, with a substantial portion (e.g., over half) of the motor 64 disposed in the upper motor housing 200. The fan 194 is enclosed within the lower motor housing 202. The enclosure 196 further includes a grille housing 206 that routes working air into and out of the lower motor housing 202.

The enclosure 196 can include an air inlet through which working air can enter the enclosure 196. In one embodiment, the enclosure air inlet is formed by a grille 210 in the grille housing 206. The grille 210 is configured for fluid communication with the air outlet 156 of the recovery tank 22. In one embodiment, the grille housing 206 forms a ceiling 212 of the tank receiver 180 (FIG. 4), and the outlet side of the filter assembly 170 can be generally aligned with the grille 210 when the tank 22 is mounted in the receiver 180, such that air passes from the filter assembly 170 directly into the enclosure 196 through the grille 210. Other configurations for the enclosure air inlet are possible.

The lower motor housing 202 includes at least one fan inlet 214 for drawing working air into a fan chamber 216 in which the fan 194 is disposed. The fan inlet 214 can be generally aligned with the grille 210.

A first cushioning member, such as a first gasket 218, can be provided at the interface between the upper motor housing 200 and the suction source 192, near the top of the motor 64. A second cushioning member, such as a second gasket 220, can be provided at the interface between the lower motor housing 202 and the suction source 192, near the bottom of the fan 194. The gaskets 218, 220 dampen vibration to reduce noise due to mechanical vibrations of the motor 64.

The lower motor housing 202 includes at least one fan outlet 222 through which air is driven from the chamber 216 by the fan 194. The fan chamber 216 can be generally circular as shown, and a plurality of fan outlets 222 can be disposed at a periphery of the chamber 216. In the illustrated embodiment, the lower motor housing 202 includes two diametrically-opposed fan outlets 222. Other arrangement for fan outlets in the lower motor housing 202 are possible.

The structure of the lower motor housing 202 and grille housing 210 can vary, but preferably, the housings 202, 210 cooperatively form a first closed path 224 to guide working air W from the grille 210 to the fan inlet 214 and a second closed path 226 to guide exhaust air from the fan outlet 222 to an enclosure air outlet 228. Various walls, baffles, or channel structures can define the closed paths 224, 226 and fluidly isolate the portions of the paths 224, 226 within the housings 202, 210. In one embodiment, the lower motor housing 202 and grille housing 210 cooperatively form a center inlet duct 230 that extends from the grill 210 to the fan inlet 214 to form the first closed path 224. The lower motor housing 202 and grille housing 210 cooperatively form lateral outlet duct 232 that extend from the fan outlets 222 to the enclosure air outlets 228 to form the second closed path 226. The enclosure air outlets 228 are open to the exhaust chambers 188 in the recovery tank lid 154, such that the working air W exiting the enclosure 196 enters the recovery tank lid 154 before exiting through the exhaust vents 186.

Figure 13:
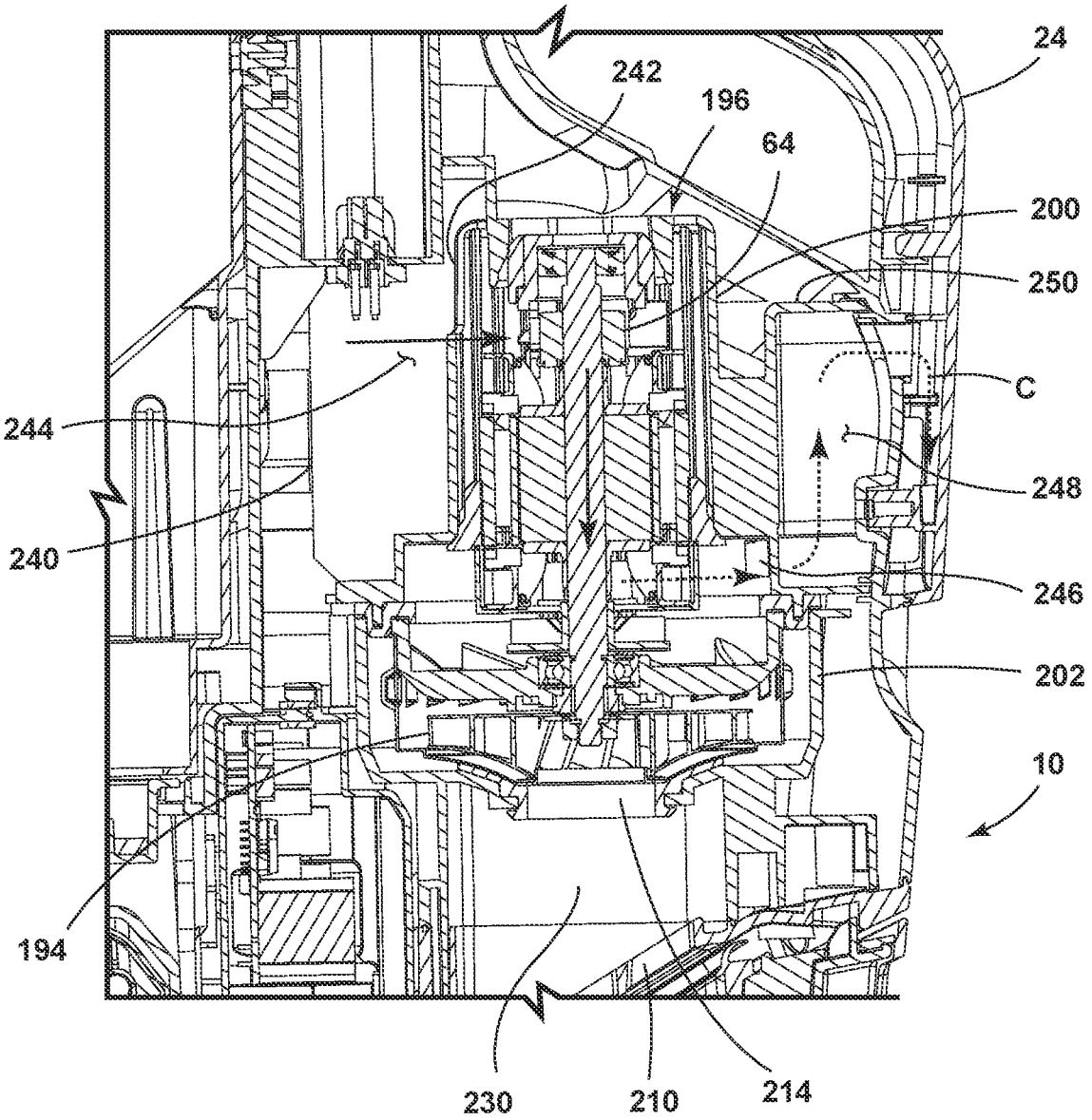
FIG. 13 is a cross-sectional view of the floor cleaner, taken through line XIII-XIII of FIG. 1 and showing a portion of a motor cooling path for the suction source and a brush motor.

FIGS. 11 and 13 show a motor cooling air path according to one aspect of the disclosure. The motor cooling air path is provided for supplying cooling air to the vacuum motor 64 and for removing heated cooling air (also referred to herein as "heated air") from the vacuum motor 64. In FIGS. 11 and 13, the cooling air path is generally indicated by arrows C.

Referring to FIG. 11, the motor cooling air path includes a cooling air inlet 234 and a cooling air outlet 236, both of which are in fluid communication with the ambient air outside the floor cleaner 10. Ambient air is drawn into the floor cleaner 10 through the cooling air inlet 234, passes through the vacuum motor 64, and is subsequently exhausted through the cooling air outlet 236. In the embodiment illustrated, the cooling air inlet 234 is defined by an inlet vent on one side of the frame 18 and the cooling air outlet 236 is defined by an outlet vent on an opposing side of the frame 18.

Referring to FIG. 13, the enclosure 196 includes at least one inlet aperture 242 for cooling air and at least one outlet aperture 246 for heated cooling air. In one embodiment, the upper motor housing 200 includes the inlet aperture 242 to allow cooling air to enter the enclosure 196 and pass by the vacuum motor 64. The inlet aperture 242 is in fluid communication with the cooling air inlet 234 (FIG. 11), such as via an at least one cooling air inlet duct 244. The cooling air inlet duct 244 can be formed internally within the upright body 12, and more specifically can be formed by housings forming the frame 18.

In one embodiment, the inlet aperture 242 is disposed on a rear upper side of the motor housing 200, and at a least a portion of the inlet duct 244 can be formed by a rearward-extending portion 240 of the motor housing 200.

The upper motor housing 200 also includes at least one outlet aperture 246 through which heated cooling air is transported away from the vacuum motor 64 and exhausted from the enclosure 196. The outlet aperture 246 is in fluid communication with the cooling air outlet 236, such as via an at least one heated air exhaust duct 248. The heated air exhaust duct 248 can be formed internally within the upright body 12, and more specifically can be formed by housings forming the frame 18. Routing the heated air exhaust internally within the frame 18 reduces noise from the vacuum motor 64. Optionally, the exhaust duct 248 can define a tortuous exhaust path to damped motor and airflow noise generated by the floor cleaner 10 during operation. The tortuous exhaust path can comprise multiple turns of 90 degrees or more.

In one embodiment, the outlet aperture 246 is defined by multiple exhaust ports disposed on a front lower side of the motor housing 200, and at a least a portion of the cooling exhaust duct 248 can be formed by a forwardly-extending portion 250 of the motor housing 200.

Figure 12:
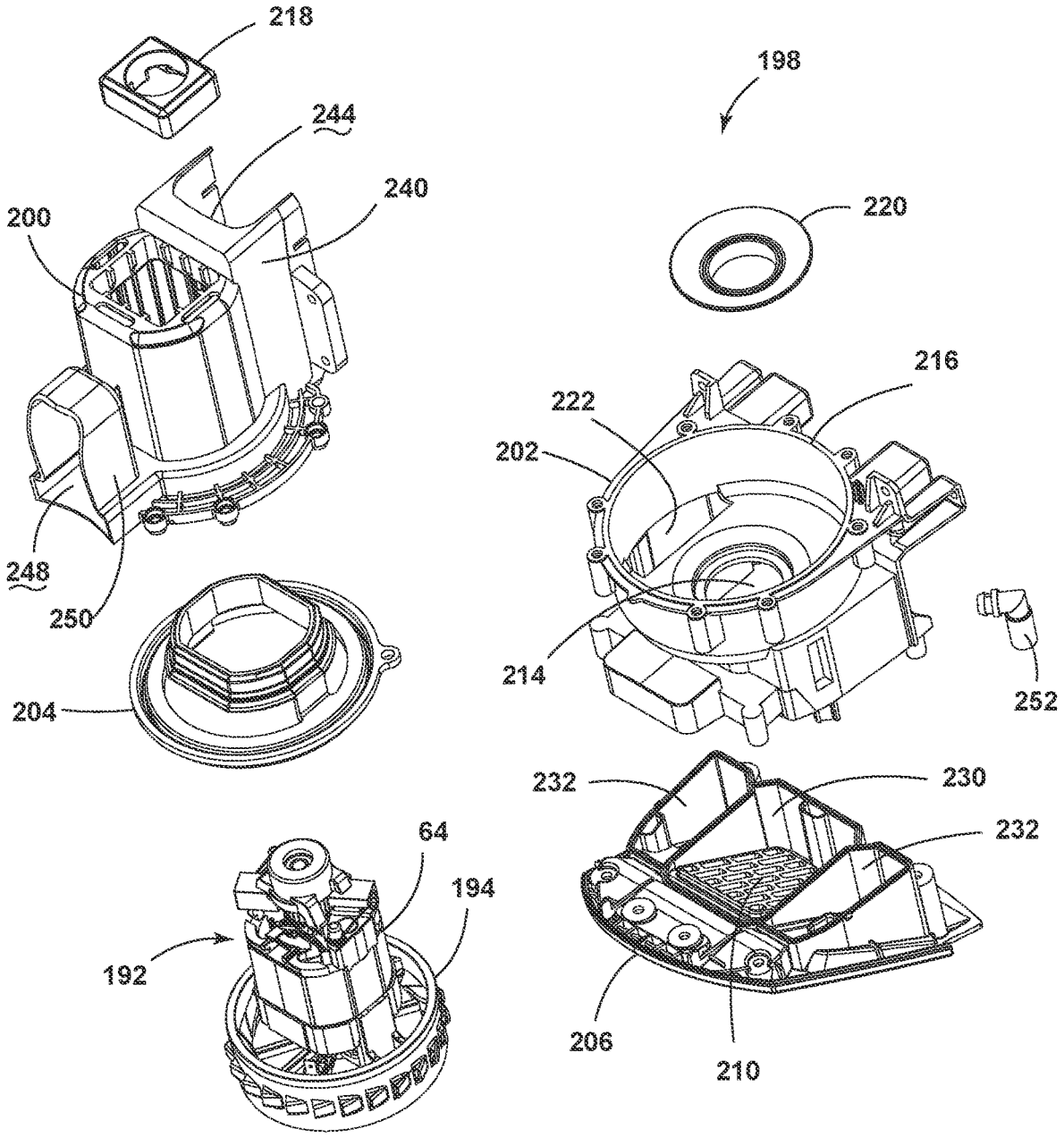
FIG. 12 is an exploded view of a self-contained module for the floor cleaner including the suction source and an enclosure for the suction source.

In one embodiment, a brush motor cooling air path is provided for supplying cooling air to the brush motor 72 (FIG. 5) and for removing heated cooling air (also referred to herein as "heated air") from the brush motor 72. The brush motor cooling air path can be defined by a conduit 252, a portion of which is shown in FIG. 12, for allowing heated air to be transported away from the brush motor 72, with the a first end of the conduit 252 in fluid communication with the brush motor 72 and a second end of the conduit 252 in fluid communication with the lower motor housing 202. From the lower motor housing 202, the heated air from the brush motor 72 can join the working air flow path through the enclosure 196. From the base 14, the conduit 252 can extend through the joint assembly 34, and through the frame 18 to connect with the enclosure 196.

Figure 14:
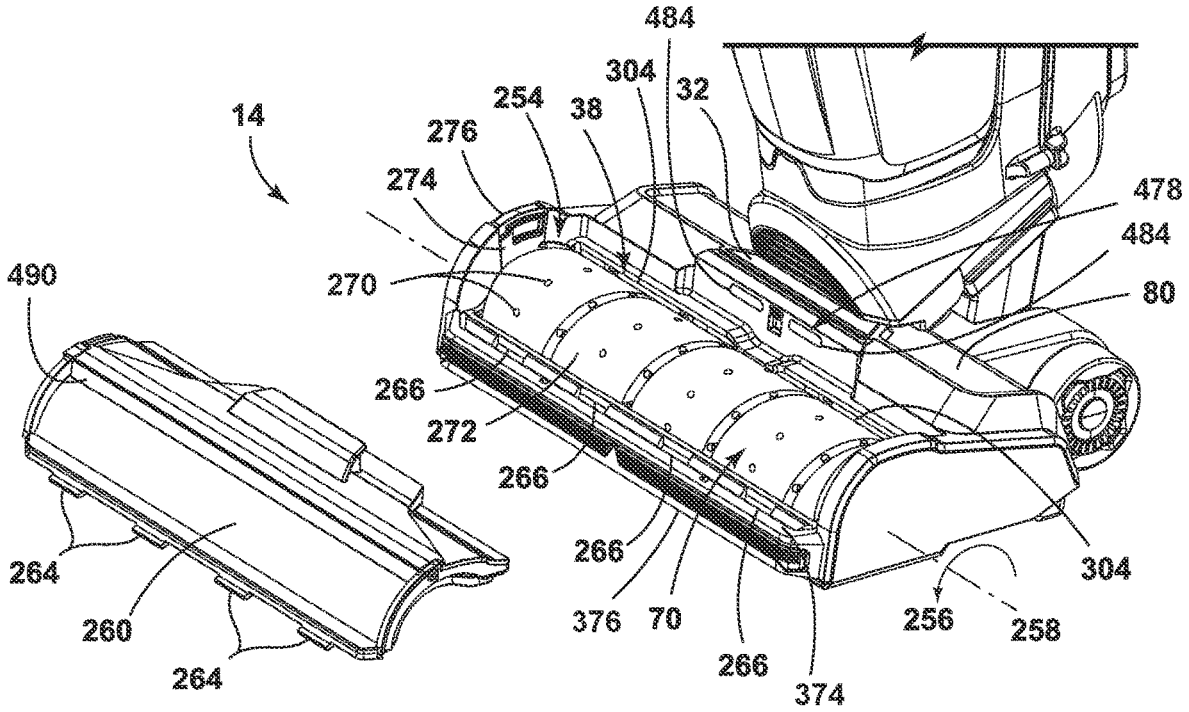
FIG. 14 is a perspective view of a base of the floor cleaner, with a cover exploded from the base to show a brushroll.
Figure 15:
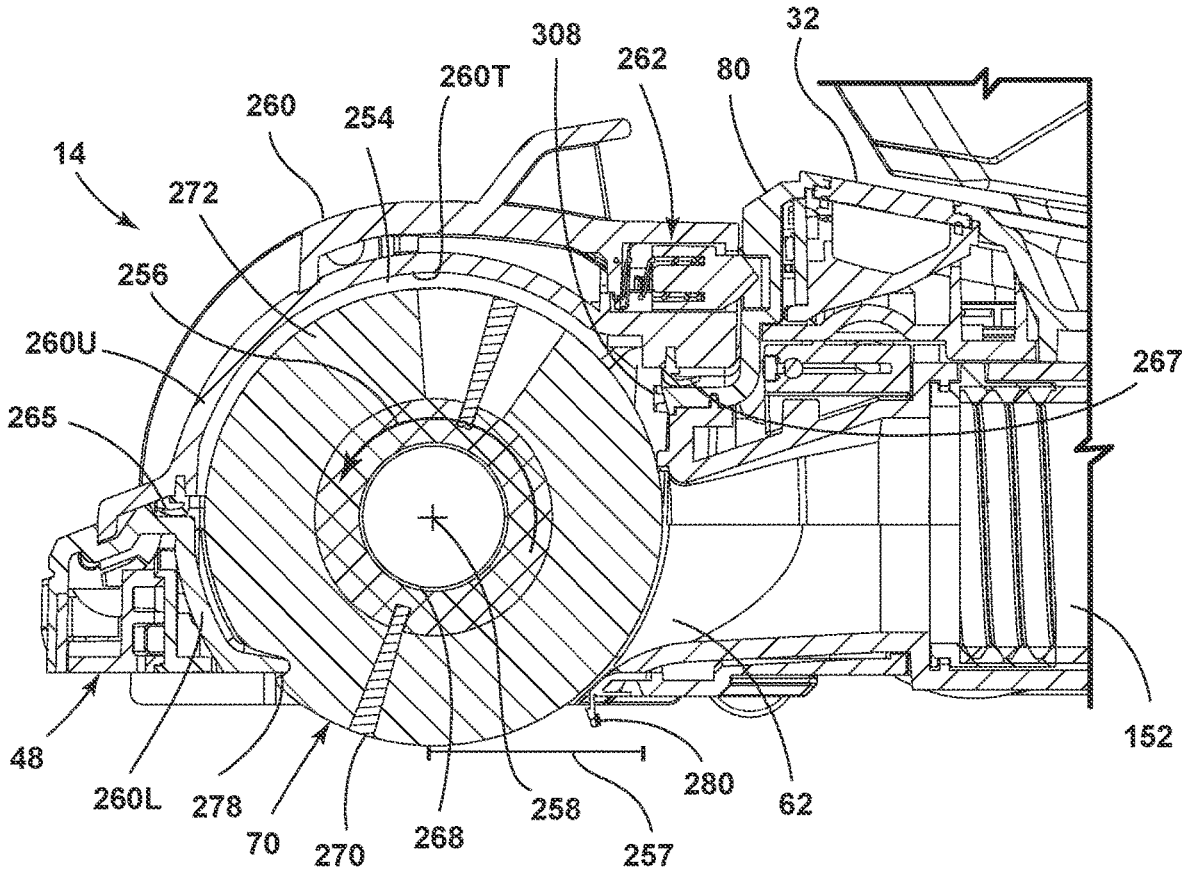
FIG. 15 is a cross-sectional view of the base, taken through line IV-VI of FIG. 1.

FIGS. 14-15 show the base 14, including the brushroll 70 and a brushroll cover according to one aspect of the disclosure. The brushroll 70 can be provided at a forward portion of the base 14 and received in a brush chamber 254 on the base 14. The brushroll 70 is positioned for rotational movement in a direction 256 about rotational axis 258. The brush chamber 254 can be disposed at a forward section of the base 14. At least an outlet of the liquid dispenser 38 can be disposed in the brush chamber 254 to dispense liquid onto the brushroll 70.

The base 14 can comprise a brush cover 260 on the base housing 80 that at least partially defines the brush chamber 254. For example, an interior surface of the cover 260 can define at least a top wall 260T and a portion 260U of a front wall of the brush chamber 254, with the interior surface of the cover 260 proximate to the brushroll 70.

The cover 260 can be removable from the base housing 80 without the use of tools. Optionally, a cover latch 262 releasably secures the cover 260 on the base housing 80, and can be configured to releasably lock the cover 260 to the base housing 80. The cover 260 can have hooks 264 that are insertable into slots 266 on the base housing 80. Insertion of the hooks 264 into the slots 266 forms a hinge about which the cover 260 pivots to engage the latch 262. Other configurations for attaching the cover 260 to the base housing 80 are possible, including, but not limited to, a hook on the cover 260 that snaps into engagement with a detent on the base housing 80, or vice versa, or other configurations where the cover 260 installed by a translating or sliding action rather than a rotational action.

With reference to FIG. 15, the portion 260U of a front wall of the brush chamber 254 formed by the cover 260 may be an upper portion of the front wall. A lower portion 260L of the front wall may be formed by a portion of the base housing 80 that is not removable, e.g. the lower portion 260L remains with the base 14 when the cover 260 is removed. A first seal 265 at the interface between the upper and lower portions 260U, 260L can prevent the escape of air or liquid from the brush chamber 254 at the front thereof. A second seal 267 at the interface between a rear portion of the cover 260 carrying the latch 262 and the base housing 80 can prevent the escape of air or liquid from the brush chamber 254 at the rear thereof. By way of non-limiting example, the seals 265, 267 can be mounted on and removable with the cover 260.

In the present embodiment, the suction inlet port 62 is configured to extract liquid and debris from the brushroll 70 and from the surface to be cleaned. The suction inlet port 62 can be in fluid communication with the brush chamber 254 and positioned in close proximity to the brushroll 70. By way of non-limiting example, the suction inlet port 62 can be disposed rearwardly of the brushroll 70, and can open to the conduit 152. The brush cover 260 can form at least in part, a suction nozzle surrounding the brushroll 70.

The brushroll 70 can be a hybrid brushroll suitable for use on both hard and soft surfaces, and for wet or dry vacuum cleaning. In one embodiment, the brushroll 70 comprises a dowel 268 supporting at least one agitation element. The agitation element can comprise a plurality of bristles 270 extending from the dowel 268 and microfiber material 272 provided on the dowel 268 and arranged between the bristles 270. Bristles 270 can be tufted or unitary bristle strips and constructed of nylon, or any other suitable synthetic or natural fiber. The microfiber material 272 can be constructed of polyester, polyamides, or a conjugation of materials including polypropylene or any other suitable material known in the art from which to construct microfiber. The dowel 268 can be constructed of a polymeric material such as acrylonitrile butadiene styrene (ABS), polypropylene or styrene, or any other suitable material such as plastic, wood, or metal.

Other embodiments of brushrolls for the floor cleaner 10 are possible including a bristle brushroll suitable for use on soft surfaces, and that comprises bristles and no microfiber material, and/or a microfiber brushroll suitable for use on hard surfaces and that comprises microfiber material and no bristles. In one embodiment, the floor cleaner 10 can be provided with multiple, interchangeable brushrolls, which allows for the selection of a brushroll depending on the cleaning task to be performed or depending on the floor type of be cleaned.

Optionally, the brushroll 70 can be configured to be removed by the user from the base 14, such as for cleaning and/or drying the brushroll 70. The brushroll 70 can be removably mounted in the brush chamber 254 by a brushroll latch 274, a portion of which can be provided on or attached to the dowel 268, with a mating portion provided in the brush chamber 254. A grip 276 can extend from the brushroll 70 to aid in removal of the brushroll 70 from the brush chamber 254.

An interference wiper 278 is mounted at a forward portion of the brush chamber 254 and is configured to interface with a leading portion of the brushroll 70, as defined by the direction of rotation 256 of the brushroll 70. The interference wiper 278 is generally below the liquid dispenser 38, such that the wetted portion brushroll 70 rotates past the interference wiper 278, which scrapes excess liquid off the brushroll 70, before reaching the surface to be cleaned. Optionally, the interference wiper 278 can be disposed generally parallel to the surface to be cleaned. Other locations for the wiper 278 in relation to the brushroll 70, where the wiper 278 is configured to interface with a portion of the brushroll 70, are possible. By way of non-limiting example, the wiper 278 can be integrally formed with the brush cover 260, such as with the lower portion 260L of the front wall.

The wiper 278 can be rigid, i.e. stiff, and non-flexible, so the wiper 278 does not yield or flex by engagement with the brushroll 70. Optionally, the wiper 278 can be formed of rigid thermoplastic material, such as poly(methyl methacrylate) (PMMA), polycarbonate, or acrylonitrile butadiene styrene (ABS). In other embodiments, the wiper 278 can be flexible.

A squeegee 280 is mounted to an underside of the base 14 and is configured to contact the surface to be cleaned as the base 14 moves across the surface. The squeegee 280 wipes residual liquid from the surface so that it can be drawn into the recovery pathway via the suction inlet port 62, thereby leaving a moisture and streak-free finish on the surface to be cleaned.

To reduce streaking, the squeegee 280 can be located close to the brush chamber 254 on a rear side of the brushroll 70. In one embodiment, the squeegee 280 is disposed partially below the brushroll 70 to position the squeegee 280 close to the brush chamber 254. For example, the brushroll 70 can define a rear radius 257 as the horizontal distance between the rotational axis 258 and a rearmost side of the brushroll 70, and the squeegee 280 is disposed within the rear radius 257 of the brushroll 70. Optionally, the squeegee 280 can be disposed generally orthogonal to the surface to be cleaned, or vertically. It is noted that FIG. 15 shows the squeegee 280 in an undeformed state, out of contact with a surface to be cleaned. In operation, the squeegee 280 is deformed by contact with the surface to be cleaned, and flexes back and forth depending on a direction of movement of the base 14.

The squeegee 280 has a geometry, hardness, flexibility, and resilience to bend readily to conform to the contour of the surface to be cleaned to suit its intended purpose of wiping up residual liquid, yet not leave debris behind on the floor surface, particularly on forward strokes of the base 14. The squeegee 280 is preferably formed from a resilient material, such as plastics, elastomers, rubber or rubber-like materials, having a hardness of about 70 Shore A or less, alternatively about 50 Shore A.

Figure 16:
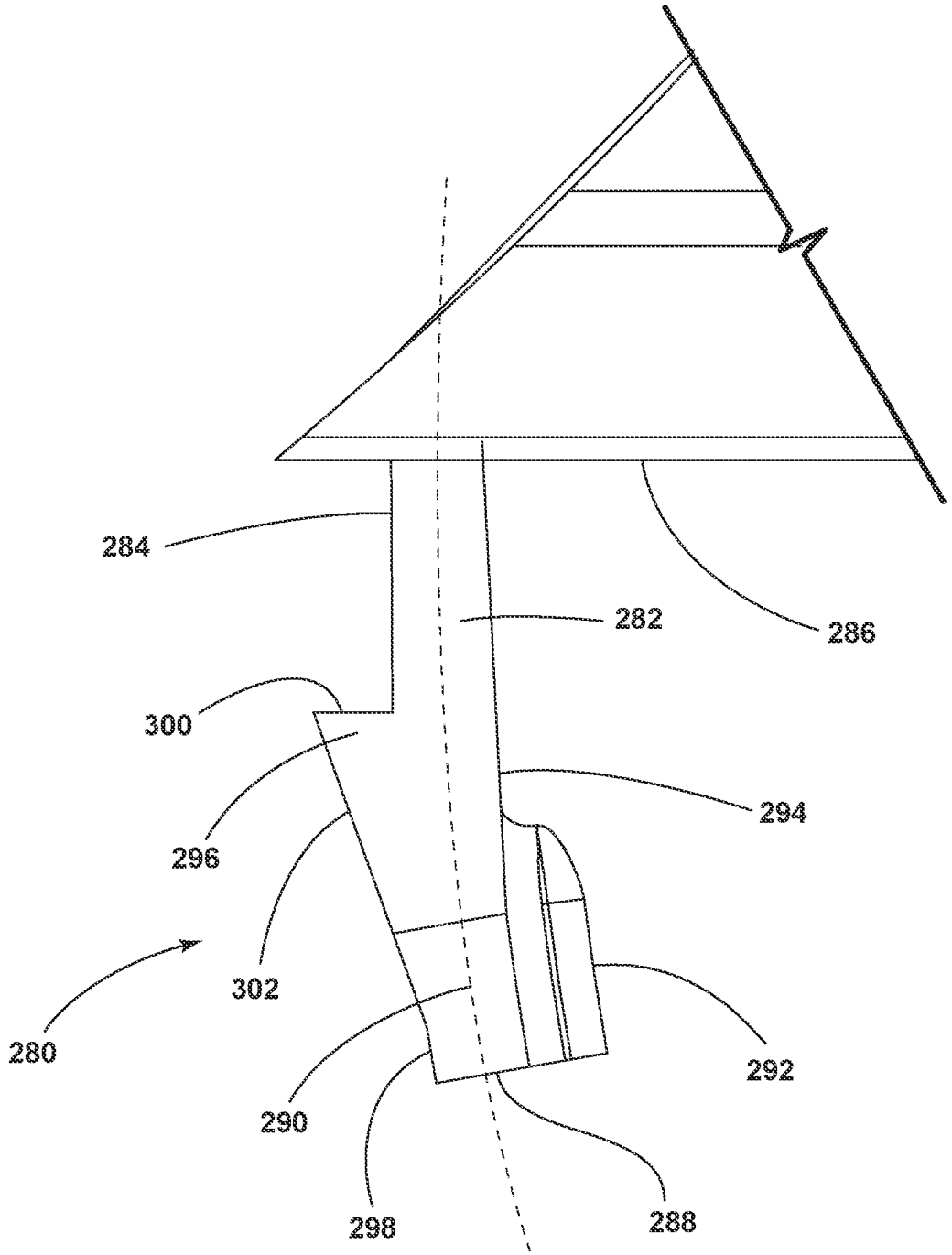
FIG. 16 is a side view of a squeegee for the floor cleaner.

Referring additionally to FIG. 16, the squeegee 280 can have a flexible lip 282 projecting from an underside of the base 14, the lip 282 configured to flex back and forth depending on the direction of movement of the base 14. For example, the lip 282 will flex backwardly on a forward stroke of the base 14 and flex forwardly on a rearward stroke of the base 14. The lip 282 is fixed at its upper end 284 to a support 286 or another portion of the base 14, and extends generally downwardly to a free lower end 288. The maximum thickness T of the lip 282 is preferably about 1.0 mm or less, alternatively about 0.6 mm.

The lip 282 defines a longitudinally squeegee axis 290 between the upper end 284 and the lower end 288. To help roll-over on forward cleaning strokes, in an undeformed state, an example of which is shown in FIG. 16, the lip 282 can curve backwardly, such that the squeegee axis 290 at the lower end 288 is rearwardly displaced from the squeegee axis 290 at the upper end 284. On a forward stroke of the base 14, the lip 282 flexes backwardly, increasing the rearward displacement of the lower end 288. On a rearward stroke of the base 14, the lip 282 flexes forwardly, against the direction of curvature, and the lower end 288 flips into being displaced forwardly relative to the upper end 284.

To aid the squeegee 280 in flexing back and forth, the squeegee 280 includes a plurality of protrusions 292. These protrusions 292 are arranged at or near the lower end 288 of the lip 282. More specifically, the protrusions 292 are arranged on a rear side 294 of the lip 282 that faces away from the brushroll 70. The protrusions 292 protrude from said rear side 294. The protrusions 292 are herein also referred to as nubs. On a rearward stroke of the base 14, where the lip 282 flexes forwardly, the protrusions 292 contact the surface to be cleaned, and space the lip 282 away from the surface to be cleaned.

To reduce flip-over, the squeegee 280 can include a triangular feature 296 arranged on a front side 298 of the lip 282 that faces toward the brushroll 70. The triangular feature 296 includes a top end face 300 of the feature 296 projecting generally orthogonally from the front side 298 of the lip 282, and an angled front face 302 of the feature angling downwardly from the top end face 300 to meet the front side 298 of the lip 282. On a forward stroke of the base 14, the lip 282 flexes backwardly, and the triangular feature 296 is positioned above and not in contact with the floor, and provides localized stiffness to the squeegee 280. On the backward stroke the triangular feature 296 is positioned near but not in contact with the brushroll 70, and provides localized stiffness in the squeegee 280 to prevent the squeegee 280 from contacting the brushroll 70.

Figure 17:
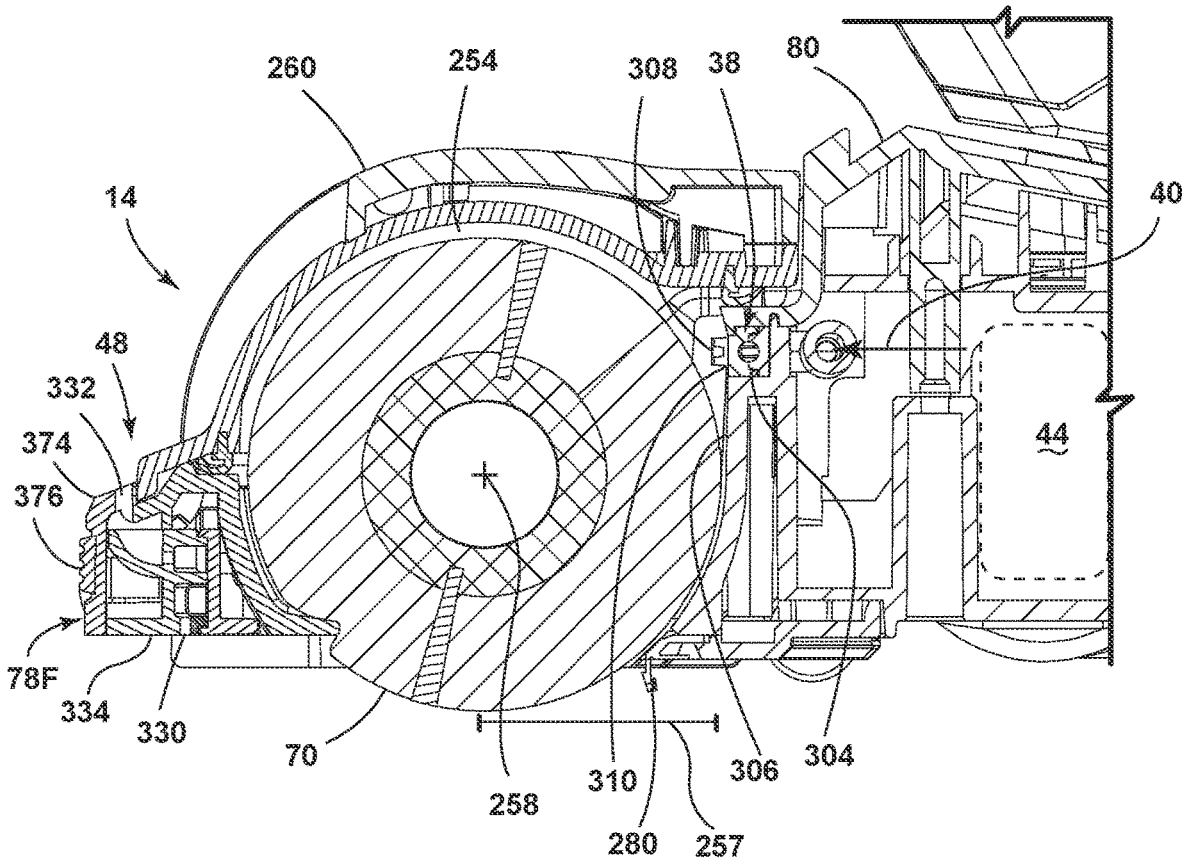
FIG. 17 is a cross-sectional view of the base, taken through line XVII-XVII of FIG. 1.

FIG. 17 shows a portion of the base 14 including the liquid dispenser 38 and the liquid pump 44 according to one aspect of the disclosure The liquid dispenser 38 is coupled to the liquid pump 44 by a portion of the liquid supply path 40 routed through the base 14. The liquid dispenser 38, in one embodiment, can include at least one spray manifold 304 disposed at a rear wall 306 of the brush chamber 254. Accordingly the spray manifold 304 is disposed generally rearwardly of the brushroll 70, and can direct a spray of cleaning fluid toward an upper rear portion of the brushroll 70. From the perspective of FIG. 17, the spray manifold 304 is disposed above the brushroll axis 258 and rearwardly of the brushroll axis 258, so that liquid is contacts the brushroll 70 above and to the rear of the brushroll axis 258, e.g. at an upper rear quadrant of the brushroll 70.

The spray manifold 304 can include at least one spray outlet 308. The spray outlet 308 can be disposed on a front side 310 of the manifold 304. According to one exemplary embodiment, the front side 310 can define a portion of the rear wall 306 of the brush chamber 254, with the outlet 308 projecting into the brush chamber 254. In alternative embodiments, the front side 310 can be recessed in the rear wall 306 or may project beyond the rear wall 306. As shown in FIG. 17, the outlet 308 can be located close to the brushroll 70 on a rear, upper side of the brushroll 70. In one embodiment, the outlet 308 is disposed partially above the brushroll 70 to position the apertures close to the brushroll 70. For example, the outlet 308 is disposed within the rear radius 257 of the brushroll 70.

Figure 18:
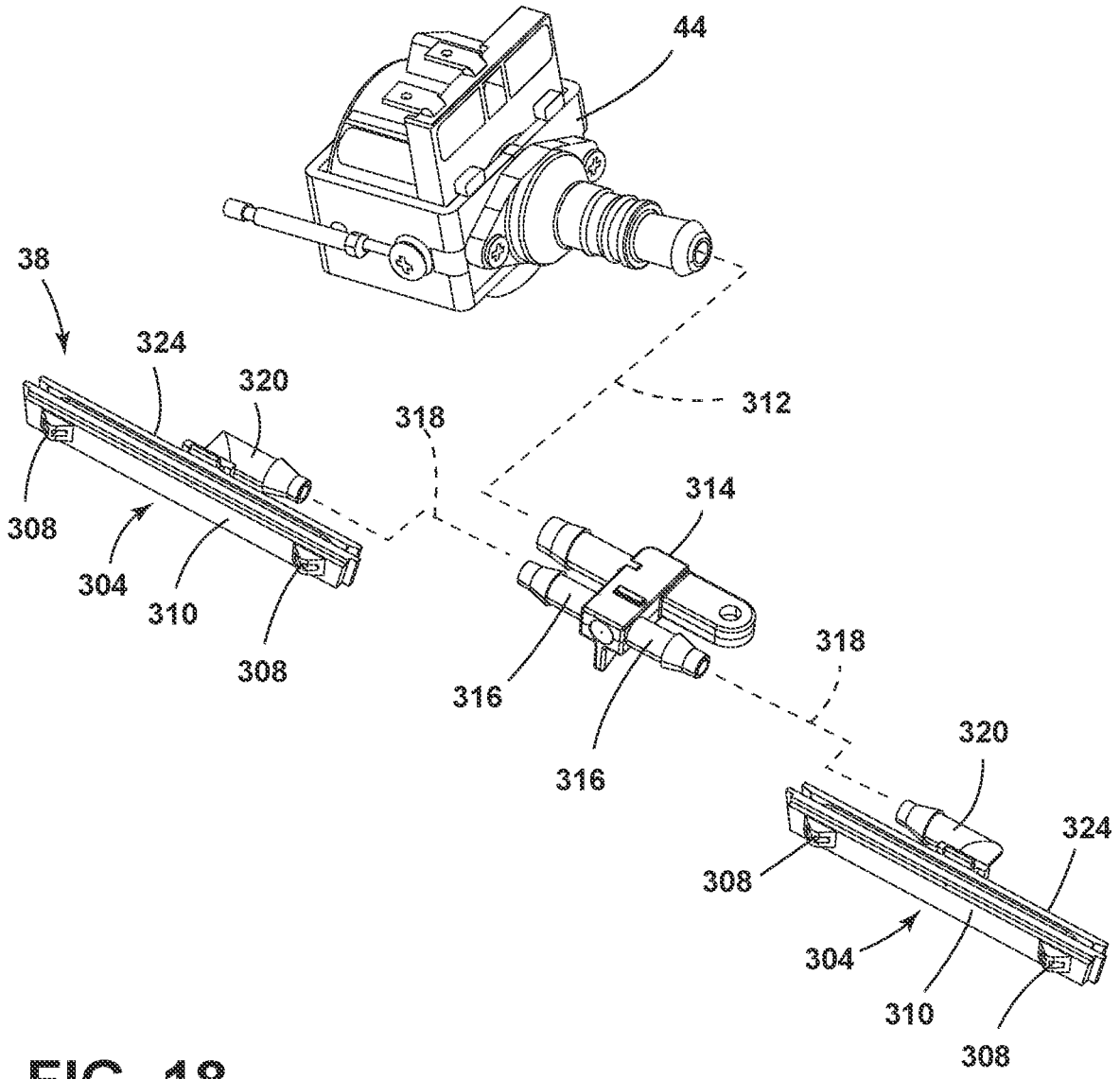
FIG. 18 is a perspective view of a portion of a liquid supply system for the floor cleaner, shown in isolation from other components of the base.

Referring to FIGS. 5 and 18, to accommodate for the suction inlet port 62 (FIG. 5), the liquid dispenser 38 can comprise two spray manifolds 304, each manifold 304 disposed on an opposing side of the suction inlet port 62. The pump 44 can supply liquid through a pump conduit 312 to a Y-connector 314 having connector outlets 316 for each spray manifold 304. A delivery conduit 318 is fluidly connected between each connector outlet 316 and an inlet connector 320 of the spray manifold 304. The pump conduit 312 and delivery conduits 318 can comprise flexible hose or tubing, and are shown schematically in FIG. 18. By way of non-limiting example, the inlet connectors 320 can supply liquid through a rear side 324 of the spray manifold 304, with the spray outlets 308 on the front, e.g. forward-facing, side 310 of the spray manifold 304.

Figure 19:
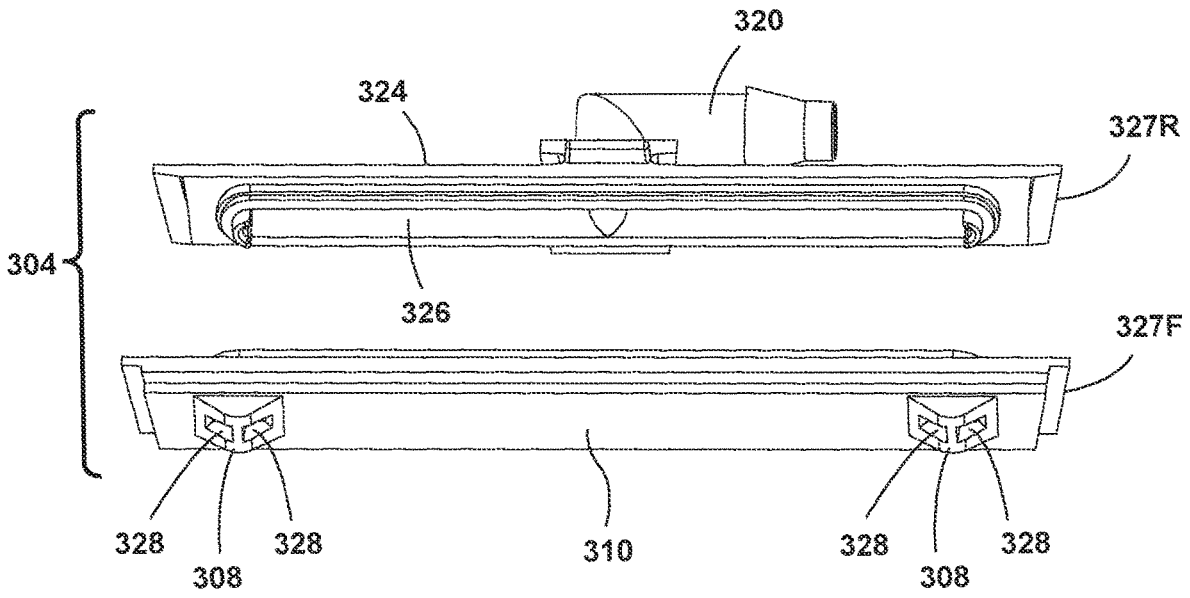
FIG. 19 is an exploded view of a spray manifold for the liquid supply system.

Referring to FIG. 19, the spray manifold 304 can be laterally elongated and/or comprise multiple spray outlets 308 laterally spaced from each other to provide coverage across the brushroll 70. By way of non-limiting example, the spray manifold 304 can include two spray outlets 308. An internal channel 326 within the manifold 304 fluidly connects the inlet connector 320 with the spray outlets 308. The channel 326 can be transversely-elongated to encourage liquid to spread across the length thereof to distribute liquid evenly to each outlet 308. By way of non-limiting example, the channel 326 can be formed by front and rear covers 327F, 327R of the spray manifold 304, the rear side 324 of the spray manifold 304 defined by the rear cover 327R and the front side 310 of the spray manifold 304 defined by the front cover 327F.

In one embodiment, each spray outlet 308 includes a plurality of discharge ports 328 for directing the flow of liquid from the spray manifold 304 onto the brushroll 70. Any suitable number, size, configuration, and angle of discharge ports 328 may be selected for facilitating distribution of liquid onto the brushroll 70. For example, according to the illustrated embodiment, each outlet 308 includes two discharge ports 328 oriented at an angle relative to the rear wall 306 in order to ensure the flow of liquid is directed across the entire, or substantially the entire, length of the brushroll 70. According to one exemplary embodiment, there is about 140 degrees between the discharge ports 328, with the ports 280 directing a spray of liquid at an angle of about 20 degrees from parallel to the rear wall 306. In addition, according to alternative embodiments, each discharge port 328 may have a different angle than adjacent discharge ports 328. Other spray configurations are possible and within the scope of the present subject matter.

Referring to FIG. 17, according to one aspect of the disclosure, the steam dispenser 48 is disposed on the base 14 and includes a floor steam outlet 330 that dispenses steam toward the floor and a visible vapor outlet 332 dispenses steam as visible vapor that can be observed by a user of the floor cleaner 10. In other embodiments, the steam dispenser 48 does not include the visible vapor outlet 332, and may dispense all steam through the floor steam outlet 330. Yet other configurations for the steam dispenser 48 are possible.

In one embodiment, generally, the steam dispenser 48 is disposed forwardly of the brushroll 70, brush chamber 254, and the liquid dispenser 38. More specifically, the floor steam outlet 330 of the steam dispenser 48 is forward of the brushroll 70, brush chamber 254, and the liquid dispenser 38, and the vapor outlet 332 of the steam dispenser 48 is forward of the floor steam outlet 330.

The floor steam outlet 330 can face downwardly, e.g. can open toward the floor surface, in front of the brushroll 70. As such, on a forward stroke of the base 14, steam is dispensed to the surface to be cleaned in front of, and before the surface is agitated by, the brushroll 70. In this location, the steam adds wet heat to the surface to be cleaned, which can pre-wet and soften stains and soils. As such, when moving the base 14 in a forward cleaning stoke, steam is dispensed to the surface to be cleaned before the surface is agitated by the brushroll 70 or suction is applied by the suction inlet port 62 (FIG. 15).

The visible vapor outlet 332 can face upwardly, e.g. can open away from the floor surface. The visible vapor outlet 332 generally dispenses steam vapor upwardly from the base 14, so that the steam vapor exiting the outlet 332 rises away from the surface to be cleaned.

In another embodiment, the outlet 332 can face forwardly to a dispense steam vapor forwardly from the base 14. In yet another embodiment, the outlet 332 can face downwardly to a dispense steam vapor generally toward the surface to be cleaned, although it is understood that the steam vapor may or may not reach the surface to be cleaned, as at least a portion of the steam vapor exiting the downwardly-facing outlet 332 may rise away from the surface.

The visible vapor outlet 332 can be disposed at the front side 78F of the base 14. In this location, the steam vapor is output within a line of sight of the user, thereby offering a visual confirmation to the user that steam is being generated and dispensed by the floor cleaner 10. Further, since the floor steam outlets 330 are hidden under the base 14, the visible steam vapor also offers a visual confirmation to the user that steam is being generated and dispensed by the floor cleaner 10. Visible steam could additionally or alternatively be routed to lateral sides 78R, 78L or rear side 78B of the base 14. Providing at least a portion of the visible steam at the front side 78F of the base 14 may be preferred, as this is within a clear line of sight of the user operating the floor cleaner 10.

Various configurations for the steam dispenser 48 are possible. In some embodiments, the floor steam outlet 330 and the visible vapor outlet 332 may be integrated with each other on the base 14, e.g. a single molded or integral steam dispenser assembly. In other embodiments, the floor steam outlet 330 may be remote from the visible vapor outlet 332. For example, the visible vapor outlet 332 can be located at a distance from the floor steam outlet 330, and require conduits, ducts, tubing, hoses, etc. routed through the floor cleaner 10 to fluidly couple the heater 46 to the outlets 330, 332.

Figure 20:
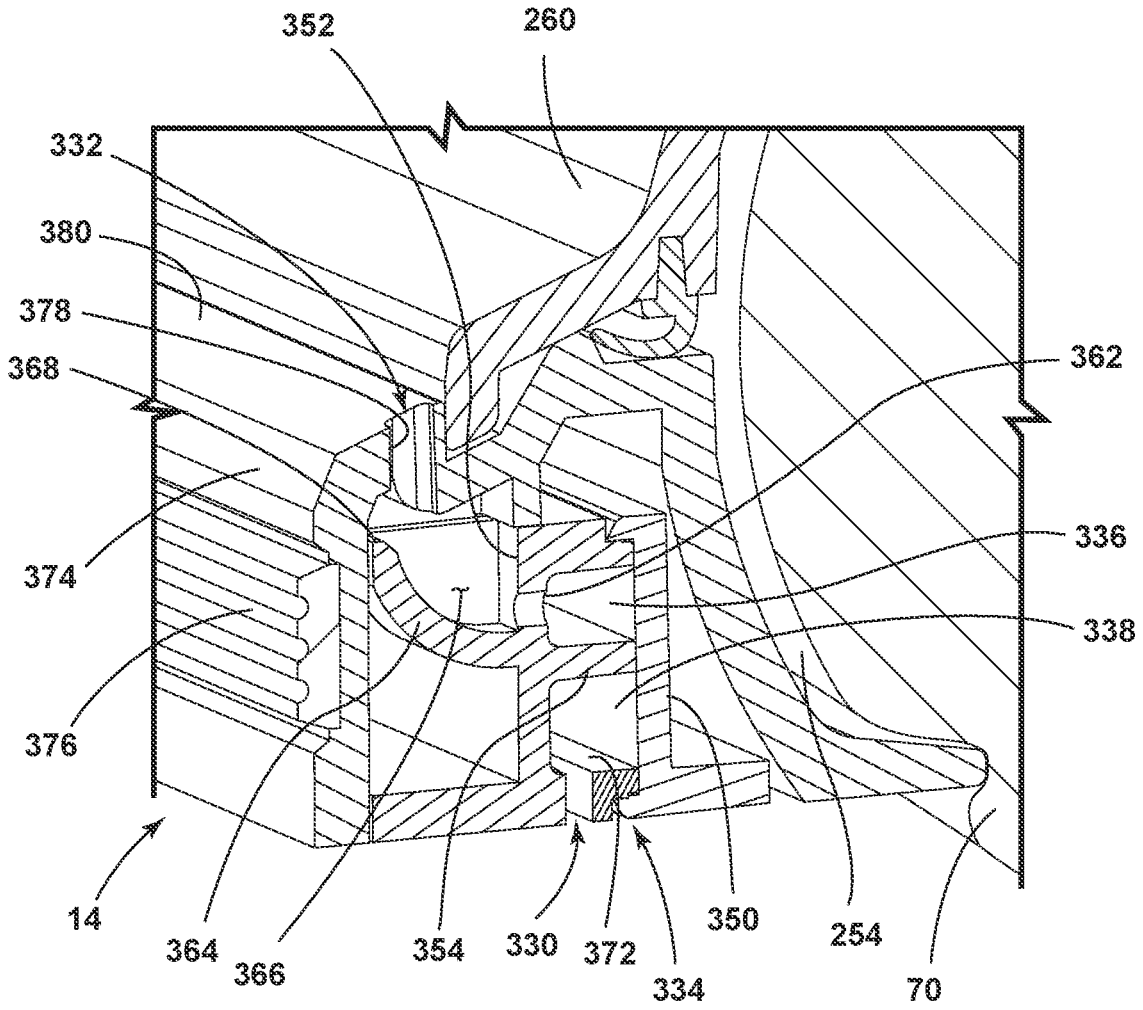
FIG. 20 is a close-up perspective view of a steam dispenser of a steam supply system for the floor cleaner, shown in a cross-section taken through line XVII-XVII of FIG. 1.
Figure 21:
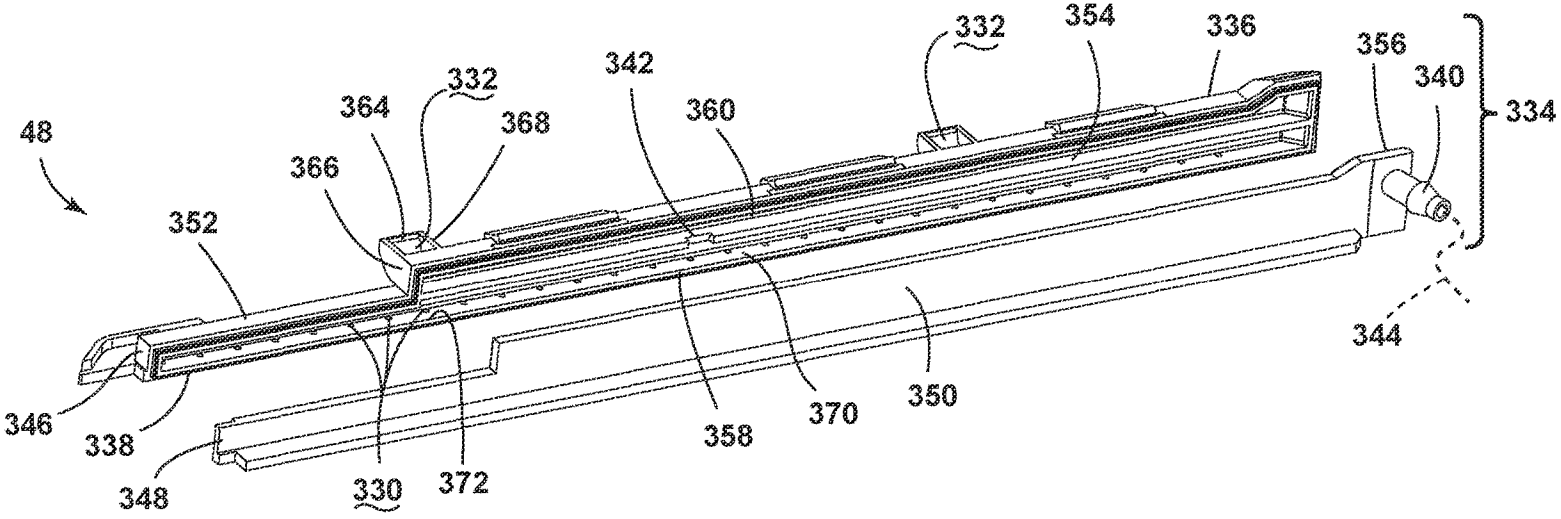
FIG. 21 is an exploded view of the steam dispenser for the steam supply system.

FIGS. 20-21 shows an embodiment of the steam dispenser 48 including a steam bar 334 comprising multiple floor steam outlets 330 and multiple vapor outlets 332. The steam bar 334 includes a first manifold 336 having multiple vapor outlets 332 and a second manifold 338 having multiple floor steam outlets 330. The first manifold 336 includes an inlet port 340 and an outlet port 342 opening to the second manifold 338. The inlet port 340 is in fluid communication with the heater 46 (FIG. 3A) through a steam supply conduit 344. The steam supply conduit 344 can comprise flexible hose or tubing, and is shown schematically in FIG. 21. The steam supply conduit 344 may pass from the upright body 12 to the base 14, for example by passing through or around the joint assembly 34.

The first manifold 336 can be configured to create back pressure that helps expel steam from the outlets 332 as visible steam. Without back pressure, the steam may be pulled out of the steam manifold by the vacuum suction. The back pressure created by the first manifold 336 isolates the visible steam ports from the vacuum suction to allow at least some, or all, of the steam to escape via the visible steam ports. It is noted that, in some embodiments, the steam quality of the visible steam may be higher than the steam dispensed to the floor. In other embodiments, the steam quality of the visible steam and the steam dispensed to the floor may be about the same.

By way of non-limiting example, the steam bar 334 can be formed by front and rear covers 346, 348, with a rear side 350 of the steam bar 334 defined by the rear cover 348 and a front side 352 of the steam bar 334 defined by the front cover 346.

In the embodiment shown in FIG. 21, the manifolds 336, 338 are integrated into one steam bar 334, e.g. as a single molded or integral component. In another embodiment, the steam dispenser 48 can include two or more steam bars, such as one including the first manifold 336 and one including the second manifold 338.

Various relative orientations for the manifolds 336, 338 are possible. In one embodiment, the first manifold 336 is disposed above the second manifold 338. The first manifold 336 can be vertically stacked with the second manifold 338, with a dividing wall 354 separating the two manifolds 336, 338. The outlet port 342 can be formed in the dividing wall 354. In another embodiment, the one manifold can be disposed in front of the other manifold, e.g. can be horizontally stacked. Vertically stacking the manifolds 336, 338 has the advantage of minimizing the distance between the front the base 14 and the front of the brushroll 70. This allows cleaning to happen closer to the front edge of the base 14. In the vertically stacked configuration shown in FIG. 20-21, the rear side 350 of the steam bar 334 defines a rear side or wall of the manifolds 336, 338 and the front side 352 of the steam bar 334 defines a front side or wall of the manifolds 336, 338.

The inlet port 340 can be disposed at one end 356 of the steam bar 334. By way of non-limiting example, the inlet port 340 can supply steam through the rear side 350 of the manifold 336.

The outlet port 342 feeds steam from the first manifold 336 to the second manifold 338. To provide a generally even steam distribution to the vapor outlets 332 and the floor steam outlets 330, the outlet port 342 can have an equivalent hydraulic diameter to the vapor outlets 332. In other words, the outlet port 342 can have an opening size that is about equal to the total opening size of the vapor outlet 332.

The outlet port 342 can be disposed at a central portion 358 of the steam bar 334. For example, the outlet port 342 can be disposed at a center of the second manifold 338. Depending on the relative lengths of the two manifolds 336, 338, the outlet port 342 may be offset from the center of the first manifold chamber 336, as shown in FIG. 21. For example, in one embodiment, the second manifold 338 is longer than the first manifold 336. In other embodiments, the outlet port 342 may be disposed at the center of both manifolds 336, 338.

Referring to FIG. 21, the first manifold 336 can be laterally elongated and/or comprise multiple outlets 332 laterally spaced from each other to provide multiple points for visible vapor to exit across the front of the base 14. By way of non-limiting example, the manifold 336 can include two outlets 332. An internal channel 360 within the manifold 336 fluidly connects the inlet port 340 with the outlets 332. The channel 360 can be transversely-elongated to encourage steam to spread across the length thereof to distribute steam evenly to each outlet 332.

Figure 22:
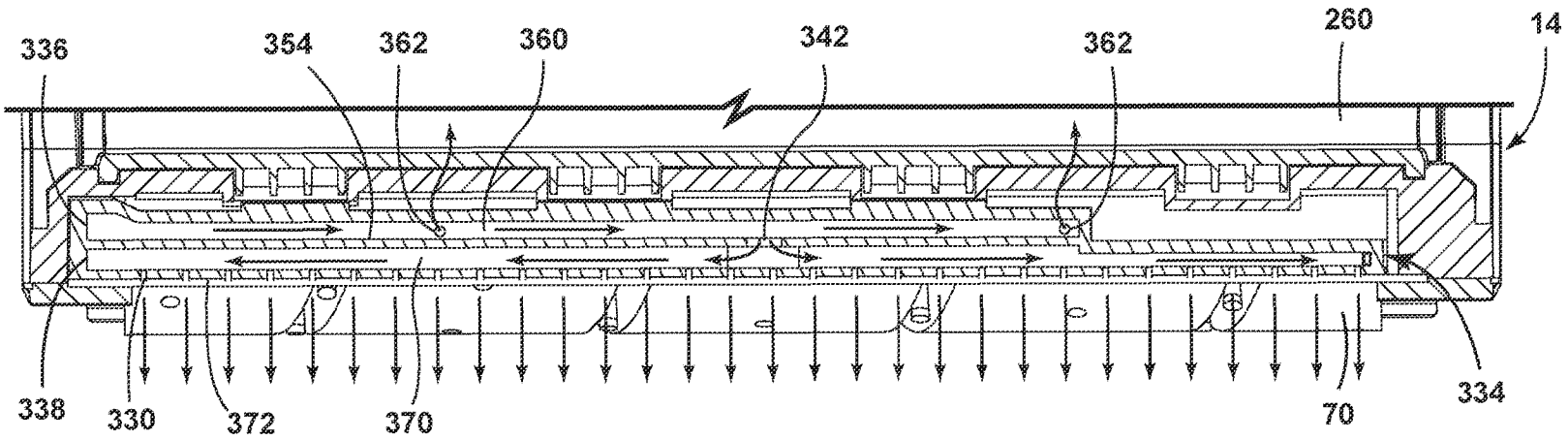
FIG. 22 is a cross-sectional view of the base, taken through line XXII-XXII of FIG. 1 and showing a portion of a steam dispensing path for the steam supply system.

In one embodiment, the manifold 336 includes at least one discharge port 362 for directing the flow of visible steam from the channel 360 toward each outlet 332. Any suitable number, size, configuration, and angle of discharge port 362 may be selected for facilitating exit of visible steam from the channel 360. By way of non-limiting example, the discharge port 362 can supply steam through the front, e.g. forward-facing, side 352 of the manifold 336. For example, according to the illustrated embodiment, each outlet 332 includes an associated discharge port 362 in the front side 352 of the manifold 336, as best seen in FIGS. 20 and 22. The discharge ports 362 can be formed as small openings in the front side or wall 352. Alternatively the discharge ports 362 can comprise narrow slit-like openings, or openings of other shapes, including a plurality of openings of uniform or varying size, defining the ports 362.

Various walls, baffles, or channel structures can guide steam from the discharge port 362 to the steam vapor outlet 332. In one embodiment, a baffle 364 directs steam vapor forwardly and upwardly from the port 362 to the outlet 332. The baffle 364 can extend from below the port 362 in a forward direction, curving upwardly toward the outlet 332. As best seen in FIG. 21, the baffles 364 can define, at least in part, a baffle chamber 366 that extends from the front side 352 of the manifold 336 to direct the output of visible vapor outwardly from the manifold 336. To redirect steam from the discharge port 362 to the outlet 332, the baffle 364 can have at least one turn between the port 362 and outlet 332, with the baffle 364 changing the direction by at least 90°. Other baffle configurations are possible and within the scope of the present subject matter.

Any suitable number, size, configuration, and angle of steam vapor outlet 332 may be selected for facilitating exit of steam vapor from the baffle chamber 366. By way of non-limiting example, the steam vapor outlets 332 can supply steam through a top, e.g. upward-facing, side 368 of the baffle chamber 366. For example, according to the illustrated embodiment, each outlet 332 can be formed as an opening through the top side 368. Alternatively the outlets 332 can comprise narrow slit-like openings, or openings of other shapes, including a plurality of openings of uniform or varying size. In another embodiment, alternatively to having a plurality of outlets 332, the steam dispenser 48 can have a single, narrow slit-like outlet defining the outlet 332.

Referring to FIG. 21, the second manifold 338 can be laterally elongated and/or comprise multiple outlets 330 laterally spaced from each other to provide coverage across a width equal to, including substantially equal to, the brushroll 70. By way of non-limiting example, the manifold 338 can include twenty-nine floor steam outlets 330. An internal channel 370 within the manifold 338 fluidly connects the outlet port 342 with the floor steam outlets 330. The channel 370 can be transversely-elongated to encourage steam to spread across the length thereof to distribute steam evenly to each outlet 330.

Any suitable number, size, configuration, and angle of floor steam outlet 330 may be selected for facilitating exit of steam from the channel 360. By way of non-limiting example, the floor steam outlets 330 can supply steam through a bottom, e.g. floor-facing, side 372 of the manifold 338. For example, according to the illustrated embodiment, each outlet 330 can be formed as a small opening in the bottom side or wall 372. Alternatively the outlets 330 can comprise narrow slit-like openings, or openings of other shapes, including a plurality of openings of uniform or varying size. In another embodiment, alternatively to having a plurality of outlets 330, the steam dispenser 48 can have a single, narrow slit-like outlet defining the outlet 330.

With reference to FIGS. 17 and 22, the floor steam outlets 330 can be in close proximity to the bottom of the base 14 to heat the floor surface. For example, in some embodiments the steam dispensed from the outlets 330 may heat the floor surface to around 30° C. to 60° C., alternative may raise the temperature of the floor surface by around 10° C. to 40° C. In some embodiments, the floor steam outlets 330 can be disposed above an underside of the base 14 and/or an underside of the brushroll 70, which accordingly spaces the outlets 330 vertically from the surface to be cleaned. This can prevent the dispensing steam from damaging certain types of floor surfaces, while still heating the floor surface to the temperature ranges noted above. In another embodiment, the floor steam outlets 330 can be at the underside of the base 14 and/or even with an underside of the brushroll 70.

Referring to FIGS. 17 and 20, the steam bar 334 is provided forwardly of the brush chamber 254, and can be mounted within the base 14, partially on an exterior of the base 14, or fully on the exterior of the base 14. In one embodiment, the steam bar 334 can be positioned between the brush chamber 254 and a portion of the base housing 80. By way of non-limiting example, the base housing 80 can include a front cover 374 at least partially defining the front side 78F of the base 14. In some embodiments, the front cover 374 can include a bumper 376 for protecting the brush cover 260 and/or the steam bar 334. As such, the front cover 374 may protrude forwardly when viewed from the side as in FIGS. 17 and 20.

The front cover 374 can define, in part, the steam vapor outlets 332. In one embodiment, the steam vapor outlets 332 include apertures 378 through the front cover 374 that are in fluid communication with the baffle chamber 366. By way of non-limiting example, the front cover 374 can include a top edge 380 covering the open top side 368 of the baffle chamber 366, with the apertures 378 formed in the top edge 380 and aligned with the baffle chamber 366. In other embodiments, the steam vapor outlets 332 can be defined by the steam bar 334 alone, or by the steam bar 334 and the brush cover 260, or by the steam bar 334 and another portion of the base 14.

As noted above, the cover 260 can be removable from the base 14. The steam bar 334 can be configured to remain with the base 14 when the cover 260 is removed. In another embodiment, the steam bar 334 can be removable with the brush cover 260. For example, the steam bar 334 can be formed or integrated with, mounted or attached to, coupled, or otherwise joined to the front cover 374 and/or another portion of the base 14. To mount the cover 260 on the base 14, the cover 260 can optionally insert into a portion of the steam bar 334 and/or front cover 374. For example, the front cover 374 can include the slots 266 in which the hooks 264 on the cover 260 are inserted (see FIG. 14).

Referring to FIG. 3A, in one aspect of the disclosure, the floor cleaner 10 can have multiple, user-selectable cleaning modes. In one embodiment, the floor cleaner 10 has a hard floor mode, an area rug mode, a steam mode, and a self-cleaning mode. The steam mode can operate in conjunction with the hard floor mode or the area rug mode. The modes can have associated operating parameters for the pumps 44, 56, heater 46, vacuum motor 64, and/or brushroll motor 72.

In one embodiment of the hard floor mode, the vacuum motor 64, liquid pump 44, and brush motor 72 are activated, with the vacuum motor 64 operating at a first power level, and depression of the trigger 28 turns the pump 44 on to dispense cleaning liquid at a first flow rate from the liquid dispenser 38. In the hard floor mode, cleaning fluid can be dispensed at a rate of about 45 ml/min to about 70 ml/min, alternatively about 50 ml/min.

In one embodiment of the area rug mode, the vacuum motor 64, liquid pump 44, and brush motor 72 are activated, and depression of the trigger 28 turns the pump 44 on to dispense cleaning liquid at a second flow rate from the liquid dispenser 38. The second flow rate can be higher than the first flow rate in the hard floor mode. In the area rug mode, cleaning fluid can be dispensed at a rate of about 95 ml/min to about 125 ml/min, alternatively about 100 ml/min. In another embodiment, the flow rate of liquid in the area rug mode is the same as in the hard floor mode.

In the area rug mode, the vacuum motor 64 can operate at a second power level, which can be the same as the first power level in the hard floor mode. In another embodiment, the second power level is higher than the first power to provide greater suction performance by the floor cleaner 10 in the area rug mode.

In one embodiment of the steam mode, the heater 46 and steam pump 56 are activated, and depression of the trigger 28 turns the pump 56 on to dispense steam from the steam dispenser 48. In the steam mode, steam can be dispensed at a rate of about 20 ml/min to about 40 ml/min, alternatively about 35 ml/min, alternatively about 30 ml/min. In embodiments where the steam dispenser 48 includes the separate outlets 330, 332, the steam flow is divided between the outlets 330, 332.

In the steam mode, the steam dispenser 48 can produce visible steam, e.g., a visible vapor that can be observed by the naked eye. Producing visible steam offers a visual confirmation to the user that steam is being generated and dispensed by the floor cleaner 10.

As noted above, the steam mode can be executed in conjunction with the hard floor mode or area rug mode. In such a case, the above-described operating parameters for the selected hard floor mode or area rug mode are also executed while the steam mode is in operation. The dual liquid and steam delivery applies wet heat to the surface to be cleaned to improve debris removal and cleaning efficiency. Application of steam can pre-treat the surface, and using high temperature fluid is particularly efficient at removing embedded soils on soft surfaces like area rugs and stuck-on debris on hard surfaces like wood and tile. The combination of heat, chemical, and mechanical (e.g. via the brushroll 70) interacts to provide improved surface cleaning and reduce cleaning time. For example, a user may need to make fewer passes (e.g., forward/backward cleaning strokes) to remove embedded soils and stuck-on debris.

It is noted that the flow rate of liquid from the liquid dispenser 38 may drop during the steam mode. For example, the rate of liquid dispensing may drop by 5 ml/min or less during steam dispensing. In another embodiment, the flow rate of liquid from the liquid dispenser 38 is substantially the same regardless of whether steam is being dispensed.

With these available modes, the floor cleaner 10 is operable to clean a floor surface in four distinct combinations: (i) a first cleaning mode or hard floor only cleaning mode in which liquid is dispensed from the liquid dispenser at a first flow rate; (ii) a second cleaning mode or area rug only cleaning mode in which liquid is dispensed from the liquid dispenser at a second flow rate; (iii) a third cleaning mode or hard floor plus steam cleaning mode in which liquid is dispensed from the liquid dispenser at the first flow rate and steam is dispensed from the steam dispenser; and (iv) a fourth cleaning mode or area rug plus steam cleaning mode in which liquid is dispensed from the liquid dispenser at the second flow rate and steam is dispensed from the steam dispenser.

In one embodiment of the self-cleaning mode, the floor cleaner 10 executes an automatic, unattended clean-out cycle. During the clean-out cycle, the vacuum motor 64, liquid pump 44, and brush motor 72 are activated in an automated sequence, and cleaning liquid is sprayed on the brushroll 70, the brushroll 70 rotates, and liquid is extracted and deposited into the recovery tank 22, thereby also flushing out the brush chamber 254 and the recovery path 66. The vacuum motor 64, pump 44, and brush motor 72 can be active individually or simultaneously, and for any predetermined times, including overlapping and non-overlapping times. For example, the vacuum motor 64, pump 44, and brush motor 72 can be activated at once. In another example, the pump 44 and brush motor 72 can be activated for a first predetermined period, and the vacuum motor 64 activated after. In yet another example, the pump 44 can be activated for a first predetermined period, the brush motor 72 can be activated for a second predetermined period after the pump 44 is de-activated, and the vacuum motor 64 activated during or after activation of the pump 44 and/or brush motor 72. Yet other clean-out cycles are possible. The self-cleaning mode can be configured to last for a predetermined amount of time or until the cleaning liquid in the supply tank 20 has been depleted.

By way of non-limiting example, in one self-cleaning mode, the liquid pump 44 and brush motor 72 are activated for 10 seconds, then the brush motor 72 remains on for an additional 10 seconds while the pump 44 is de-activated to spin the brushroll 70 without additional liquid delivery, and finally the brush motor 72 remains on for an additional 20 seconds while vacuum motor 64 is activated. In total, the clean-out cycle lasts for 40 seconds. Steam is not dispensed during the self-cleaning mode, therefore the steam pump 56 is not activated.

In the self-cleaning mode, cleaning fluid can be dispensed at a rate of about 50 ml/min to about 1000 ml/min, alternatively about 480 ml/min. The self-cleaning mode can be designed to deposit a specific amount (e.g., 80 mL) of cleaning fluid into the tray in a predetermined amount of time (e.g., about 10 seconds).

In the self-cleaning mode, the vacuum motor 64 can operate at a third power level, which can be the same as the first power level in the hard floor mode and/or the same as the second power level in the area rug mode. In another embodiment, the third power level is higher than the first power and the second power level to provide greater suction performance by the floor cleaner 10 in the self-cleaning mode.

In another embodiment of the self-cleaning mode, at least some steam is dispensed in self-cleaning mode during an automatic, unattended clean-out cycle.

Table 1 below lists some non-limiting examples of operating parameters for the modes. Other operating parameters for the modes and other cleaning modes are possible.

TABLE 1

| Mode | Liquid Dispensing | Steam Dispensing | Vacuum Motor | Brush Motor |
|---|---|---|---|---|
| Hard Floor | LOW | OFF | ON | ON |
| Area Rug | HIGH | OFF | ON | ON |
| Steam | LOW/HIGH | ON | ON | ON |
| Self-Cleaning | HIGH | OFF | ON | ON |

In all manual cleaning modes (e.g. user-operated or attended modes), the release of cleaning fluid can be controlled by the trigger 28. Alternatively, release of cleaning liquid can be controlled by the trigger 28 and release of steam can be controlled by the steam input control 60. In the unattended self-cleaning mode, the release of cleaning fluid is automatic.

Figure 23:
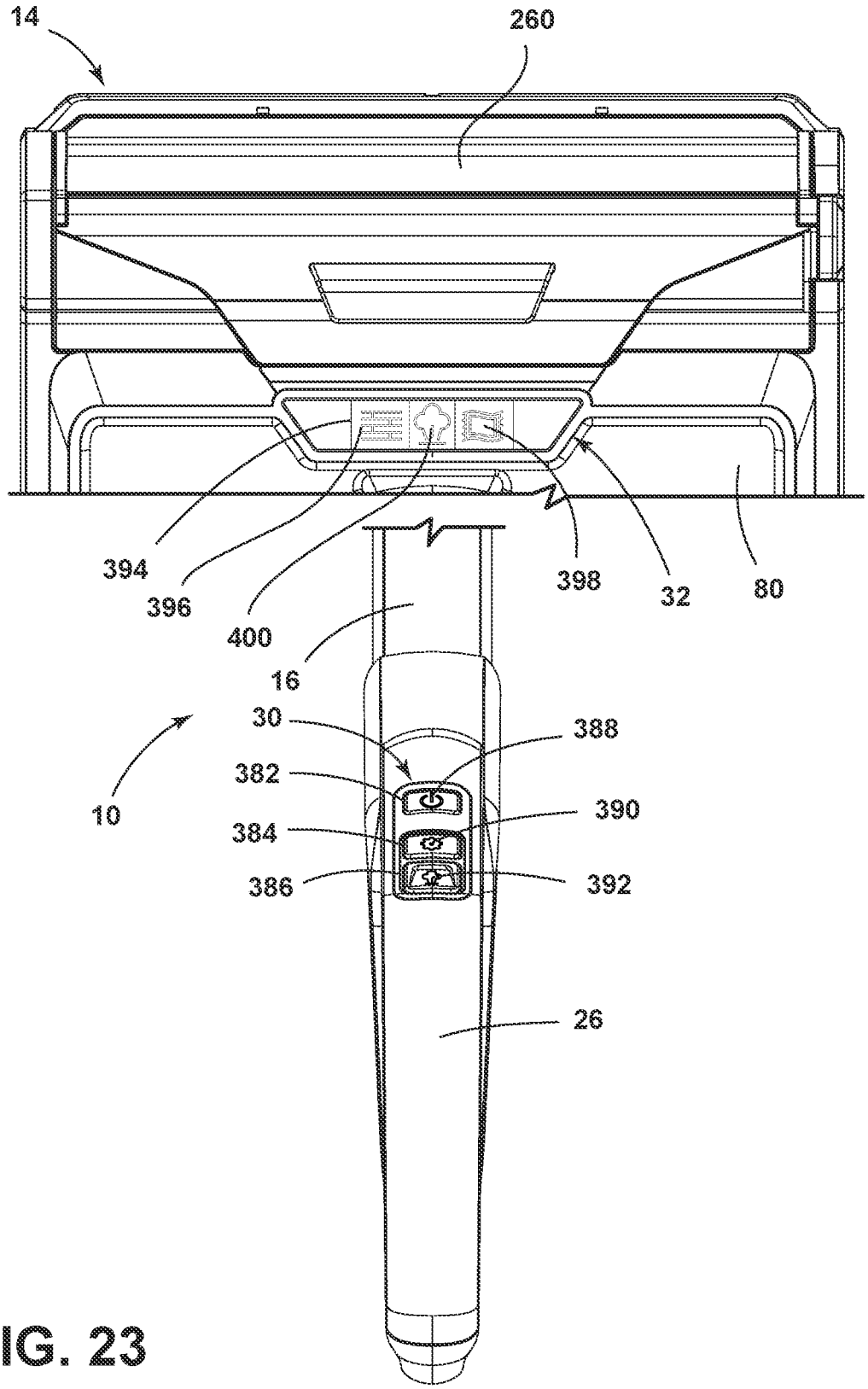
FIG. 23 is a schematic view showing one configuration for the user interfaces of the floor cleaner of FIG. 1, along with a portion of the handle and base.

FIG. 23 is a schematic view showing one configuration of the UIs 30, 32 for the floor cleaner 10 are shown, along with the handle 16 and base 14. The first UI 30 has an on/off button, e.g. a power button 382, to activate and de-active the vacuum motor 64 (FIG. 3A). By default, pressing the power button 382 to activate the vacuum motor 64 can operate the floor cleaner 10 in the hard floor mode. In other embodiments, the default cleaning mode can be the area rug mode or the last mode selected before the floor cleaner 10 was last powered off. Other default operating modes for the floor cleaner 10 are possible, including a default mode in which pressing the power button 382 activates an electronic component of the floor cleaner 10 other than the vacuum motor 64.

The first UI 30 has a mode select input control or mode button 384 to select between different modes when the floor cleaner 10 is on. For example, repeated pressing of the mode button 384 can cycle between the hard floor and the area rug modes. In another example, repeated pressing of the mode button 384 can cycle between the hard floor mode, area rug mode, hard floor+steam, area rug+steam, and/or self-cleaning mode, or any combination thereof, and in any order thereof.

The first UI 30 has a steam button 386 to select the steam mode. For example, repeated pressing of the steam button 386 can cycle the steam mode on and off. In one example, in the steam mode, the pump 56 (FIG. 3A) is activated. Therefore, pressing the steam button 386 activates and de-actives the pump 56. In other embodiments, a separate steam button 386 is not provided, and the steam mode can be selected via the mode button 384.

Optionally, there is a warm-up period after turning the heater 46 on via the power button 382 during which steam is not available to be dispensed. By way of non-limiting example, the warm-up period may last up to about 30 seconds.

As noted above, the steam mode can be structured to operate in conjunction with the hard floor mode, area rug mode, or another cleaning mode. For example, pressing the steam button 386 to select a steam mode may include maintaining operation of the currently-selected hard floor or area rug mode. In another embodiment, pressing the steam button 386 to select the steam mode may deactivate the currently-selected mode.

Each button 382, 384, 386 is preferably provided with an icons 388, 390, 392, respectively. The icons can be in the form of graphics, symbols, words, or a combination thereof. Various icons are possible, and preferably give the user an indication of the purpose of the button. The icons 388, 390, 392 can be formed on the button 382, 384, 386 via pad printing, attaching a label, adhering a graphic, or the like, or are otherwise visible at all times to the user. In another embodiment, the icons can next to the buttons rather than on the buttons.

Various arrangements of the buttons 382, 384, 386 are possible. In one embodiment, the buttons 382, 384, 386 are arranged accordingly to a predetermined frequency of use, with the steam button 386 disposed highest on the grip 26, e.g. closest to the user, followed by the mode button 384, and the power button 382 disposed lowest on the grip 26, e.g. farthest from the user.

During operation, the user can select the mode button 384 and/or steam button 386 to toggle through multiple cleaning modes. With the arrangement of the UI 30 on the handle 16 the user can conveniently hold the handle grip 26 in one hand and use the thumb of the same hand to toggle the mode button 384 and/or steam button 386 until the desired mode is selected. The selected cleaning mode is displayed on the base 14 by the second UI 32.

The second UI 32 includes a status display 394 on the base 14 with a plurality of status indicators 396, 398, 400. The individual status indicators can each include at least one icon in the form of graphics, symbols, words, or a combination thereof. In FIG. 23, for example, the second UI 32 is shown with three status indicators, including a hard floor mode status indicator comprising an icon 396 in the form of a graphic depicting a hard floor, an area rug status indicator comprising an icon 398 in the form of a graphic icon depicting a rug, and a steam status indicator comprising an icon 400 in the form of a graphic icon depicting steam.

The second UI 32 can be structured so that when the floor cleaner 10 is off, the status display 394 is blank and the status indicators 396, 398, 400 are hidden or dead, e.g. not illuminated, and when the floor cleaner 10 is on, the status indicators 396, 398, 400 may selectively be illuminated and visible to the user. In one embodiment, the status indicators 396, 398, 400 can be back-lit icons that are hidden or dead, e.g. not illuminated, under a first condition and may selectively be illuminated and visible under a second condition. For example, the hard floor icon 396 can be hidden or dead, e.g. not illuminated when the floor cleaner 10 is not operating in the hard floor mode, and can be illuminated and visible when the hard floor mode is selected, e.g. using mode button 384 The area rug icon 398 can be hidden or dead, e.g. not illuminated when the floor cleaner 10 is not operating in the area rug mode, and can be illuminated and visible when the area rug mode is selected, e.g. using mode button 384. The steam icon 400 can be hidden or dead, e.g. not illuminated when the floor cleaner 10 is not operating in the steam mode, and can be illuminated and visible when the steam mode is selected, e.g. using steam button 386. The status display 394 therefore shows the selected cleaning mode on the base 14, within the user's field of view where the user naturally looks while cleaning a surface. The different shapes of the icons 396, 398, 400 provide visual signal to the user that different modes are in operation. To provide a further visual distinction, in some embodiments the icons 396, 398, 400 may illuminate in different colors. For example, the hard floor and area rug icons 396, 398 can illuminate in a first color (e.g., blue), and the steam icon 400 can illuminate in a second color (e.g., orange).

Figure 24:
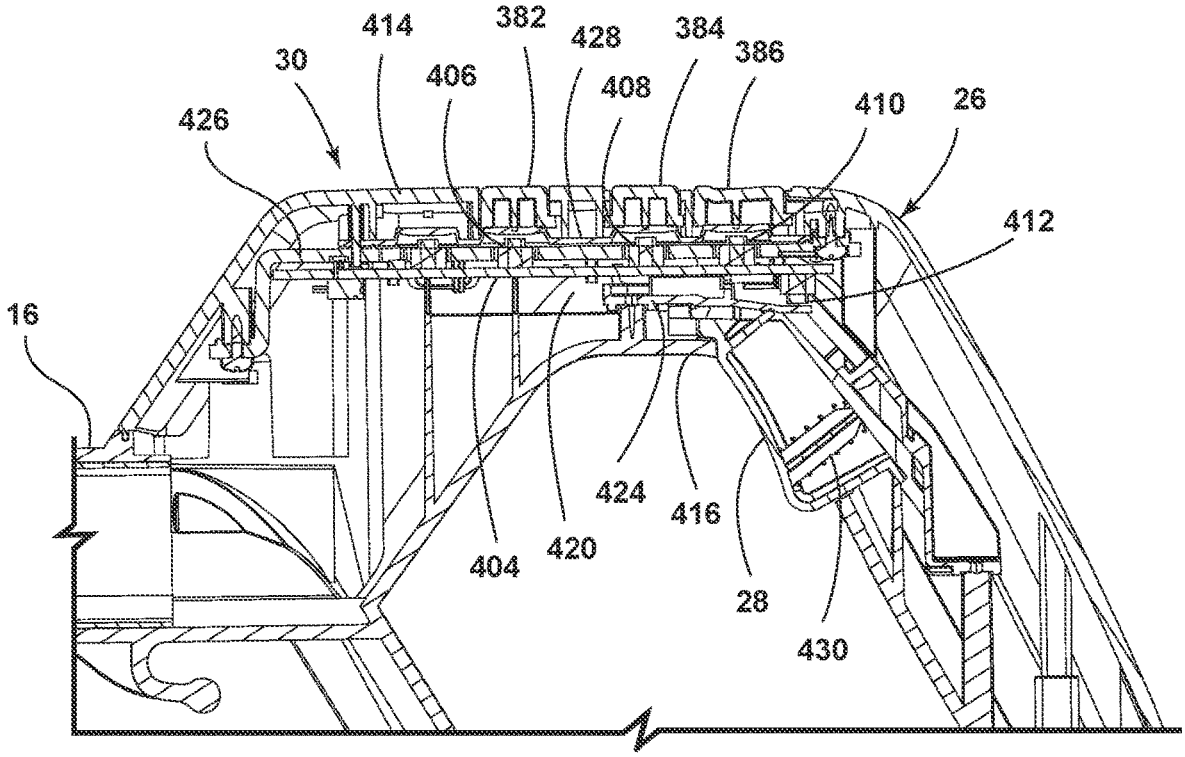
FIG. 24 is a cross-sectional view of a handle of the floor cleaner, taken through line IV-IV of FIG. 1 and showing a first user interface and a trigger on the handle.
Figure 25:
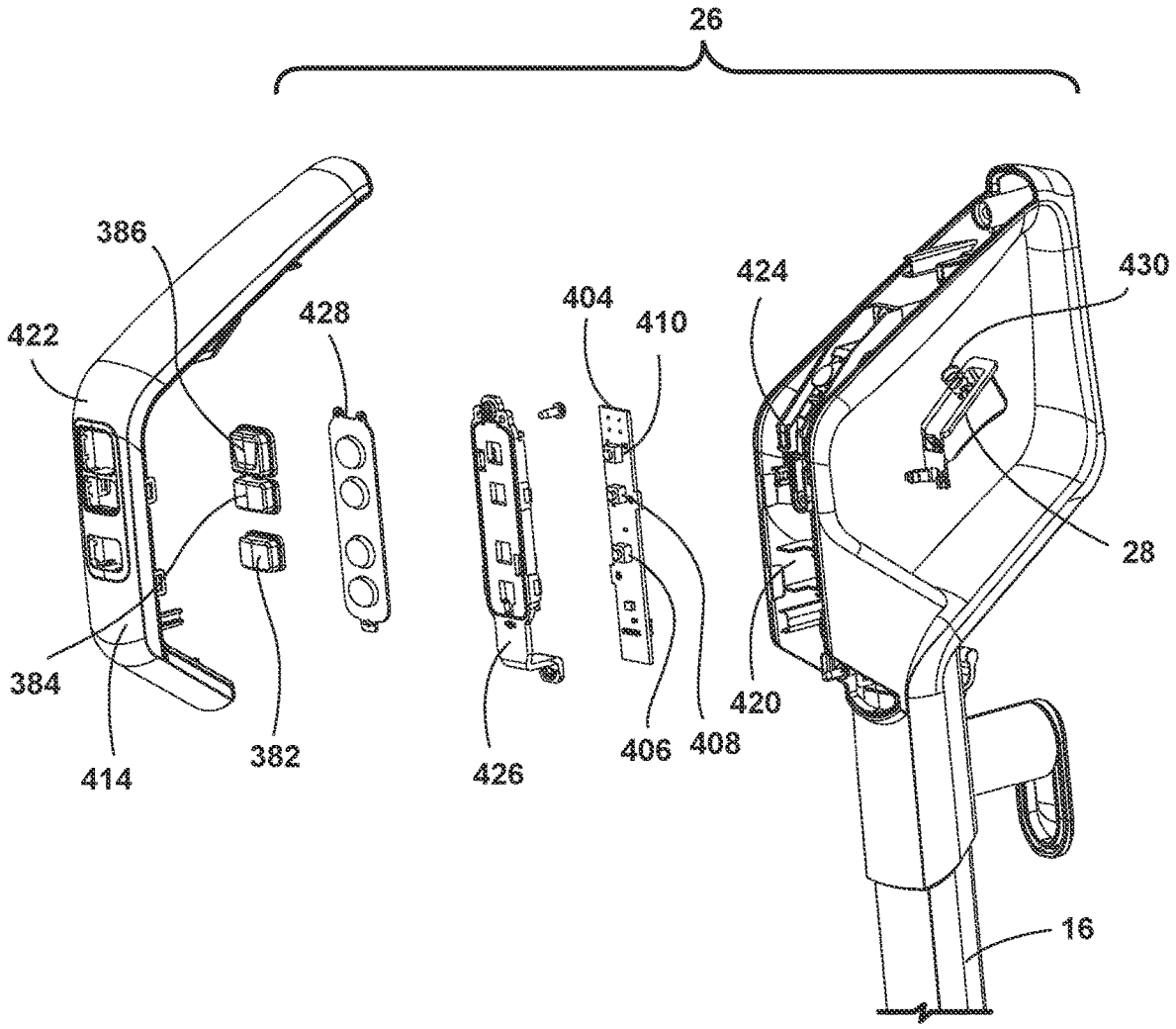
FIG. 25 is an exploded view of the handle, first user interface, and trigger.

FIG. 24 is a cross-sectional view through the first UI 30, a portion of the handle 16, and the hand grip 26. The first UI 30 may include a first UI controller 402. The first UI controller 404 can include, in one embodiment, a PCB with switches 406, 408, 410 on a first surface thereof that are operated by the buttons 382, 384, 386, respectively. By way of non-limiting example, the switches 406, 408, 410 may be toggle switches.

The first UI controller 404 can include a trigger switch 412 on a second surface of the PCB that is operated by the trigger 28. The trigger switch 412 may be a momentary switch that is closed only as long as the user depresses the trigger 28. Closure of the trigger switch 412 operates one or both of the pumps 44, 56. Alternatively, the trigger 28 can mechanically communicate with the fluid delivery system, such as via a push rod (not shown) that runs through the handle 16.

The trigger 28 can conveniently be located adjacent to the UI 30. For example, in one arrangement, the buttons 382, 384, 386 of the UI 30 are disposed on a front side 414 of the grip 26 and the trigger 28 is disposed on a rear side 416 of the grip 26. Conveniently, a user may operate the trigger 28 using the forefinger and the buttons 382, 384, 386 using the thumb of the same hand holding the grip 26. For a closed-loop grip 26 as shown in FIG. 24, the front side 414 comprises an outwardly-facing side of the loop grip 26 and the rear side 416 comprises an inwardly-facing side of the loop grip 26.

Optionally, the controller 404 can include illumination elements (e.g. LEDs) on the PCB that selectively emit light to illuminate the icons 388, 390, 392 (FIG. 23) on the buttons 382, 384, 386 or status lights associated with the buttons 382, 384, 386.

Various mounting arrangements for the UI 30 on the grip 26 are possible. In one embodiment, the controller 404 and buttons 382, 384, 386 are mounted within a cavity 420 of the hand grip 26, with a grip cover 422 enclosing the cavity 420 and supporting the buttons 382, 384, 386 in operably alignment with the switches 406, 408, 410. The grip cover 422 may at least partially define the front side 414 of the grip 26. The controller 404 is supported within the cavity 420 by a rear bracket 424 and a front holder 426. The holder 426 includes openings through which the switches 406, 408, 410 project to be actuatable by the buttons 382, 384, 386. To protect the controller 404 from water, a seal 428 is provided between the buttons 382, 384, 386 and the holder 426.

The trigger 28 is pivotally mounted to the hand grip 26. A spring 430 biases the trigger 28 outwardly from the hand grip 26, and is disposed between the bracket 424 and an inwardly-facing side of the trigger 28.

Figure 26:
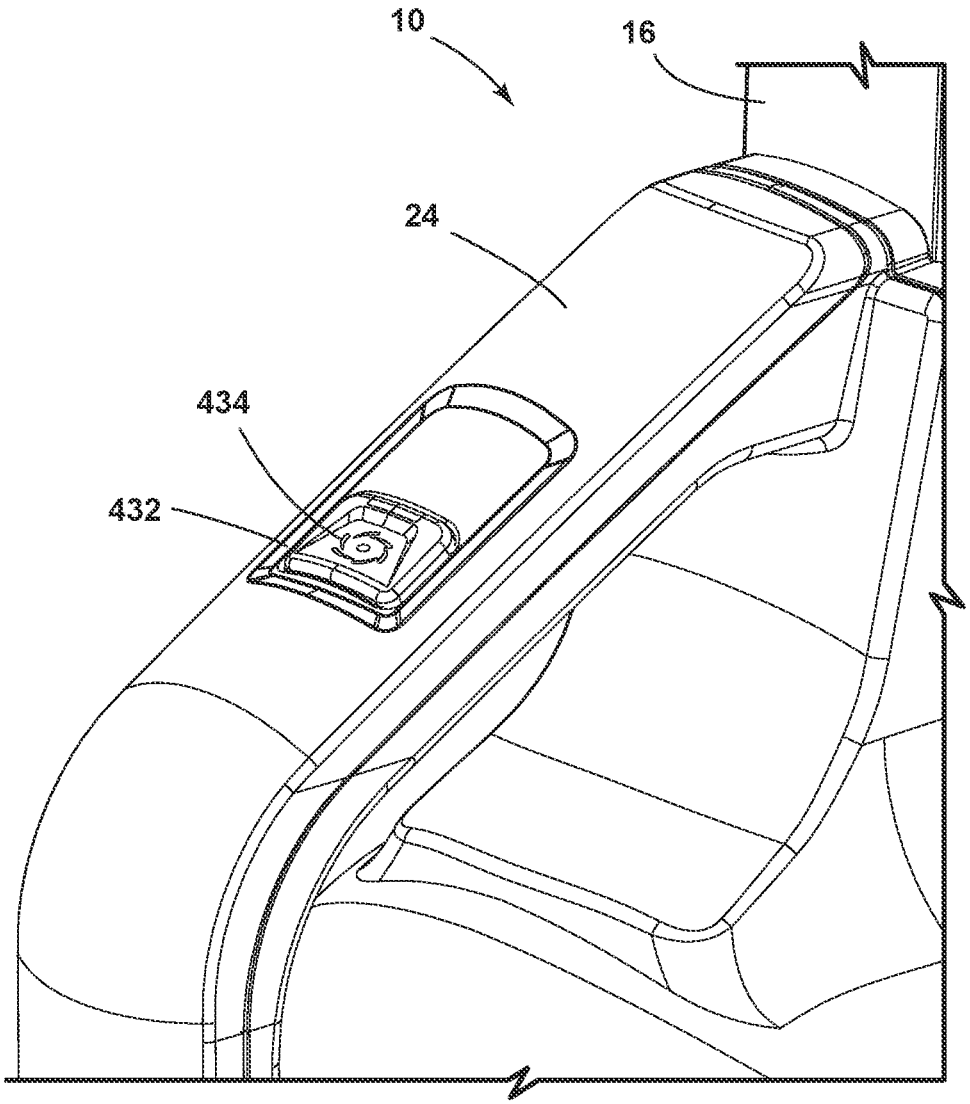
FIG. 26 is a close-up view showing a clean-out cycle button for the floor cleaner.

Referring to FIG. 26, the floor cleaner 10 has a clean-out cycle button 432 to activate and de-active the self-cleaning mode of the floor cleaner 10 in which the floor cleaner 10 executes the automatic, unattended clean-out cycle. The clean-out cycle button 432 can be disposed on the carry handle 24. In another embodiment, the clean-out cycle button 432 can be disposed on the handle 16, alternatively on the hand grip 26 as part of the first UI 30 (FIG. 23). For example, the clean-out cycle button 432 can be located lower than the power button on the front side of the grip 26. Yet other locations for the clean-out cycle button 432 are possible.

In some embodiments, when the self-cleaning feature is not available to the user, pressing the button 432 does not initiate the clean-out cycle. Optionally, the clean-out cycle button 432 can have a contextual or context-based icon 434 that is displayed when a clean-out cycle is needed and/or when a clean-out cycle is ready to be executed. When a clean-out cycle is not needed and/or when a clean-out cycle is not ready to be executed, the icon 434 is not visible to the user. Thus, the contextual icon 434 informs the user when the self-cleaning feature is available, and display of the contextual icon 434 to the user is associated with an enablement of the self-cleaning feature that allows the clean-out cycle to be executed.

The icon 434 can be a back-lit icon structured so that, when the clean-out cycle is available to the user, the icon 434 is hidden or dead, e.g. not illuminated by an LED or other illumination source, and when the clean-out cycle is available to the user, the icon 434 is illuminated and visible to the user. The back-lit icon 434 can be in the form of a graphic, symbol, word, or a combination thereof. For example, the button 432 can have a back-lit graphic on the button 432. In another example, the carry handle 24 can have a back-lit dot or other symbol adjacent to the button 432, which may itself include a graphic or other icon that is always visible.

Figure 27:
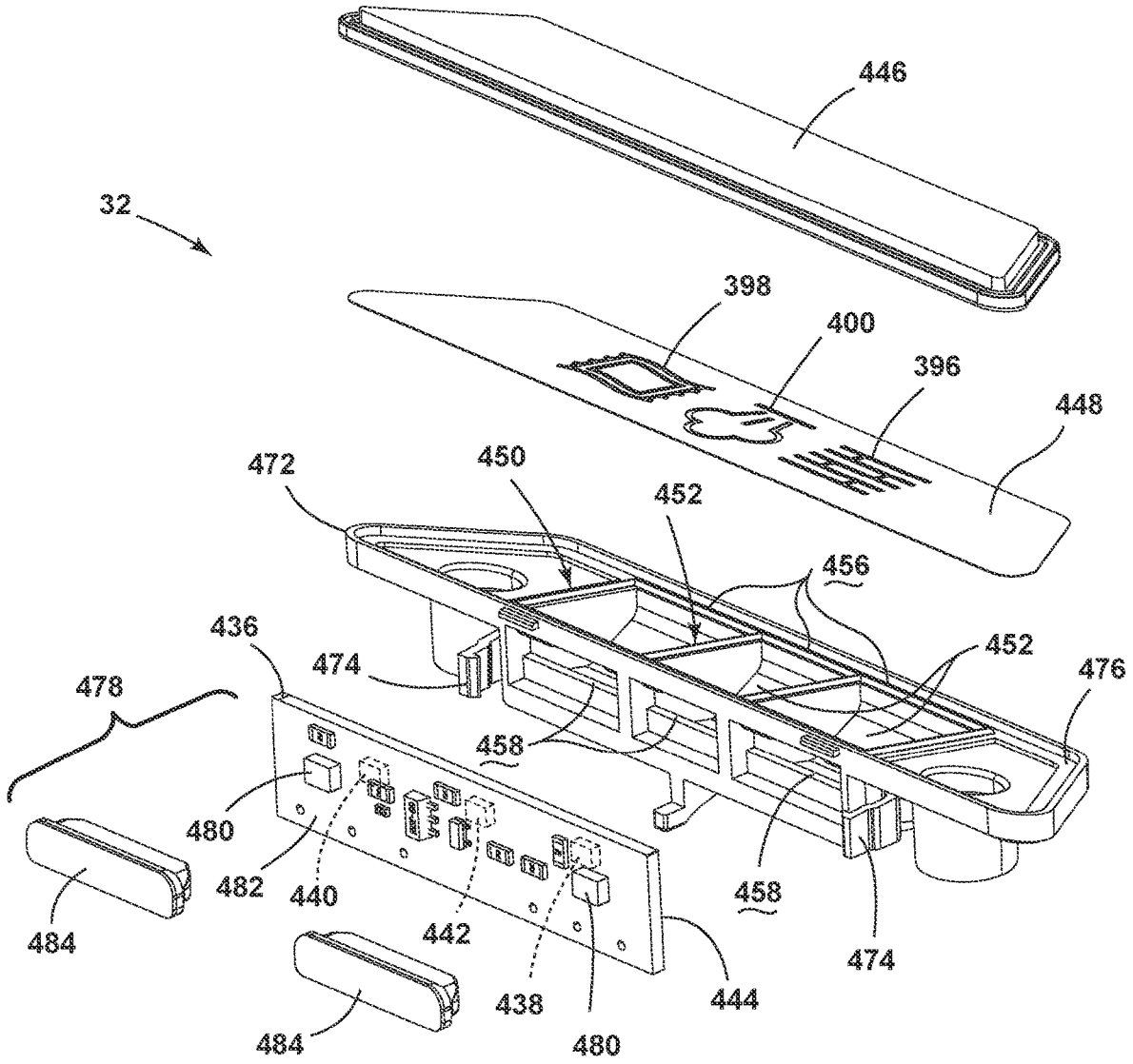
FIG. 27 is an exploded view of a second user interface for the floor cleaner.
Figure 28:
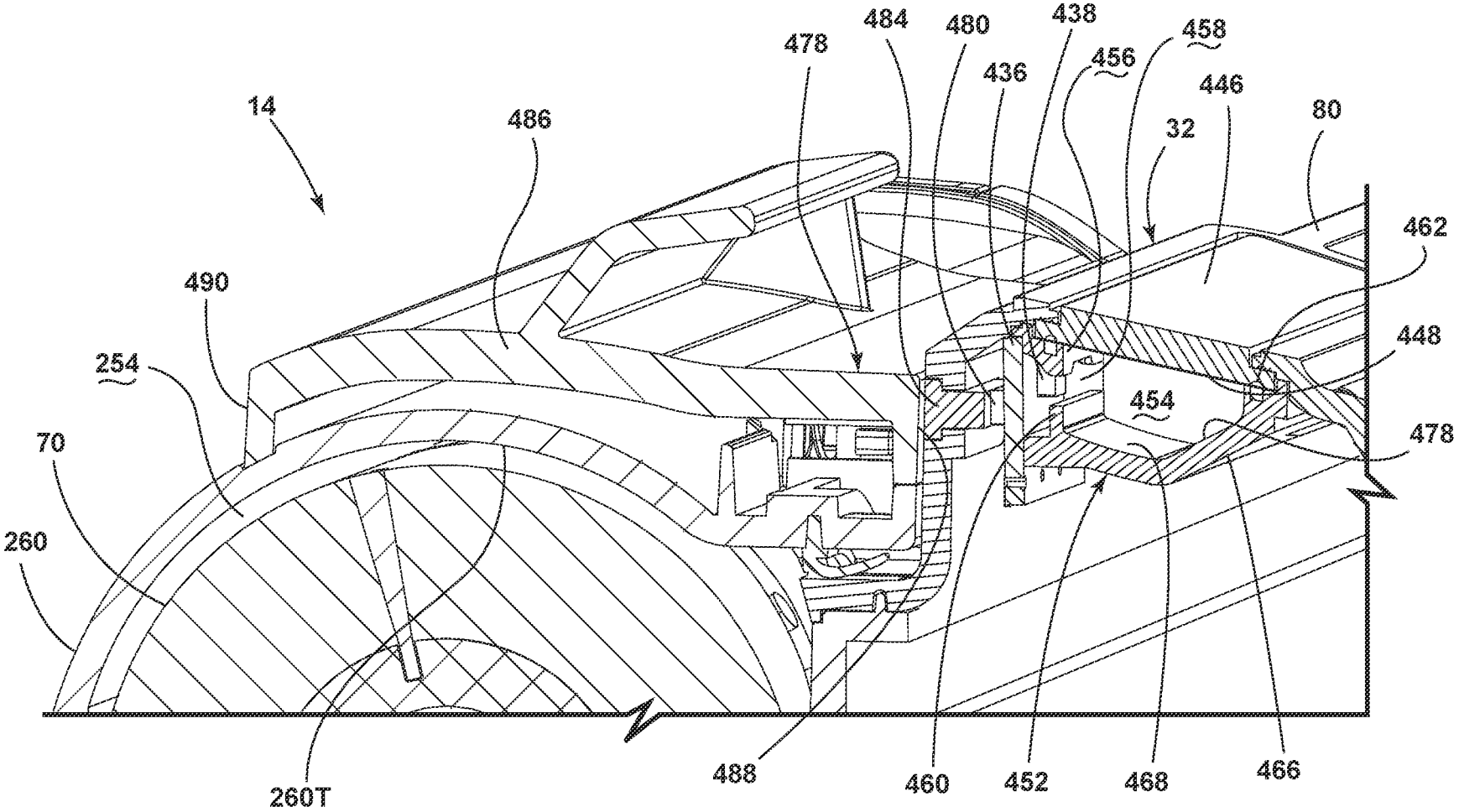
FIG. 28 is a cross-sectional view of the second user interface, taken through line XVIII-XVIII of FIG. 1.

FIG. 28 is a cross-sectional view through the second UI 32 and a portion of the base 14. The second UI 32 may include a second UI controller 436. The second UI controller 436 can include, in one embodiment, a PCB with illumination elements 438, 440, 442 (e.g. LEDs, shown in phantom line in FIG. 27) on a first surface 444 thereof that selectively emit light to illuminate the icons 396, 398, 400, respectively. While referred to herein as LEDs, it is understood any illumination element disclosed herein can comprise organic LEDs (OLEDs), chip-on-board LEDs, lasers or laser diodes, regular lamps (arc lamps, gas discharge lamps, etc.), bulbs, other light emitting devices, or combinations thereof, including comprising multiple light emitting devices.

According to an embodiment, each icon 396, 398, 400 is illuminated by a separate LED 438, 440, 442, respectively. The LEDs can emit visible light in one or more colors, such as, but not limited to, white, blue, orange, red, green, yellow, and the like. The LEDs can be configured to emit light in specific colors, wavelength ranges, and or patterns to convey information to the user. Alternatively or in addition, the LEDs may be adjustable by the user to emit light in different wavelength ranges or colors.

The second UI 32 includes a portion on the base 14 that is translucent or transparent, i.e. it permits light from the LED 438, 440, 442 positioned internally of the base 14 to emit light therethrough. In the embodiment shown, the portion comprises a lens 446, and the lens 446 forms an exterior surface of the base 14. The lens 446 can, for example, be mounted to the base housing 80, rearwardly of the cover 260 as shown in FIG. 14.

A film 448 is disposed in the light path between the LEDs 438, 440, 442 and the lens 446, and includes the icons 396, 398, 400. A portion of the film 448 blocks light from the LEDs 438, 440, 442 in the base 14 and a portion of the film permits light to emit there though. For example, the desired icons for the second UI 32 can be etched or otherwise formed on the film 448, such that light can proceed through the etched icons from the associated LED. The lens 446 covers and protects the film 448. In one embodiment, the film 448 can be adhered to a rear side of the lens 446. Various films are possible. In another embodiment, a masking layer, such as opaque paint, can be applied to an interior surface of the lens 446, and the icons 396, 398, 400 are etched in the masking layer.

The second UI 32 includes a baffle assembly 450 that surrounds the LEDs 438, 440, 442 to restrict the light produced by each LED to its specific associated icon 396, 398, 400, so that only one icon is illuminated by each LED. In one embodiment, the baffle assembly 450 comprises multiple individual baffle sections 452, with each baffle section 452 defining a light chamber 454. One icon 396, 398, 400 is aligned with an output opening 456 of one baffle section 452. Each baffle section 452 comprises an input opening 458 through which light from one LED can be emitted and project out through the icon 396, 398, 400 via the output opening 456. The baffle sections 452 are otherwise enclosed such that the light from an illuminated LED does not bleed over to the other icons, providing a clear indication to the user as to which mode is selected. At least a portion of the baffle sections 452 are opaque or otherwise impenetrable to light so as to not allow light from one baffle section 452 to pass through to another baffle section 452.

With reference to FIG. 28, which shows a cross-section of one representative baffle section 452, in one embodiment, the output and input openings 456, 458 of the baffle section 452 are positioned on different sides of the light chamber 454. For example, the input opening 458 is positioned on a first side 460 of the light chamber 454, which may be a forward side in some embodiments, and the output opening 456 is positioned on a second side 462 of the light chamber 454, which may be an upper side in some embodiments. With this configuration, the LED 438 can be disposed forwardly of the light chamber 454 and the film 448 can be disposed above the light chamber 454.

A reflector 466 can be provided in the baffle section 452 to reflect the light emitted by the LED 438 and evenly distribute the emitted light toward the output opening 456.

The reflector 466 can comprise one or more reflection surfaces 468, 470 in the baffle section 452. For example, one or more walls of the baffle section 452 may be reflective to form the reflection surfaces 468, 470. In another embodiment, a reflective film or coating is applied to one or more walls of the baffle section 452 to form the reflection surfaces 468, 470.

The shape of the reflector 466 can maximize the brightness of the back-lit icon 400. For example, reflector 466 can be angled, curved, or otherwise shaped so as to focus light toward the icon 400. Alternatively or additionally, reflector 466 may improve illumination uniformity of the back-lit icon 400. In one embodiment, the reflector 466 includes angled reflective surfaces 468, 470 generally positioned on a third side of the light chamber 454, which may be positioned below the second side 462 of the light chamber 454.

Referring to FIG. 27, a controller bracket 472 mounts the controller 436 to the baffle assembly 450. In one embodiment, the controller bracket 472 can include the baffle assembly 450, a controller mount 474 to attach the controller 436 to the baffle assembly 450, and a lens mount 476 to support the lens 446 over the baffle assembly 450. An injection molding process can be used to form the controller bracket 472. Alternatively, one or more of the baffle assembly 450, controller mount 474, and the lens mount 476 can be separately formed and assembled together.

With reference to FIG. 14, the floor cleaner 10 can include a headlight assembly 478 on the base 14 that illuminates a surface to be cleaned, or floor surface, exterior of the base 14. Various locations and configurations for the headlight assembly 478 are possible. In one embodiment, the headlight assembly 478 can be disposed on an upper side of the base 14, making the emitted visible light easy to see from the typical operating position of the user behind and above the base 14. In particular, the headlight assembly 478 is disposed above the brushroll 70, and outside the brush chamber 254.

In some embodiments, the headlight assembly 478 can be enclosed by the cover 260. The cover 260 can be formed at least partially from a transparent, semi-transparent, or translucent material, and may, for example, allow a user to view visible light emitted from the headlight assembly 478 from the typical operating position of the user behind and above the base 14.

Referring to FIG. 27, in one embodiment, the headlight assembly 478 can comprise at least one illumination element 480 (e.g. headlight LED), on a second surface 482 of the controller 436 that selectively emits light. The second surface 482 can be opposite the first surface 444, for example, with the first surface 444 facing rearwardly and the second surface 482 facing forwardly. Other orientations for the surfaces 444, 482 are possible. Utilizing one PCB and providing illuminations elements on both sides thereof conserves space in the base 14, minimizes cost, and simplifies the design of the base 14. To protect the LED 480, a headlight cover 484 is disposed over the LED 480. The cover 484 is translucent or transparent, i.e. it permits light from the LED 480 to shine therethrough. In the illustrated embodiment, two headlight LEDs 480 and covers 484 are provided, although other numbers are possible.

The covers 484 protect the LEDs, particularly when the brush cover 260 is removed from the base housing 80 as shown in FIG. 14. In addition to physical protection, the covers 484 can provide a fluid-tight barrier between the brush chamber 254 and the electronics of the controller 436. Optionally, the covers 484 may additionally function as a lens to focus the emitted light.

With reference to FIG. 28, in one embodiment, the brush cover 260 includes a light pipe 486 that transmits or conveys light from the LED 480 to the floor surface in front of the base 14. Thus, the internal LED 480 and light pipe 486 can together function as the headlight assembly 478 for illuminating a surface to be cleaned. In one embodiment, the portion of the cover 260 defining the top wall 260T of the brush chamber 254 can separate the light pipe 486 from the brush chamber 254.

The light pipe 486, in certain embodiments, can distribute light generated by the LEDs 480 across a width of the base 14 to increase the ability of the user to see the floor surface in front of the base 14. Utilizing the removable brush cover 260 as a light pipe for the headlight assembly 478 enables the LEDs 480 and associated wiring to remain on the base housing 80, while still providing light to the front of the base 14 via the removable cover 260. This further allows the LEDs 480 and associated wiring to be isolated from exposure to wet areas of the base 14.

The light pipe 486 can be any physical structure capable of transporting or distributing light from the LEDs 480 and that can be integrated with the cover 260. The light pipe 486 can be a hollow structure that contain the light with a reflective lining, or a transparent solid structure that contain the light by total internal reflection. In the illustrated example, light pipe 486 is a solid structure formed with the cover 260 and configured to distribute light over its length by total internal reflection. In one such embodiment, the light pipe 486 is integrally formed with the cover 260 and, thus, would be considered as being "coupled to the nozzle" during the formation process of the cover, which can be an injection molding process or an additive manufacturing process, for example.

The light pipe 486 can have an entrance end 488 aligned with the cover 484 and an exit end 490 disposed proximate a front of the base 14 for propagating light along a front of the base 14 at a front portion thereof. The entrance end 488 can be shaped to allow light emitted by the LED 480 to easily enter the light pipe 486 and to propagate internally. The entrance end 488 can have a prism (not shown), for example comprising a series of undulating curves, or other suitable shapes, at a light input location of the cover 260 to diffuse light through the light pipe 486. The light input location of the cover 260 can be an upper, rearward-facing end of the cover 260 disposed proximate to the headlight cover 484 when the cover 260 is mounted to the base housing 80.

The exit end 490 can be shaped to emit light outward from the base 14 to illuminate the floor surface. The exit end 490 can form a light emitting lens surface that emits light beams configured to converge on the floor surface for enhanced illumination of the area to be cleaned. The exit end 490 can be diffused to provide a uniform illuminated surface. With additional reference to FIG. 14, the cover 260 can include a stepped portion defining the exit end 490, the stepped portion being elongated in a lateral direction, which is parallel to a front of the base 14 and generally perpendicular to a direction of forward movement of the floor cleaner 10.

The headlight assembly 478 can be structured so that the headlight assembly 478 is not illuminated when the floor cleaner 10 is off and the headlight assembly 478 is illuminated when the floor cleaner 10 is on. Optionally, for a corded floor cleaner 10, the headlight assembly 478 can be illuminated when the floor cleaner 10 is plugged in, and before the power button 382 (FIG. 23) is pressed. For example, the headlight assembly 478 can illuminate at about 50% power when the floor cleaner 10 is plugged in and at 100% power when the power button 382 is pressed to turn the floor cleaner 10 on.

FIGS. 23-28 show but one configuration for the UIs 30, 32. It is understood that other layouts, buttons, status indicators, and/or icons are possible, including having the same buttons in a different layout, or having additional or fewer buttons, status indicators, and/or icons. For example, for a floor cleaner with fewer or more cleaning modes, the first UI 30 may accordingly include fewer or more mode buttons, and the second UI 32 may accordingly include fewer or more status indicators. In another example, rather than providing one mode button to toggle between different cleaning modes, a dedicated mode button for each cleaning mode may be provided. Other possible UI buttons, status indicators, and/or icons include, but are not limited to, other cleaning modes, battery status, Wi-Fi connection status, an empty supply container status, a full recovery container status, filter status, floor type, or any number of other status information.

Referring to FIG. 1, the floor cleaner 10 can be provided with a tray 492 that can be used to store and/or to self-clean the floor cleaner 10. The tray 492 can be configured to receive the base 14 of the floor cleaner 10 in an upright, stored position. The tray 492 can further be configured for further functionality, such as for charging the floor cleaner 10 in embodiments where the power source 74 (FIG. 3A) of the floor cleaner 10 is a rechargeable battery.

Figure 29:
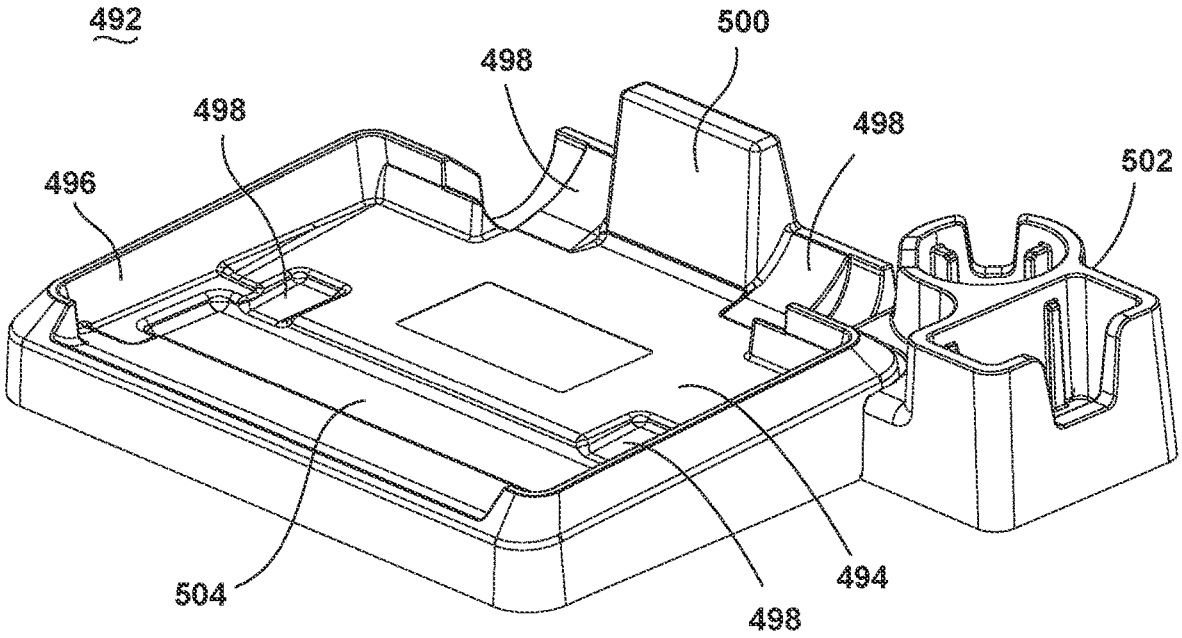
FIG. 29 is a perspective view of a tray for the floor cleaner.

FIG. 29 is a perspective view of one embodiment of the tray 492. The tray 492 can include a tray base 494 and guide walls 496 extending upwardly from the tray base 494 that help to align the base 14 within the tray 492. To help to properly align the base 14 on the tray 492, the tray base 494 can comprise one or more wheel holders 498 that at least partially receive wheels of the floor cleaner 10. A rear portion of the tray 492 can include a supporting rest 500 extending upwardly and configured to help align the base 14 within the tray 492 and prevent the floor cleaner 10 from tipping backward. For example, the joint assembly 34 and the supporting rest 500 can possess complementary shapes, with a rear side of the joint fitting against the rest 500. Optionally the tray 492 can include an accessory holder 502 for storing one or more accessories for the floor cleaner 10. The illustrated accessory holder 502 can removably receive the brushroll 70 and the filter assembly 170 for the purposes of storage and/or drying.

Figure 30:
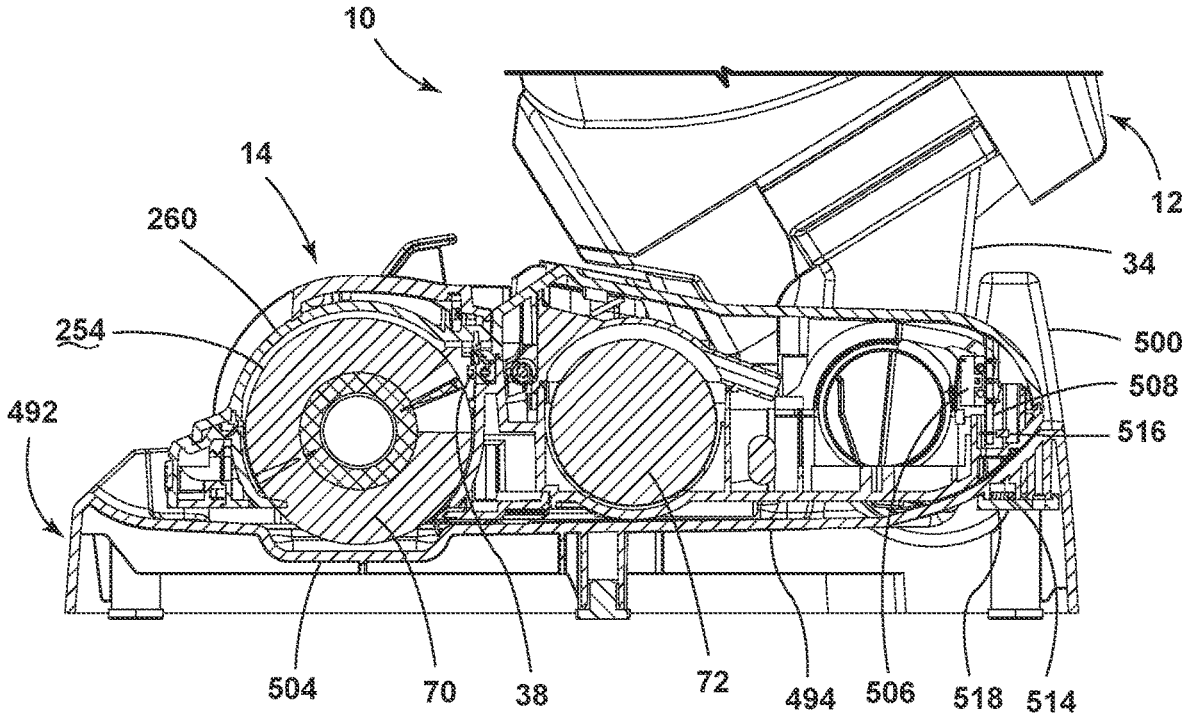
FIG. 30 is a cross-sectional view of the floor cleaner docked on the tray, taken through line XXX-XXX of FIG. 1.

In some embodiments, the tray 492 can function as a cleaning tray during the self-cleaning mode. Self-cleaning using the tray 492 can save the user considerable time and may lead to more frequent use of the floor cleaner 10. With reference to FIG. 30, the tray 492 can have a recessed portion in the form of a sump 504 in register with at least one of the brush chamber 254 and brushroll 70. Optionally, the sump 504 can create a closed loop between the fluid delivery and recovery systems of the floor cleaner 10 to flush out a recovery pathway between the suction inlet port 62 and the recovery tank 22 during self-cleaning.

In one aspect of the disclosure, operation of the self-cleaning mode may require that the floor cleaner 10 be docked on a tray 492 and/or another condition for self-cleaning be met. When not docked and/or when another condition for self-cleaning is not met, the clean-out cycle may be inoperable, e.g., selection of the clean-out cycle button 432 (FIG. 1) will not activate the self-cleaning mode. In some embodiments, the floor cleaner 10 is also prepared for self-cleaning by ensuring that the supply tank 20 contains a sufficient amount of cleaning liquid, such as water.

FIG. 30 is a cross-sectional view showing the floor cleaner 10 docked on the tray 492. When a floor cleaning operation has ceased, the floor cleaner 10 can be locked upright and placed onto the tray 492 for cleaning. The floor cleaner 10 can include a switch 506 to de-activate one or more components when the upright body 12 is in the upright stored position. When the upright body 12 is raised to and/or locked in the upright stored position, the switch 506 communicates with the main controller 76 to lock-out or disable fluid dispensing. Consequently, depressing the trigger 28 will not dispense liquid or steam. Aside from this function, the switch 506 is not particularly limited, and may comprise any components and/or configurations suitable for use in/as a switch. In one embodiment, the switch 506 is a normally-open (NO) switch disposed in a location to be closed when the upright body 12 is raised to and/or locked in the upright stored position. For example, the switch 506 can close when the joint lock 36 (FIG. 5) engages and locks the upright body 12 in the stored position. The switch 506 can open when the upright body 12 is reclined.

In one embodiment, with the floor cleaner 10 parked, e.g., the switch 506 closed, the floor cleaner 10 enters a stand-by mode in which the floor cleaner 10 remains powered on and one or more components are turned off. In one embodiment, the brush motor 72 is turned off in the stand-by mode. The vacuum motor 64 may remain on in the stand-by mode. To end the stand-by mode, the upright body 12 can be reclined to open the switch 506.

With reference to FIG. 5, in one embodiment, the switch 506 is provided on a PCB 508 in the base 14. The switch 506 can, for example be provided at a back corner 510 of the base, the back corner 510 being closer to the rear side 78B than the front side 78F, and closer to one lateral side 78R than the other lateral side 78L. The back corner 510 is preferably on a side of the base 14 opposite liquid-carrying components such as the pump 44, thereby protecting the switch 506 from exposure to liquid.

The floor cleaner 10 can include a detection mechanism that detects docking of the floor cleaner 10 on the tray 492. By detecting the tray 492, the self-cleaning mode can accordingly be enabled. The self-cleaning mode can be disabled when the tray 492 is not detected. In another embodiment, the tray 492 can include the detection mechanism.

The detection mechanism can include or be operably coupled with a switch 516 configured to enable the self-cleaning mode when the floor cleaner 10 is docked on the tray 492. If the floor cleaner 10 is not on the tray or incorrectly docked, the switch 516 is configured to open and disable the self-cleaning mode.

The detection mechanism can include various components for detecting when the floor cleaner 10 is docked and closing the activating switch 516. In one embodiment, the detection mechanism can include a detectable component 514, such as a permanent magnet, on the tray 492 and a sensing component, such as a Hall Effect sensor or a reed switch, on the floor cleaner 10 in a position to sense the detectable component when the floor cleaner 10 is docked on the tray 492. In embodiments in which the sensing component is a Hall Effect sensor, the Hall sensor may be arranged to act as the activating switch 516. When a magnetic field experienced by the Hall Effect sensor exceeds a pre-determined value, the Hall Effect sensor can change state. The Hall Effect sensor will again change state if a magnetic field experienced by the Hall Effect sensor falls below the pre-determined value. Thus, for purposes of the description reference numeral 516 may refer to the switch, sensing component, or Hall Effect sensor, although it is understood that in other embodiments, a separate activating switch and sensing component may be provided and is within the scope of the present subject matter.

The detectable component 514 is configured to be detected by the sensing component 516 within an effective sensing zone of the sensing component 516. Direct physical contact between the detectable component 514 and sensing component 516 is not required, as the effective sensing zone can detect the detectable component 514 within a predetermined distance away from the sensing component 516. The predetermined distance can be distance within which the detectable component 514 is spaced from the sensing component 516 when the floor cleaner 10 is correctly docked on the tray 492.

The detection mechanism is configured to enable the self-cleaning mode when the detectable component 514 is detected by the sensing component 516 and to disable the self-cleaning mode when the detectable component 514 is not detected by the sensing component 516. If the floor cleaner 10 is not on the tray 492 or incorrectly docked, the self-cleaning mode is prevented from operating.

In one embodiment, when the detectable component 514 is detected by the sensing component 516, selection of the self-cleaning mode via the clean-out cycle button 432 (FIG. 1) initiates the automated, unattended clean-out cycle. When the detectable component 514 is not detected by the sensing component 516 selection of the self-cleaning mode via the clean-out cycle button 432 does not initiate the automated, unattended clean-out cycle.

The main controller 76 detects the state of the switch, e.g. the state of the Hall Effect sensor 516. The controller 76 is arranged selectively to enable or disable the self-cleaning mode depending upon the state of the sensor 516. This in turn is dependent upon the distance between the Hall Effect sensor 516 and the permanent magnet 514. In some embodiments, when the clean-out cycle button 432 (FIG. 1) is pressed in an attempt to initiate the clean-out cycle, and the permanent magnet 514 is not detected by the Hall Effect sensor 516, the Hall Effect sensor 516 can send a signal to the controller 76 to cause the floor cleaner 10 to provide a status update to the user. For example, the floor cleaner 10 can deliver a visual and/or audio message to the user. The message may indicate to the user that the floor cleaner 10 must be correctly docked on the tray 492 before self-cleaning.

In another embodiment, the detection mechanism can include a mechanical sensing component, such as a moveable actuator (not shown), provided on the floor cleaner 10 or on the tray 492. When the floor cleaner 10 is docked, the actuator is forced to move and the activating switch 516 is closed.

In one embodiment, the magnet 514 is provided on an underside of the tray base 494 and is protected by a cover 518, and the Hall Effect sensor 516 is provided on the same PCB 508 as the detent switch 506. The PCB 508 can be disposed on a side of the base 14 opposite the pump and fluid lines, protecting the PCB 508 from exposure to liquid. For example, the PCB 508 can be disposed on the same side of the base 14 as the brush motor 72. By providing the PCB 508 rearward of the brushroll 70, brush chamber 254, and brush motor 72, the PCB 508 is less likely to become damaged or dirty.

Figure 31:
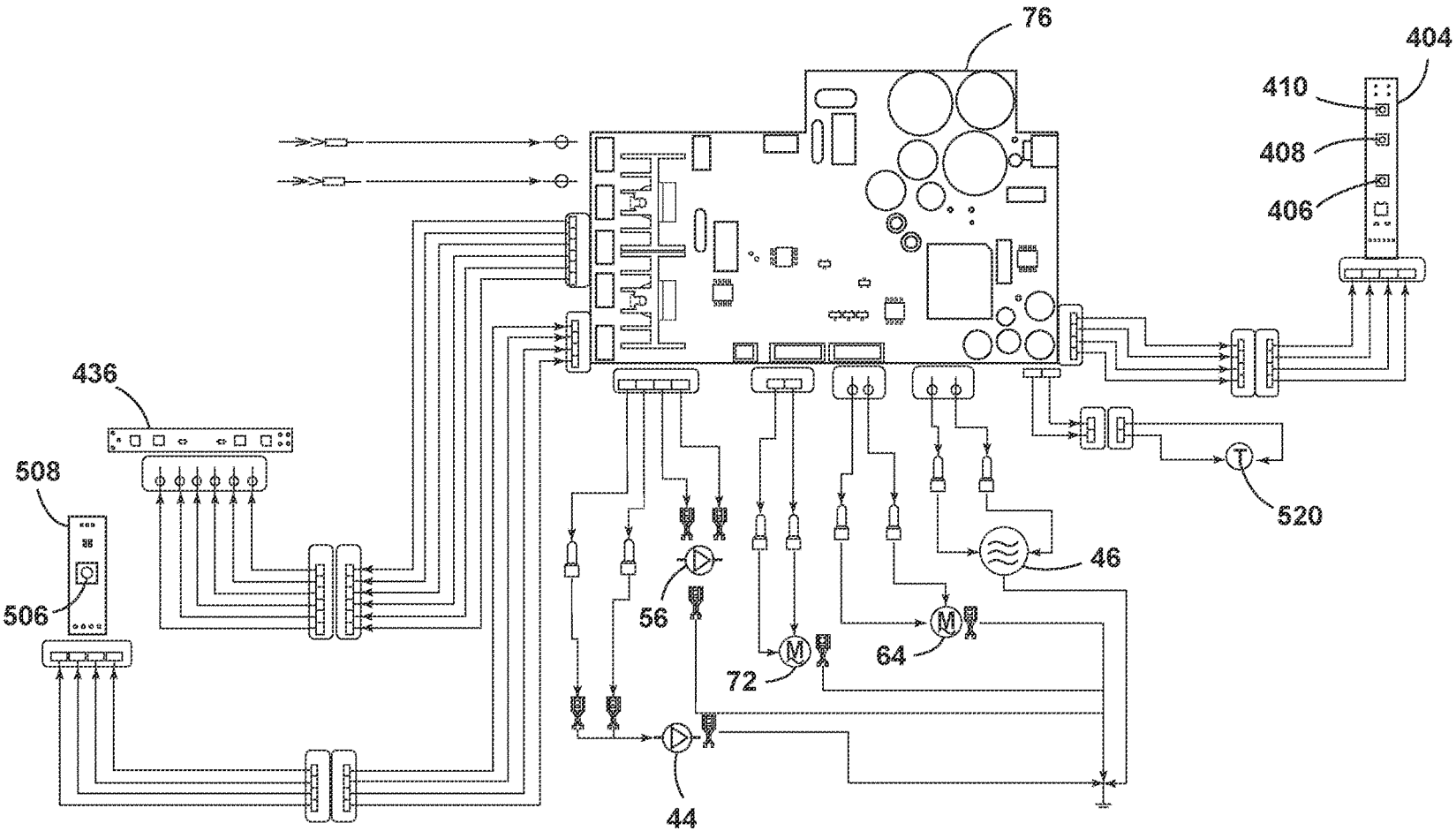
FIG. 31 is an electrical system schematic for the floor cleaner.

FIG. 31 is an electrical system schematic for the floor cleaner 10. Power to the heater 46, liquid pump 44, steam pump 56, brush motor 72, and vacuum motor 64 is controlled by the main controller 76. Input from the main controller 76 is provided to the UI controllers 404, 463 and detent controller 508, and vice versa.

When the floor cleaner 10 turns on, e.g. by a user pressing the power button 382 (FIG. 25) to close the power switch 406, the main controller 76 can execute the default operating mode. The main controller 76 executes the other cleaning modes upon selection of the other buttons to operate the mode switch 408 and/or steam switch 410.

Enablement of steam dispensing via the trigger 28 (FIG. 3A) may be temperature-dependent. Power to the steam pump 56 is controlled by a temperature sensor 520 that provides input to the main controller 76 to control when the steam pump 56 energizes to limit any unheated water from coming out of the steam dispenser 48 at the beginning of operation. The temperature sensor 520 senses temperature at the heater 46 and provides temperature input to the main controller 76. Such temperature input can be a signal or data corresponding to the actual temperature of the heater 46. Aside from this function, the temperature sensor 520 is not particularly limited, and may comprise any components and/or configurations suitable for use in/as a temperature sensor. In one embodiment, the temperature sensor 520 is a thermistor on the heater 46.

The main controller 76 can compare the temperature input to at least one threshold value, for example a predetermined minimum temperature. The minimum temperature can correspond to a minimum temperature at which a heated fluid having a minimum steam quality is produced by the heater 46. When the minimum temperature is met or exceeded, the main controller 76 enables the selection of the steam mode and, when the steam mode is selected, enables the trigger 28 to power the steam pump 56. Dispensing of steam is controlled by the trigger 28, as described above.

The minimum temperature may be, for example, about 120° C., alternatively about 130° C., alternatively about 140° C., although it is understood that the minimum temperature may vary depending on the design limits of the floor cleaner 10 and the desired quality of the dispensed heated fluid. The minimum temperature may be set based on an expected minimum operating temperature for the heater 46 that will produce heated fluid with a desired stream quality. For example, the minimum temperature can be a minimum temperature at which heated fluid having a steam quality of around 70% is produced by the heater 46.

The floor cleaner 10 can include at least one indicator to indicate to the user when the heater 46 is warming up and steam is ready and available for dispensing. The indicator can be mode-dependent. In one embodiment, the indicator is the steam icon 400 on the base 14 (FIG. 23). During a warm-up period after turning the heater 46 on via the power button 382 during which steam is not available to be dispensed, the steam icon 400 can be illuminated in a first state. Once the heater 46 reaches the minimum temperature as determined by the temperature sensor 520, and the main controller 76 powers the steam pump 56, the steam icon 400 can be illuminated in a second state. Various illumination states are contemplated, including, but not limited to being illuminated in an animated state, e.g. with a change pattern and/or changing characteristics over time, during warm-up and in a steady state, e.g., with generally continuous, unchanging characteristics over a period of time, when steam is ready, and/or being illuminated in an first color during warm-up and in a second color when steam is ready. Various animations are contemplated, including, but not limited to, a flashing animation. In a flashing animation, light intensity generally varies in a square wave fashion or in some other non-sinusoidal manner. This change in state can be based on input from the temperature sensor 520.

In some embodiments, the main controller 76 can compare the temperature input to at least one other threshold value, for example a predetermined maximum temperature. The maximum temperature can be a temperature at which the heater 46 may operate within the design limits of the surrounding components of the floor cleaner 10, and may also be a threshold above which heater 46 need not operated to produce a desired steam output for effective cleaning. When the maximum temperature is met or exceeded, the main controller 76 cuts off power to the heater 46 to allow the heater 46 to cool. Once the temperature of the heater 46 drops below the maximum temperature, the controller 76 supplies power to the heater 46 and the heater 46 is energized.

The predetermined maximum temperature may be, for example, about 160° C., alternatively about 170° C., alternatively about 180° C., alternatively about 190° C., alternatively 192° C., although it is understood that the maximum temperature may vary depending on the design limits of the floor cleaner 10 and the desired characteristics of the dispensed steam.

To the extent not already described, the different features and structures of the various embodiments of the invention, may be used in combination with each other as desired, or may be used separately. That one surface cleaning apparatus is illustrated herein as having all of these features does not mean that all of these features must be used in combination, but rather done so here for brevity of description. Thus, the various features of the different embodiments may be mixed and matched in various vacuum cleaner configurations as desired to form new embodiments, whether or not the new embodiments are expressly described.

The terms "comprising" or "comprise" are used herein in their broadest sense to mean and encompass the notions of "including," "include," "consist(ing) essentially of," and "consist(ing) of. The use of "for example," "e.g.," "such as," and "including" to list illustrative examples does not limit to only the listed examples. Thus, "for example" or "such as" means "for example, but not limited to" or "such as, but not limited to" and encompasses other similar or equivalent examples.

The above description relates to general and specific embodiments of the disclosure. However, various alterations and changes can be made without departing from the spirit and broader aspects of the disclosure as defined in the appended claims, which are to be interpreted in accordance with the principles of patent law including the doctrine of equivalents. As such, this disclosure is presented for illustrative purposes and should not be interpreted as an exhaustive description of all embodiments of the disclosure or to limit the scope of the claims to the specific elements illustrated or described in connection with these embodiments. Any reference to elements in the singular, for example, using the articles "a," "an," "the," or "said," is not to be construed as limiting the element to the singular.

Likewise, it is also to be understood that the appended claims are not limited to express and particular compounds, compositions, or methods described in the detailed description, which may vary between particular embodiments that fall within the scope of the appended claims. With respect to any Markush groups relied upon herein for describing particular features or aspects of various embodiments, different, special, and/or unexpected results may be obtained from each member of the respective Markush group independent from all other Markush members. Each member of a Markush group may be relied upon individually and or in combination and provides adequate support for specific embodiments within the scope of the appended claims.

The invention claimed is:

1. A surface cleaning apparatus, comprising:

an upright body comprising a handle and a frame;

a base assembly coupled with the upright body and adapted for movement across a surface to be cleaned, the base assembly comprising a brush chamber;

a moveable joint assembly mounting the base assembly to the upright body, wherein the upright body is pivotable via the joint assembly between an upright stored position and a reclined use position;

a recovery system comprising a recovery pathway, a suction inlet port on the base assembly in fluid communication with the brush chamber and at least partially defining the recovery pathway, a recovery tank at least partially defining the recovery pathway, and a vacuum motor in fluid communication with the suction inlet port;

a brushroll in the brush chamber and at least partially within the recovery pathway, the brushroll configured to rotate about an axis to agitate the surface to be cleaned;

a supply tank configured to store a supply of cleaning fluid;

a liquid dispenser; and a heater in fluid communication with the supply tank and configured to heat cleaning fluid to generate steam;

wherein the base assembly comprises a steam dispenser comprising:

a floor steam outlet to dispense steam toward the surface to be cleaned, wherein the floor steam outlet is forward of the brushroll, the brush chamber, and the liquid dispenser to dispense steam toward the surface to be cleaned in front of the brushroll, the brush chamber, and the liquid dispenser; and a steam vapor outlet to dispense steam away from the surface to be cleaned as visible steam vapor;

wherein the steam vapor outlet is fluidly isolated from the brush chamber.

2. The surface cleaning apparatus of claim 1, wherein the floor steam outlet is hidden under the base assembly and the steam vapor outlet is located on an exterior front side of the base assembly.

3. The surface cleaning apparatus of claim 1, wherein the steam dispenser comprises a first manifold in fluid communication with the steam vapor outlet to supply steam to the steam vapor outlet.

4. The surface cleaning apparatus of claim 3, wherein the first manifold comprises an inlet port in fluid communication with the heater to receive steam from the heater.

5. The surface cleaning apparatus of claim 3, wherein the first manifold includes a discharge port and a baffle guiding steam from the discharge port toward the steam vapor outlet, wherein the baffle has at least one 90° turn between the discharge port and the steam vapor outlet.

6. The surface cleaning apparatus of claim 3, wherein the steam dispenser comprises a second manifold in fluid communication with the floor steam outlet to supply steam to the floor steam outlet.

7. The surface cleaning apparatus of claim 6, wherein the first manifold is disposed above the second manifold.

8. A surface cleaning apparatus, comprising:

an upright body comprising a handle and a frame;

a base assembly coupled with the upright body and adapted for movement across a surface to be cleaned;

a moveable joint assembly mounting the base assembly to the upright body, wherein the upright body is pivotable via the joint assembly between an upright stored position and a reclined use position;

a recovery system comprising a recovery pathway, a suction inlet port on the base assembly at least partially defining the recovery pathway, a recovery tank at least partially defining the recovery pathway, and a vacuum motor in fluid communication with the suction inlet port;

a brushroll at least partially within the recovery pathway, the brushroll configured to rotate about an axis to agitate the surface to be cleaned;

a supply tank configured to store a supply of cleaning fluid;

a liquid dispenser; and a heater in fluid communication with the supply tank and configured to heat cleaning fluid to generate steam;

wherein the base assembly comprises a steam dispenser comprising:

a floor steam outlet to dispense steam toward the surface to be cleaned;

a steam vapor outlet to dispense steam away from the surface to be cleaned as visible steam vapor;

a first manifold in fluid communication with the steam vapor outlet to supply steam to the steam vapor outlet; and a second manifold in fluid communication with the floor steam outlet to supply steam to the floor steam outlet;

wherein the first manifold is in fluid communication with the second manifold via an outlet port.

9. The surface cleaning apparatus of claim 8, wherein the first manifold is vertically stacked with the second manifold, and the steam dispenser comprises a dividing wall separating the first manifold from the second manifold, the dividing wall including the outlet port.

10. The surface cleaning apparatus of claim 1, wherein the steam dispenser comprises a plurality of floor steam outlets and a plurality of steam vapor outlets.

11. The surface cleaning apparatus of claim 1, wherein:

the base assembly comprises a removable brush cover at least partially defining the brush chamber; and the steam vapor outlet is disposed forwardly of the brush chamber.

12. The surface cleaning apparatus of claim 1, wherein the liquid dispenser is positioned to dispense liquid onto the brushroll, and the steam dispenser is positioned to dispense steam in front of the brushroll.

13. A surface cleaning apparatus, comprising:

an upright body comprising a handle and a frame;

a base assembly coupled with the upright body and adapted for movement across a surface to be cleaned;

a moveable joint assembly mounting the base assembly to the upright body, wherein the upright body is pivotable via the joint assembly between an upright stored position and a reclined use position;

a recovery system comprising a recovery pathway, a suction inlet port on the base assembly at least partially defining the recovery pathway, a recovery tank at least partially defining the recovery pathway, and a vacuum motor in fluid communication with the suction inlet port;

a brushroll at least partially within the recovery pathway, the brushroll configured to rotate about an axis to agitate the surface to be cleaned;

a supply tank configured to store a supply of cleaning fluid;

a liquid dispenser;

a heater in fluid communication with the supply tank and configured to heat cleaning fluid to generate steam;

wherein the base assembly comprises a steam dispenser comprising:

a floor steam outlet to dispense steam toward the surface to be cleaned; and a steam vapor outlet to dispense steam away from the surface to be cleaned as visible steam vapor; and a controller configured to provide a plurality of modes of operation, the plurality of modes of operation comprising at least:

a first liquid cleaning mode in which liquid is dispensed from the liquid dispenser at a first flow rate;

a second liquid cleaning mode in which liquid is dispensed from the liquid dispenser at a second flow rate that is greater than the first flow rate; and a steam mode in which steam is dispensed from the steam dispenser, wherein the steam mode is executable in conjunction with one of the first liquid cleaning mode and the second liquid cleaning mode.

14. The surface cleaning apparatus of claim 13 comprising at least one of:

the first liquid cleaning mode dispensing liquid from the liquid dispenser at a flow rate of 45-70 ml/min;

the second liquid cleaning mode dispensing liquid from the liquid dispenser at a flow rate of 95-125 ml/min;

the steam mode dispensing steam from the steam dispenser at a flow rate of 20-40 ml/min;

the heater generating steam having a temperature of 90-100° C.; and the heater generating steam having a steam quality of 50-100%.

15. The surface cleaning apparatus of claim 13, comprising a status display on the base assembly, the status display comprising:

a plurality of illumination elements within the base assembly;

a plurality of icons representative of the plurality of modes of operation, the plurality of icons viewable at an upper side of the base assembly; and a baffle assembly having a plurality of baffle sections, each baffle section having an input opening aligned with one of the plurality of illumination elements, an output opening lighted with one of the plurality of icons, and a reflector to reflect light emitted by the one of the plurality of illumination elements toward the output opening.

16. The surface cleaning apparatus of claim 1, wherein the heater is disposed in a heater cavity on the upright body and comprises a heater inlet in fluid communication with the supply tank and a heater outlet in fluid communication with the steam dispenser, wherein the heater inlet and the heater outlet are disposed at a lower end of the heater.

17. The surface cleaning apparatus of claim 1, comprising a first pump disposed in a liquid supply path between the supply tank and the liquid dispenser and a second pump disposed in a steam supply path between the supply tank and the heater, wherein the heater and the second pump are disposed within the frame, and the liquid dispenser and the first pump are disposed on the base assembly.

18. The surface cleaning apparatus of claim 1, comprising:

a wiper adapted to contact the brushroll and disposed rearwardly of the steam dispenser; and a squeegee adapted to contact the surface to be cleaned, the squeegee disposed partially below the brushroll and rearward of the axis.

19. The surface cleaning apparatus of claim 1, wherein the recovery pathway extends from the suction inlet port to an exhaust vent defining a clean air outlet of the surface cleaning apparatus, wherein the exhaust vent is formed in the recovery tank and is fluidly downstream of the vacuum motor such that a portion of the recovery pathway downstream of the vacuum motor extends through a portion of the recovery tank including the exhaust vent.

20. The surface cleaning apparatus of claim 1, comprising:

a controller;

a detection mechanism that detects docking of the base assembly on a tray; and a self-cleaning mode in which an unattended, automatic cleanout mode of operation is executed to clean at least a portion of the recovery system;

wherein the controller is configured to enable the self-cleaning mode when the detection mechanism detects the base assembly on the tray and the controller is configured to disable the self-cleaning mode when the detection mechanism does not detect the base assembly on the tray.

* * * * *